US011180915B2

(12) United States Patent
Richardson et al.

(10) Patent No.: US 11,180,915 B2
(45) Date of Patent: Nov. 23, 2021

(54) LONGSPAN STAY-IN-PLACE LINERS

(71) Applicant: CFS Concrete Forming Systems Inc., Vancouver (CA)

(72) Inventors: George David Richardson, Vancouver (CA); Zi Li Fang, New Westminster (CA); Semion Krivulin, Richmond (CA)

(73) Assignee: CFS Concrete Forming Systems Inc., Vancouver (CA)

( * ) Notice: Subject to any disclaimer, the term of this patent is extended or adjusted under 35 U.S.C. 154(b) by 68 days.

(21) Appl. No.: 16/569,612

(22) Filed: Sep. 12, 2019

(65) Prior Publication Data

US 2020/0080306 A1 Mar. 12, 2020

Related U.S. Application Data

(63) Continuation of application No. PCT/CA2018/050409, filed on Apr. 3, 2018.
(Continued)

(51) Int. Cl.
*E04B 9/04* (2006.01)
*E04F 13/08* (2006.01)
*E04B 9/24* (2006.01)

(52) U.S. Cl.
CPC ..... *E04B 9/0435* (2013.01); *E04B 9/0457* (2013.01); *E04F 13/0833* (2013.01);
(Continued)

(58) Field of Classification Search
CPC ..... E04B 9/0435; E04B 9/0457; E04B 9/245; E04B 9/247; E04B 1/6815; E04F 13/0889; E04F 13/0894; E04F 13/0837
(Continued)

(56) References Cited

U.S. PATENT DOCUMENTS 154,179 A 8/1874 Hubert
374,826 A 12/1887 Clarke
(Continued)

FOREIGN PATENT DOCUMENTS

CA 0574720 4/1959
CA 0957816 11/1974
(Continued)

OTHER PUBLICATIONS 5 page PDF of machine translation of DE 202018104844 U1. (Year: 2018).*
(Continued)

*Primary Examiner* — Robert Canfield
(74) *Attorney, Agent, or Firm* — Todd A. Rattray; Oyen Wiggs Green & Mutala LLP

(57) ABSTRACT

A structure-lining apparatus comprising a plurality of transversely and longitudinally extending panels connectable to a structure and connectable edge-to-edge via complementary connector components on their longitudinally extending edges. Each panel comprises transversely extending edges generally orthogonal to their longitudinally extending edges. Each panel comprises first and second complementary connector components on first and second longitudinally extending edges thereof. The apparatus comprises at least one edge-to-edge connection between a first connector component of a first panel and a second connector component of a second panel wherein a primary male connector component of the second connector component of the second panel is extended into a primary female connector component of the first connector component of the first panel and a secondary male connector component of the first connector component of the first panel is extended into a secondary female connector component of the second connector component of the second panel.

17 Claims, 34 Drawing Sheets

Related U.S. Application Data

(60) Provisional application No. 62/578,287, filed on Oct. 27, 2017, provisional application No. 62/481,111, filed on Apr. 3, 2017.

(52) U.S. Cl.
CPC ..... *E04F 13/0894* (2013.01); *E04B 9/245* (2013.01); *E04F 13/0837* (2013.01)

(58) Field of Classification Search
USPC ..... 52/177, 483.1, 506.01, 573.1, 588.1, 52/592.1, 745.06, 747.1
See application file for complete search history.

(56) References Cited

U.S. PATENT DOCUMENTS 510,720 A 12/1893 Stewart, Jr.
820,246 A 5/1906 Nidds
1,035,206 A 8/1912 Lewen
1,080,221 A 12/1913 Jester
1,175,168 A 3/1916 Moulton
1,244,608 A 10/1917 Hicks
1,276,147 A 8/1918 White
1,345,156 A 6/1920 Flynn
1,423,879 A 7/1922 Potter
1,540,570 A 6/1925 Roberts
1,637,410 A 8/1927 Corybell
1,653,197 A 12/1927 Barnes
1,715,466 A 6/1929 Miller
1,820,897 A 8/1931 White et al.
1,875,242 A 8/1932 Hathaway
1,915,611 A 6/1933 Miller
1,963,153 A 6/1934 Schmieder
2,008,162 A 7/1935 Waddell
2,050,258 A 8/1936 Bemis
2,059,483 A 11/1936 Parsons
2,073,278 A 3/1937 Hohl
2,076,472 A 4/1937 London
2,164,681 A 7/1939 Fould
2,172,052 A 9/1939 Robbins
2,326,361 A 8/1943 Jacobsen
2,354,485 A 7/1944 Slaughter
2,845,685 A 8/1958 Lovgren et al.
2,861,277 A 11/1958 Hermann
2,871,619 A 2/1959 Walters
2,892,340 A 6/1959 Fort
2,928,115 A 3/1960 Hill
3,043,407 A * 7/1962 Marryatt ..... E04C 2/427 52/588.1
3,063,122 A 11/1962 Katz
3,100,677 A 8/1963 Frank et al.
3,128,851 A * 4/1964 Deridder et al. ..... E04C 2/08 52/588.1
3,152,354 A 10/1964 Diack
3,184,013 A 5/1965 Pavlecka
3,196,990 A 7/1965 Handley
3,199,258 A 8/1965 Jentoft et al.
3,220,151 A 11/1965 Goldman
3,242,834 A 3/1966 Sondheim
3,288,427 A 11/1966 Pluckebaum
3,291,437 A 12/1966 Bowden et al.
3,301,147 A * 1/1967 Clayton ..... E01C 9/083 404/35
3,385,182 A * 5/1968 Harvey ..... F16B 5/008 404/35
3,468,088 A 9/1969 Miller
3,545,152 A 12/1970 Knohl
3,555,751 A 1/1971 Thorgusen
3,555,762 A * 1/1971 Costanzo ..... E04F 15/02161 52/588.1
3,588,027 A 6/1971 Bowden
3,667,177 A 6/1972 Biela
3,682,434 A 8/1972 Boenig
3,688,460 A 9/1972 Van Loghem et al.
3,760,544 A 9/1973 Hawes et al.
3,769,769 A 11/1973 Kohl
3,788,020 A 1/1974 Gregori
3,813,839 A * 6/1974 Simpson, Jr. ..... E04D 3/30 52/506.1
3,822,557 A 7/1974 Frederick
3,886,705 A 6/1975 Cornland
3,951,294 A 4/1976 Wilson
3,991,636 A 11/1976 Devillers
4,023,374 A 5/1977 Colbert et al.
4,060,945 A 12/1977 Wilson
4,067,155 A 1/1978 Ruff et al.
4,104,837 A 8/1978 Naito
4,106,233 A 8/1978 Horowitz
4,114,388 A 9/1978 Straub
4,162,640 A 7/1979 Arnold
4,180,956 A 1/1980 Gross
4,182,087 A 1/1980 Schall et al.
4,193,243 A 3/1980 Tiner
4,276,730 A 7/1981 Lewis
4,299,070 A 10/1981 Ottmanns et al.
4,315,390 A 2/1982 Schaafsma
4,332,119 A 6/1982 Toews
4,351,870 A 9/1982 English
4,383,674 A 5/1983 Fricker
4,385,850 A 5/1983 Bobath
4,386,543 A 6/1983 Walker, Jr.
4,430,831 A 2/1984 Kemp
4,433,522 A 2/1984 Yerushalmi
4,434,597 A 3/1984 Fischer
4,508,310 A 4/1985 Schultz
4,532,745 A 8/1985 Kinard
4,543,764 A 10/1985 Kozikowski
4,550,539 A 11/1985 Foster
4,553,875 A 11/1985 Casey
4,575,985 A 3/1986 Eckenrodt
4,581,864 A 4/1986 Shvakhman et al.
4,601,149 A 7/1986 Dokan
4,606,167 A 8/1986 Thorne
4,633,558 A 1/1987 Spaulding
4,695,033 A 9/1987 Imaeda et al.
4,703,602 A 11/1987 Pardo
4,731,964 A 3/1988 Phillips
4,736,563 A 4/1988 Bilhorn
4,731,971 A 5/1988 Terkl
4,742,665 A 5/1988 Baierl
4,754,668 A 7/1988 Oetiker
4,808,039 A 2/1989 Fischer
4,856,754 A 8/1989 Yokota et al.
4,866,891 A 9/1989 Young
4,892,052 A * 1/1990 Zook ..... B63B 3/48 114/355
4,912,900 A 4/1990 Yeamans
4,913,576 A 4/1990 Grant, Jr.
4,930,282 A 6/1990 Meadows
4,946,056 A 8/1990 Stannard
4,951,992 A * 8/1990 Hockney ..... B62D 25/2054 105/422
4,995,191 A 2/1991 Davis
5,014,480 A 5/1991 Guarriello et al.
5,028,368 A 7/1991 Grau
5,050,362 A * 9/1991 Tai ..... E04F 13/18 52/588.1
5,058,855 A 10/1991 Ward
5,078,360 A 1/1992 Spera
5,106,233 A 4/1992 Breaux
5,124,102 A 6/1992 Serafini
5,155,952 A 10/1992 Herwegh et al.
5,170,605 A * 12/1992 Huddle ..... B60P 3/20 52/588.1
5,185,193 A * 2/1993 Phenicie ..... B65D 90/026 220/1.5
5,187,843 A 2/1993 Lynch
5,216,863 A 6/1993 Nessa et al.
5,243,805 A 9/1993 Fricker
5,247,773 A 9/1993 Weir
5,265,750 A 11/1993 Whiteley
5,292,208 A 3/1994 Berger
5,311,718 A 5/1994 Trousilek

(56) References Cited

U.S. PATENT DOCUMENTS 5,392,576 A 2/1995 Yeamans
5,465,545 A 11/1995 Trousilek
5,489,468 A 2/1996 Davidson
5,491,947 A 2/1996 Kim
5,513,474 A 5/1996 Scharkowski
5,516,863 A 5/1996 Abusleme et al.
5,553,430 A 9/1996 Majnaric et al.
5,591,265 A 1/1997 Tusch
5,608,999 A 3/1997 McNamara
5,625,989 A 5/1997 Brubaker et al.
5,678,383 A 10/1997 Danielewicz
5,714,045 A 2/1998 Lasa et al.
5,729,944 A 3/1998 De Zen
5,740,648 A 4/1998 Piccone
5,747,134 A 5/1998 Mohammed et al.
5,758,467 A * 6/1998 Snear ..... E04C 2/20 52/177
5,791,103 A 8/1998 Coolman
5,816,010 A * 10/1998 Conn ..... E04C 2/08 52/588.1
5,824,347 A 10/1998 Serafini
5,860,262 A 1/1999 Johnson
5,860,267 A * 1/1999 Pervan ..... E04F 15/04 52/748.1
5,876,810 A * 3/1999 Bodine ..... E04B 9/245 428/33
5,953,880 A 9/1999 De Zen
5,987,830 A 11/1999 Worley
6,053,666 A 4/2000 Irvine et al.
6,151,856 A 11/2000 Shimonohara
6,161,989 A 12/2000 Kotani et al.
6,167,669 B1 1/2001 Lane
6,167,672 B1 1/2001 Okitomo
6,185,884 B1 2/2001 Myers et al.
6,189,269 B1 2/2001 De Zen
6,199,340 B1 * 3/2001 Davis ..... C08L 23/10 52/100
6,205,733 B1 3/2001 LaLonde
6,212,845 B1 4/2001 De Zen
6,219,984 B1 4/2001 Piccone
6,220,779 B1 4/2001 Warner et al.
6,226,950 B1 * 5/2001 Davis ..... C08L 23/10 52/100
6,247,280 B1 6/2001 Grinshpun et al.
6,286,281 B1 9/2001 Johnson
6,293,067 B1 9/2001 Meendering et al.
6,387,309 B1 5/2002 Kojima
6,405,508 B1 6/2002 Janesky
6,435,470 B1 8/2002 Lahham et al.
6,435,471 B1 8/2002 Piccone
6,438,918 B2 8/2002 Moore et al.
6,467,136 B1 10/2002 Graham
6,530,185 B1 3/2003 Scott et al.
6,550,194 B2 4/2003 Jackson et al.
6,584,748 B2 * 7/2003 Bresnahan ..... E04C 2/427 52/650.3
6,588,165 B1 7/2003 Wright
6,622,452 B2 9/2003 Alvaro
6,691,976 B2 2/2004 Myers et al.
6,694,692 B2 2/2004 Piccone
6,711,870 B1 3/2004 Richardson
6,832,456 B1 12/2004 Bilowol
6,866,445 B2 3/2005 Semler
6,935,081 B2 8/2005 Dunn et al.
7,007,433 B2 * 3/2006 Boyer ..... E04C 2/292 52/309.9
7,188,576 B2 * 3/2007 Bogard ..... B63B 73/43 114/85
7,320,201 B2 1/2008 Kitchen et al.
7,406,801 B2 * 8/2008 Zeng ..... E04F 15/02161 52/177
7,415,801 B2 * 8/2008 Zeng ..... F24D 3/127 52/177
7,444,788 B2 11/2008 Morin et al.
7,584,583 B2 * 9/2009 Bergelin ..... E04F 15/02172 52/588.1
7,763,345 B2 7/2010 Chen et al.
7,765,762 B2 8/2010 Gulbrandsen et al.
7,818,936 B2 10/2010 Morin et al.
7,901,537 B2 3/2011 Jones et al.
8,071,193 B2 12/2011 Windmöller
8,074,418 B2 12/2011 Thiagarajan et al.
8,099,921 B2 1/2012 Muehlebach
8,136,321 B1 3/2012 Bauman
8,316,598 B2 * 11/2012 Flynn ..... E04C 2/20 52/235
8,322,102 B2 12/2012 Krieger
8,485,493 B2 7/2013 Wells et al.
8,544,232 B2 10/2013 Wybo et al.
8,707,648 B2 4/2014 Timko et al.
8,769,904 B1 7/2014 Brandt et al.
8,806,839 B2 8/2014 Zhou
8,859,898 B2 10/2014 Frye
8,925,275 B2 1/2015 Meersseman et al.
8,959,871 B2 2/2015 Parenti et al.
8,985,888 B2 3/2015 Kawasaki
9,003,737 B2 4/2015 Solomon et al.
9,156,233 B2 10/2015 Dossche et al.
9,328,518 B2 5/2016 Bilge
9,347,226 B2 * 5/2016 Ouellet ..... E04F 15/02016
9,745,758 B2 8/2017 Baert et al.
9,993,340 B2 6/2018 Foroni et al.
10,246,883 B2 4/2019 Derelov
10,287,777 B2 5/2019 Boo
10,400,457 B2 9/2019 Simon
10,480,186 B2 11/2019 Tanguay et al.
10,563,410 B2 2/2020 Horton et al.
10,619,357 B2 4/2020 Segaert et al.
10,731,333 B2 8/2020 Richardson et al.
2002/0095895 A1 7/2002 Daly et al.
2003/0005659 A1 1/2003 Moore, Jr.
2003/0085482 A1 5/2003 Sincock et al.
2003/0155683 A1 8/2003 Pietrobon
2004/0010994 A1 1/2004 Piccone
2004/0093817 A1 5/2004 Pujol Barcons
2005/0016083 A1 1/2005 Morin et al.
2005/0016103 A1 1/2005 Piccone
2005/0055938 A1 * 3/2005 Secondino ..... A47F 5/0846 52/506.01
2006/0179762 A1 8/2006 Thome et al.
2006/0185270 A1 8/2006 Handley et al.
2006/0213140 A1 9/2006 Morin et al.
2006/0251865 A1 11/2006 Hinterneder
2007/0044416 A1 * 3/2007 Van Dijk ..... E04F 15/10 52/650.3
2007/0193169 A1 8/2007 Emblin
2008/0163664 A1 7/2008 Battenfeld
2009/0120027 A1 5/2009 Amend
2009/0229214 A1 8/2009 Nelson
2009/0269130 A1 10/2009 Williams
2010/0047608 A1 2/2010 Seccombe
2010/0050552 A1 3/2010 David
2010/0071304 A1 3/2010 Richardson et al.
2010/0212241 A1 8/2010 Holroyd
2010/0251657 A1 10/2010 Richardson et al.
2010/0325984 A1 12/2010 Richardson et al.
2011/0000161 A1 1/2011 Aube
2011/0131914 A1 6/2011 Richardson et al.
2011/0146189 A1 6/2011 Courey
2011/0277410 A1 11/2011 Richardson
2012/0056344 A1 3/2012 Richardson et al.
2012/0121337 A1 5/2012 Richardson et al.
2012/0192515 A1 * 8/2012 Petta ..... E04F 15/02183 52/302.1
2013/0081345 A1 4/2013 Sheehy
2014/0305063 A1 * 10/2014 Kim ..... E04F 13/0805 52/489.1
2014/0360121 A1 * 12/2014 Richardson ..... E04F 13/24 52/588.1
2015/0082724 A1 3/2015 Amend
2016/0340899 A1 11/2016 Piccone
2016/0376799 A1 12/2016 Richardson et al.

(56) References Cited

U.S. PATENT DOCUMENTS

| | | | | |
|---|---|---|---|---|
| 2017/0218627 | A1 | 8/2017 | Neil | |
| 2019/0032341 | A1 | 1/2019 | Fleet | |
| 2020/0131780 | A1 * | 4/2020 | De Rick | E04F 13/0894 |

FOREIGN PATENT DOCUMENTS

| | | | | | |
|---|---|---|---|---|---|
| CA | 1316366 | | | 4/1993 | |
| CA | 2097226 | | | 11/1994 | |
| CA | 2141463 | | | 8/1996 | |
| CA | 2070079 | | | 6/1997 | |
| CA | 2170681 | | | 8/1997 | |
| CA | 2218600 | | | 6/1998 | |
| CA | 2215939 | | | 8/1999 | |
| CA | 2226497 | | | 10/1999 | |
| CA | 2243905 | | | 1/2000 | |
| CA | 2255256 | | | 1/2000 | |
| CA | 2244537 | | | 2/2000 | |
| CA | 2418885 | | | 8/2003 | |
| CA | 2502343 | | | 5/2004 | |
| CA | 2502392 | | | 5/2004 | |
| CA | 2499450 | | | 9/2005 | |
| CA | 2577217 | | | 1/2006 | |
| CA | 2629202 | | | 4/2008 | |
| CA | 2716118 | | | 8/2008 | |
| CA | 2681963 | | | 10/2008 | |
| CA | 2654992 | AA | | 8/2010 | |
| CA | 2751134 | | | 12/2011 | |
| CA | 2855742 | | | 5/2013 | |
| CA | 2810538 | | | 9/2014 | |
| CA | 2979918 | A1 | | 3/2018 | |
| CH | 317758 | | | 1/1957 | |
| CH | 401422 | A | * | 10/1965 | E04F 13/18 |
| CH | 569235 | | | 2/1989 | |
| CN | 2272915 | Y | * | 1/1998 | |
| CN | 2529936 | | | 1/2003 | |
| CN | 105781053 | A | | 7/2016 | |
| DE | 1684357 | | | 4/1967 | |
| DE | 1812590 | | | 6/1970 | |
| DE | 2062723 | | | 8/1972 | |
| DE | 3003446 | | | 8/1981 | |
| DE | 3202385 | A1 | * | 8/1983 | E04C 2/405 |
| DE | 3234489 | | | 3/1984 | |
| DE | 3727956 | | | 5/1988 | |
| DE | 3918676 | A1 | * | 8/1990 | E04B 2/721 |
| DE | 19503948 | A1 | | 8/1996 | |
| DE | 29803155 | | | 6/1998 | |
| DE | 20017114 | U1 | | 1/2001 | |
| DE | 202014006376 | U1 | | 12/2014 | |
| DE | 202018104844 | U1 | * | 10/2018 | E04F 13/0837 |
| DE | 202018107451 | U1 | * | 3/2019 | E04F 15/06 |
| EP | 0025420 | | | 3/1981 | |
| EP | 0055504 | | | 7/1982 | |
| EP | 0141782 | | | 5/1985 | |
| EP | 0179046 | | | 4/1986 | |
| EP | 0381339 | A2 | | 8/1990 | |
| EP | 0735226 | A2 | * | 10/1996 | E06B 3/485 |
| EP | 0757137 | | | 2/1997 | |
| EP | 1854937 | A1 | | 11/2007 | |
| EP | 2169133 | | | 3/2010 | |
| FR | 0507787 | | | 7/1920 | |
| FR | 1381945 | | | 11/1964 | |
| FR | 1603005 | | | 4/1971 | |
| FR | 2364314 | | | 4/1978 | |
| FR | 2535417 | | | 5/1984 | |
| FR | 2721054 | | | 6/1994 | |
| FR | 2717848 | | | 9/1995 | |
| FR | 2733264 | A1 | * | 10/1996 | E04F 13/0889 |
| FR | 2669364 | | | 3/2012 | |
| GB | 137221 | | | 1/1920 | |
| GB | 779916 | | | 7/1957 | |
| GB | 1243173 | | | 8/1971 | |
| GB | 1253447 | | | 11/1971 | |
| GB | 2141661 | | | 1/1985 | |
| GB | 2205624 | | | 12/1988 | |
| JP | 05133028 | | | 5/1993 | |
| JP | 09041612 | | | 2/1997 | |
| JP | 2008223335 | | | 9/2008 | |
| NL | 2013486 | | | 1/2017 | |
| SE | 206538 | | | 8/1966 | |
| WO | 8204088 | | | 11/1982 | |
| WO | 9500724 | | | 1/1995 | |
| WO | 9607799 | | | 3/1996 | |
| WO | 9635845 | | | 11/1996 | |
| WO | 9743496 | | | 11/1997 | |
| WO | 0163066 | | | 8/2001 | |
| WO | 0173240 | | | 10/2001 | |
| WO | 03006760 | | | 1/2003 | |
| WO | 2004088064 | | | 10/2004 | |
| WO | 2005040526 | | | 5/2005 | |
| WO | 08119178 | | | 10/2008 | |
| WO | 09059410 | | | 5/2009 | |
| WO | 09092158 | | | 7/2009 | |
| WO | 2010012061 | | | 2/2010 | |
| WO | 2010037211 | | | 4/2010 | |
| WO | 2010078645 | | | 7/2010 | |
| WO | 2010094111 | | | 8/2010 | |
| WO | 2012003587 | | | 1/2012 | |
| WO | 2013075250 | | | 5/2013 | |
| WO | 2013075251 | | | 5/2013 | |
| WO | 2013102274 | | | 7/2013 | |
| WO | 2013102275 | | | 7/2013 | |
| WO | 2013177715 | | | 12/2013 | |
| WO | 2013188980 | | | 12/2013 | |
| WO | 2014121337 | | | 8/2014 | |
| WO | 2015081445 | | | 6/2015 | |
| WO | 2015149187 | | | 10/2015 | |
| WO | 2017113016 | | | 7/2017 | |
| WO | 2017/132477 | A1 | | 8/2017 | |
| WO | 2019/197393 | A1 | | 10/2019 | |

OTHER PUBLICATIONS 12 page PDF of machine translation of DE 20 2018 107 451 U1. (Year: 2019).*

Vector Corrosion Technologies Marketing Materials, 2005.

Vector Corrosion Technologies Marketing Materials, 2007.

Vector Corrosion Technologies Marketing Materials, 2008.

Digigraph Brochure, Building Systems using PVC extrusions and concrete, accessed online Jan. 2012.

Digigraph Guide, Digigraph Systems Inc., Installation Guide for the Digigraph Construction System Composed of PVC Extrusions and Concrete, accessed online Jan. 2012.

The Digigraph System, http://www.digigraph-housing.com/web/system.ht, accessed online Jan. 2012.

* cited by examiner

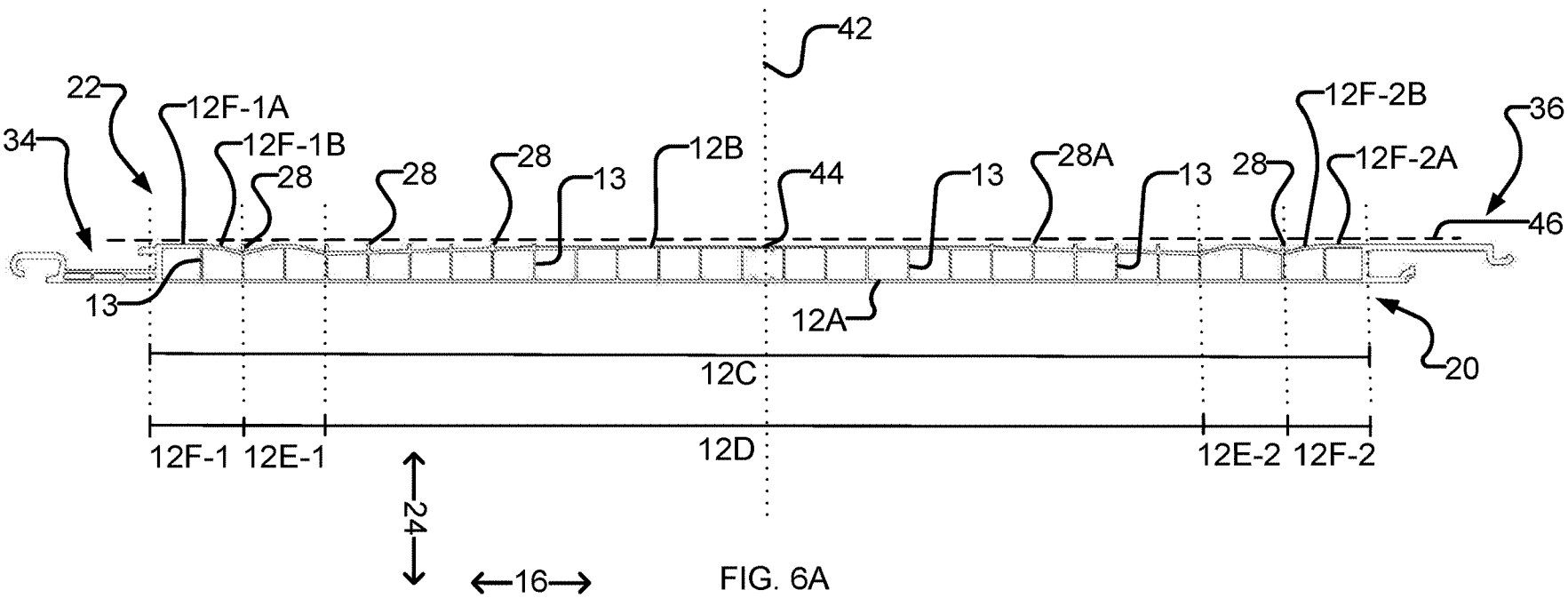
FIG. 6A
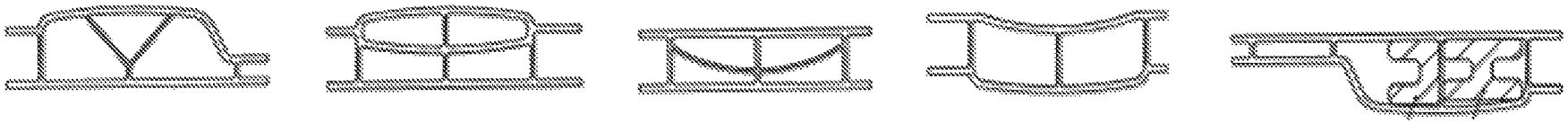
FIG. 6B
FIG. 6C
FIG. 6D
FIG. 6E
FIG. 6F

LONGSPAN STAY-IN-PLACE LINERS

RELATED APPLICATIONS

This application is a continuation of Patent Cooperation Treaty (PCT) application No. PCT/CA2018/050409 having an international filing date of 3 Apr. 2018. PCT application No. PCT/CA2018/050409 in turn claims priority from (and the benefit under 35 USC § 119 of) U.S. application No. 62/578,287 filed 27 Oct. 2017 and U.S. application No. 62/481,111 filed 3 Apr. 2017. All of the applications referenced in this paragraph are hereby incorporated herein by reference.

TECHNICAL FIELD

This invention relates to structure lining apparatus. Particular embodiments of the invention provide structure lining apparatus for ceilings.

BACKGROUND

In some buildings or structures, walls and/or ceilings may be provided by one or more panels or claddings to improve aesthetics, facilitate cleaning, improve hygiene, etc.

A problem with prior art systems is that panels employed for ceilings tend to sag (e.g. in the inward-outward direction) under their own weight and the weight of anything supported by the panels (e.g. insulation). In other words, panels that have a relatively flat shape may develop a relatively convex shape. Sagging may occur across one or both of the longitudinal dimension of a panel and the transverse dimension of the panel. Typically, a region near the center of an unsupported region of a panel (e.g. a region that experiences sag in both the transverse and longitudinal dimensions) exhibits a maximum amount of sag.

Deformation of panels due to sagging can lead to a number of related problems including, without limitation, unsightly ceiling appearance, panel fatigue, reduction in structural integrity and/or the like.

One way to reduce sag is to reduce the length of unsupported sections of panel. This can be accomplished by increasing the number of roof trusses (or other supports for the panels). However, this technique is known to raise construction time and costs.

There is accordingly a general desire to provide a structure lining apparatus that minimizes and/or otherwise reduces (in relation to the prior art) outward deformation of panels due to sagging, without increasing construction time and costs.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

FIG. 6A is a cross-sectional profile view of a panel of the structure cladding apparatus of the FIG. 2 embodiment.

FIGS. 6B to 6F are cross-sectional profile views of portions of a panel according to another embodiment of a structure cladding apparatus.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Particular aspects of the invention provide modular methods and apparatus for providing lining surfaces of a structure. In particular embodiments, a portion of a structure is lined with a structure lining apparatus comprising a plurality of structure lining panels and a plurality of panel-to-panel connector components to create a lining surface. The panels, which may extend in longitudinal and transverse directions, are interconnected with one another in edge-to-edge relationship at their longitudinally extending edges by the panel-to-panel connector components, to line at least a portion of the structure. The panel-to-panel connector components may: be integrally formed with the panels or connect to the panels via suitably configured connector components. The panel-to-panel connector components may comprise features which may extend in the longitudinal and transverse directions (e.g. in a plane parallel to the panels). In particular embodiments, the connecting features comprise double male/female connections. In some embodiments, the complementary connector components may be shaped to form a locked configuration by pivoting and/or sliding the connector components relative to one another.

In particular embodiments, the portion of the structure to be lined comprises a portion of a ceiling of the structure. In such embodiments, complementary connector components may be shaped such that a first connector component of a first panel can be at least partially suspended from a second connector component of a second panel during installation. In some embodiments, the suspended second panel may be connected to the first panel by pivoting the second panel and then sliding the first and second connector components toward one another to engage primary male and female connectors and optionally secondary male and female connectors of the first and second connector components to achieve a locked configuration.

Figure 1:
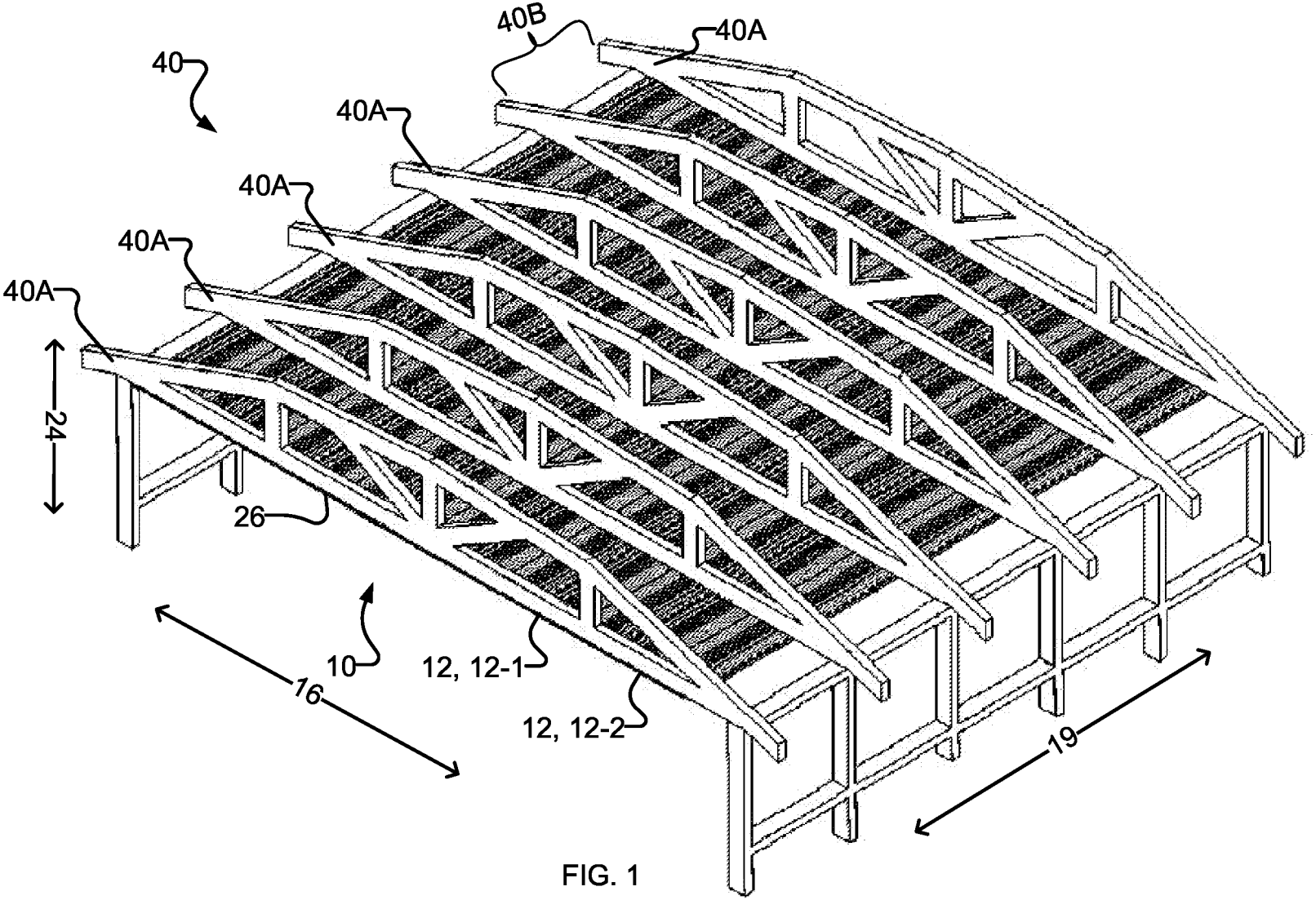
FIG. 1 is an elevated perspective view of a structure having a ceiling partially clad by a structure lining apparatus according to one embodiment of the invention.

One particular non-limiting example of a structure that might be lined with a structure lining apparatus according to the invention is a building have a roof supported by roof trusses, such as, a barn or hangar or any other building structure. In other embodiments, the structure may have a ceiling lined with plywood, or the like. FIG. 1 depicts a building having a roof supported by a plurality of roof trusses 40A. Roof trusses 40A extend in the transverse direction 16 (shown by double-headed arrow 16) and inward-outward direction 24 (shown by double-headed arrow 24). In particular embodiments, a plurality of panels may be attached to roof trusses 40A such that each panel is attached to a plurality of roof trusses 40A at locations spaced apart along the panel in the longitudinal direction by spaces 40B and the plurality of panels may be attached to one another in an edge-to-edge relationship to extend across at least a portion of a transverse width of the plurality of roof trusses 40A.

FIG. 1 depicts a structure lining apparatus 10 according to a particular non-limiting embodiment of the invention. In the illustrated embodiment, structure-lining apparatus 10 is a lining apparatus used to line a ceiling of building structure 40. Structure lining apparatus 10 comprises a plurality of generally planar panels 12 which extend in a longitudinal dimension (shown by double-headed arrow 19) and in a transverse dimension (shown by double-headed arrow 16). Panels 12 may be attached to supports 40A of structure 40 by fasteners 50 shown in FIG. 2. Panels 12 are disposed in edge-to-edge relationship with one another along their longitudinally extending edges 20, 22. It will be appreciated from the drawings that longitudinally extending edges 20, 22 extend in longitudinal directions 19. The edge-to-edge configuration of panels 12 provides a structure-lining surface 26 as described in more detail below.

It should be understood that FIG. 1 provides a general embodiment of a structure lining apparatus 10 having panels 12. Unless the context dictates otherwise, further embodiments described herein (e.g. panels 112, connector components 134, 136) may use like numbering to show that they are particular embodiments of structure lining apparatus 10. For example, panel 112 is a particular embodiment of panel 12.

In particular embodiments, panels 12 are fabricated from suitable plastic as a monolithic unit using an extrusion process. By way of non-limiting example, suitable plastics include: poly-vinyl chloride (PVC), acrylonitrile butadiene styrene (ABS) or the like. In other embodiments, panels 12 may be fabricated from other suitable materials, such as composite materials (e.g. a combination of one or more resins and natural and/or synthetic materials), for example. Although extrusion is one particular technique for fabricating panels 12, other suitable fabrication techniques, such as injection molding, stamping, sheet metal fabrication techniques or the like may additionally or alternatively be used. In some embodiments the structure cladding may be made of material that is suitable for food storage applications. In some embodiments, the interfaces between adjacent panels are tight enough to be suitable for food storage applications. In some applications these interfaces are watertight.

In some embodiments, a surface of panels 12 may be provided with a non-smooth texture (e.g. roughened and/or piled texture) or other bondable surface (not explicitly shown) to facilitate bonding of panels 12 to concrete during fabrication (e.g. as the concrete solidifies). In particular embodiments, the non-smooth texture panels 12 may have a dimension (in inward-outward direction 24) that is greater than 2.5% of the thickness of panel 12 in inward-outward direction 24. In particular embodiments, the non-smooth texture of panel 12 may have a dimension (in inward-outward direction 24) that is greater than 1% of the thickness of panel 12 in inward-outward direction 24. In other embodiments, the non-smooth texture of panel 12 may have a dimension (in inward-outward direction 24) that is greater than 0.25% of the thickness of panel 12 in inward-outward direction 24. In some embodiments, panel 12 (and/or its inner surface) may comprise a material having physical or chemical properties that bonds naturally to concrete as the concrete solidifies (e.g. acrylonitrile butadiene styrene (ABS) plastic or the like).

In some embodiments, panels 12 are prefabricated to have different longitudinal dimensions (double-headed arrow 19 of FIG. 1). In other embodiments, the longitudinal dimensions of panels 12 may be cut to length. Panels 12 may be relatively thin in the inward-outward direction (double-headed arrow 24 in FIG. 1) in comparison to the inward-outward dimension of the resultant wall segments fabricated using wall-lining apparatus 10. In some embodiments, the ratio of the inward-outward dimension of a wall segment to the inward-outward dimension of a panel 12 is in a range of 10-600. In some embodiments, the ratio of the inward-outward dimension of a wall segment to the inward-outward dimension of a panel 12 is in a range of 20-300.

Figure 2:
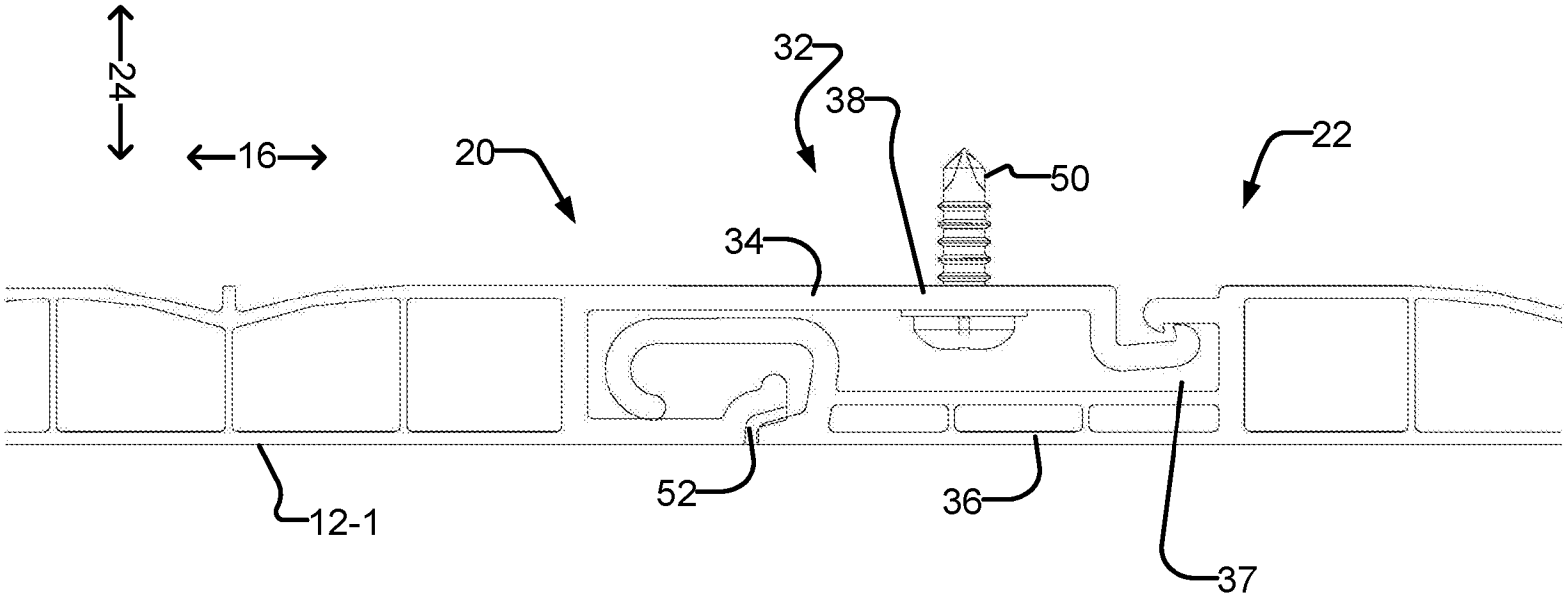
FIG. 2 is a cross-section of a connection of two panels of a structure cladding apparatus according to one embodiment of the invention.

FIG. 2 shows detail of an edge-to-edge connection 32 of transversely adjacent panels 12 of structure-lining apparatus 10. In particular, FIG. 2 depicts a transverse cross-section (i.e. a cross section in a plane defined by the transverse and inward-outward directions) of edge-to-edge connection 32. In the illustrated embodiment, longitudinally extending edge 20 of a first panel 12 comprises a first connector 34 and opposing longitudinally extending edge 22 of a transversely adjacent second panel 12 comprises a complementary second connector 36. In the illustrated embodiment, second connector 36 is received in first connector 34 by hooking, pivoting, sliding and locking (e.g. snapping together) second connector 36 relative to first connector 34 as will be described in more detail herein. It will be appreciated that connector components 34, 36 represent only one set of suitable connector components which could be used to connect panels 12 in edge-adjacent relationship and that many other types of connector components could be used in place of connector components 34, 36. By way of non-limiting example, such connector components may be used to form slidable connections, deformable "snap together" connections, pivotable connections, or connections incorporating any combination of these actions and others.

First connector component 34 may comprise a primary female connector 35A and a secondary male connector 35B while second connector 36 may comprise a primary male connector 37A and a secondary female connector 37B. Connection 32 may be formed when primary male connector 37A engages primary female connector 35A and secondary male connector 35B engages secondary female connector 35B. This double male/female connector connection 32 functions to improve engagement of connection 32 and prevents disengagement of connection 32 upon sagging of one or more panels 12, or failure of one or more fasteners 50 and also serves to reduce sagging of panels 12 both longitudinally and transversely. In this way, it may be possible to employ panels 12 having greater transverse dimensions than is traditionally possible and/or safe.

Figure 3:
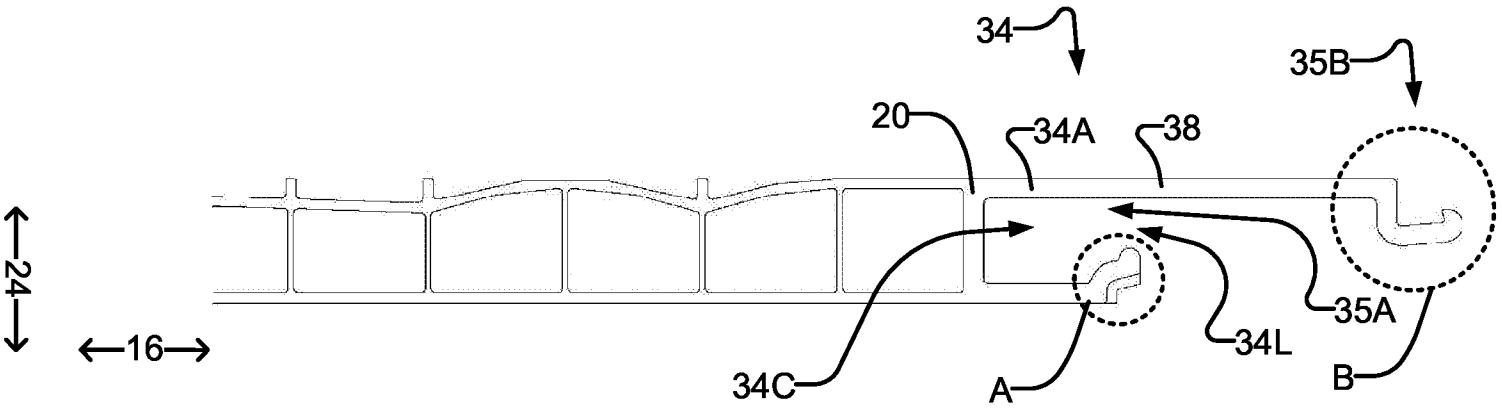
FIG. 3 is a detail view of the first connector of a panel of a structure cladding apparatus according to the FIG. 2 embodiment.
Figure 3B:
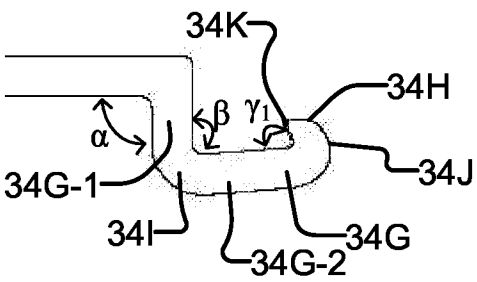
FIG. 3B is a detail view of a portion B (as labelled in FIG. 3) of the first connector of a panel of a structure cladding apparatus according to the FIG. 2 embodiment.
Figure 3A:
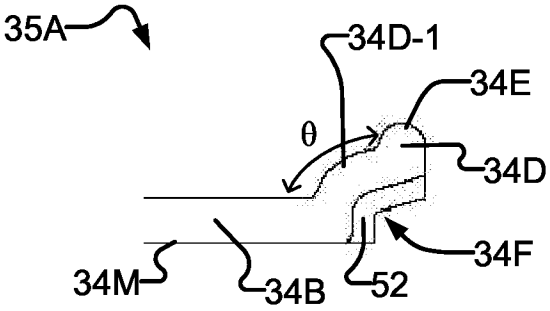
FIG. 3A is a detail view of a portion A (as labelled in FIG. 3) of the first connector of a panel of a structure cladding apparatus according to the FIG. 2 embodiment.

FIGS. 3, 3A and 3B depict a detail view of first connector 34 according to one embodiment of the invention. Although not depicted in FIGS. 3, 3A and 3B, first connector 34 extends in longitudinal direction 19. In some embodiments, first connector 34 extends along the entire longitudinal dimension of panel 12. This is not mandatory. In other embodiments, first connector 34 extends along only a portion of the longitudinal dimension of panel 12. First connector 34 comprises a primary female connector 35A defined by a first inner component 34A and a first outer component 34B and a secondary male connector 35B comprising first finger 34G.

First inner and outer components 34A, 34B may extend in a generally transverse direction 16 from longitudinally extending edge 20 of panel 12. In some embodiments, first inner component 34A extends generally parallel to first outer component 34B, although this is not mandatory. In some embodiments, a corner defined by an intersection of longitudinally extending edge 20 and first inner component 34A is reinforced with additional material or one or more trusses to reduce bending of first inner component 34A relative to longitudinally extending edge 20. A transverse dimension of first inner component 34A may be greater than a transverse dimension of first outer component 34B, as shown in FIG. 3.

First inner component 34A may comprise a mounting tab 38 having one or more apertures for receiving fasteners 50 spaced apart longitudinally, although not depicted. The apertures of mounting tab may be circular or elongated. Mounting tab 38 may be similar to mounting tab 438 depicted in FIG. 19, although this is not mandatory. First inner component 34A may comprise a first finger 34G, as shown in greater detail in FIG. 3B. First finger 34G extends from a distal end of first inner component 34A. A first portion 34G-1 extends generally in inward-outward direction 24 toward first outer component 34B from the distal end of first inner component 34A at an angle, $\alpha$. In some embodiments, angle $\alpha$ is approximately equal to 90°, such as is depicted in FIG. 3B. This is not mandatory. In other embodiments, angle, $\alpha$, may be more or less than 90°. A second portion 34G-2 is connected to first portion 34G-1 by a knuckle 341 such that second portion 34G-2 extends at an angle, $\beta$, from first portion 34G-1. In some embodiments, angle, $\beta$, is an acute angle (e.g. less than 90°), as is depicted in FIG. 3B. This is not mandatory, angle, $\beta$, may be equal to or more than 90°.

A distal end of finger 34G comprises a first hook tip 34H extending in inward-outward direction 24 away from outer component 34B. First hook tip 34H may comprise a bevelled outer surface 34J and a first hook concavity surface 34K that defines a hooked concavity having an angle, $\gamma_1$, with respect to second portion 34G-2. Angle, $\gamma_1$, may be an acute angle (e.g. less than 90°, as is depicted in FIG. 3B. This is not mandatory, angle, $\gamma_1$, may be equal to or more than 90°. In some embodiments, angles $\alpha$, $\beta$ are chosen such that second portion 34G-2 extends partially in inward-outward direction 24 away from first outer component 34B to create a space 37 (as shown in FIG. 2) where second portion 34G-2 can resiliently deform to make connection 32, as will be discussed further herein.

First outer component 34B may comprise a barb 34D. Barb 34D extends from a distal end of first outer component 34B in a generally inward-outward direction 24 toward first inner component 34A, at an angle, θ. In some embodiments, angle θ is approximately equal to 90°, such as is depicted in FIG. 3A. This is not mandatory. In other embodiments, angle, θ, may be more or less than 90°. An inward-outward dimension of barb 34D may be less than the distance between first inner and outer components 34A, 34B such that a gap 34L is formed between tip 34E of barb 34D and inner component 34A. A distal tip 34E of barb 34D may be rounded, as depicted in FIG. 3A, although this is not mandatory.

Outer surface 34M of first outer component 34B may define a groove 34F. Groove 34F may be located at a corner defined by outer surface 34M and barb 34D. Groove 34F may comprise any suitable cross-sectional shape in a plane defined by the transverse and inward-outward directions. Groove 34F may be shaped to receive a corresponding tongue of second connector 34, as discussed further herein.

Figure 4:
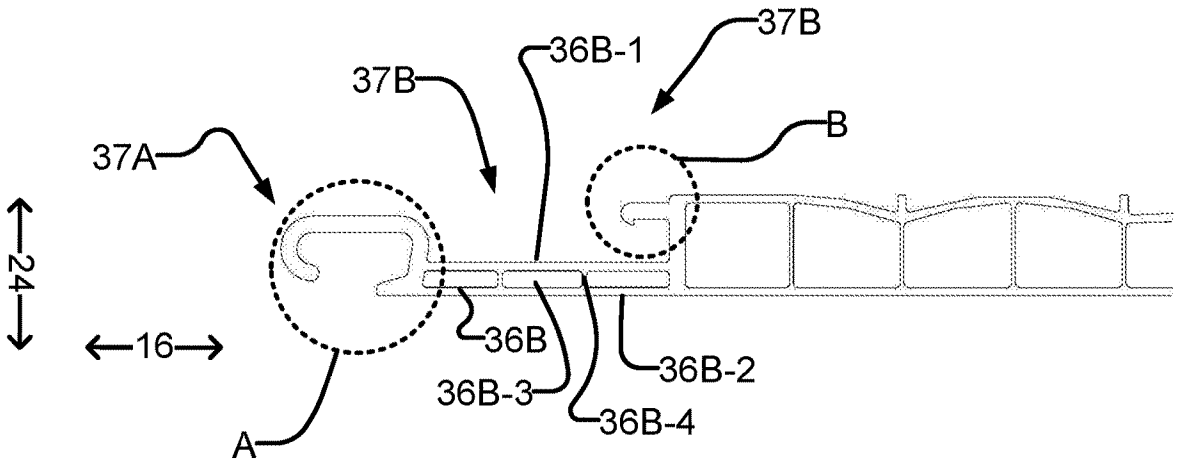
FIG. 4 is a detail view of the second connector of a panel of a structure cladding apparatus according to the FIG. 2 embodiment.
Figure 4B:
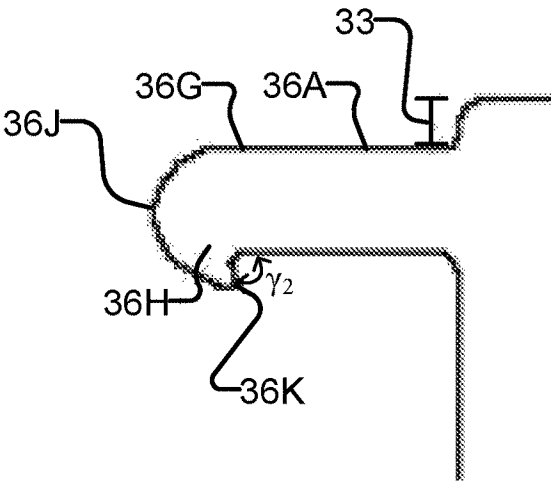
FIG. 4B is a detail view of a portion B (as labelled in FIG. 4) of the second connector of a panel of a structure cladding apparatus according to the FIG. 2 embodiment.
Figure 4A:
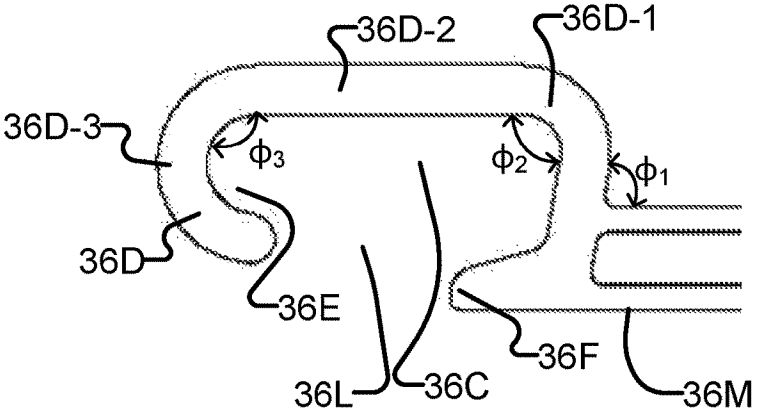
FIG. 4A is a detail view of a portion A (as labelled in FIG. 4) of the second connector of a panel of a structure cladding apparatus according to the FIG. 2 embodiment.

FIGS. 4, 4A and 4B depict a detail view of second connector 36 according to one embodiment of the invention. Although not depicted in FIGS. 4, 4A and 4B, second connector 36 extends in longitudinal direction 19. In some embodiments, second connector 36 extends along the entire longitudinal dimension of panel 12. This is not mandatory. In other embodiments, second connector 36 extends along only a portion of the longitudinal dimension of panel 12. Second connector 36 comprises a primary male connector 37A comprising hook 36D and a secondary female connector 37B defined by a second inner component 36A and a second outer component 36B. Second inner and outer components 36A, 36B may extend in a generally transverse direction 16 from longitudinally extending edge 22 of panel 12. In some embodiments, second inner component 36A extends generally parallel to second outer component 36B, although this is not mandatory. A transverse dimension of second inner component 36A may be less than a transverse dimension of second outer component 36B, as shown in FIG. 4.

Second inner component 36A may comprise a second finger 36G as best depicted in FIG. 4B. Second finger 36G extends from a distal end of second inner component 36A. Second finger 36G may extend generally parallel to first inner component 36A (e.g. extend primarily in transverse direction 16). This is not mandatory. Second finger 36G may extend from second inner component 36A or longitudinally extending edge 22 at a non-zero angle with respect to transverse direction 16. A distal end of second finger 36G comprises a second hook tip 36H extending in inward-outward direction 24 toward second outer component 36B. Second hook tip 36H may comprise a bevelled outer surface 36J and a second hook concavity surface 36K that defines a hooked concavity having an angle, γ2, with respect to second finger 36G. Angle, γ2, is an acute angle (e.g. less than 90°), as is depicted in FIG. 4. This is not mandatory, angle, γ2, may be equal to or more than 90°. As can be seen from FIG. 4B, second finger 36G may be recessed from an inner-most portion of longitudinally extending edge 22 by an inward-outward dimension 33 thereby leaving space for second finger 36G to resiliently deform without contacting structure 40 during the formation of connection 32.

Second outer component 36B may comprise a hook 36D as best depicted in FIG. 4A. Hook 36D extends from a distal end of second outer component 36B. Hook 36D comprises first, second and third hook portions 36D-1, 36D-2, 36D-3. First hook portion 36D-1 extends at an angle, $\varphi_1$, from second inner component 36A. As can be seen from FIG. 4, angle, $\varphi_1$, is less than 90°. This is not mandatory, angle, $\varphi_1$, may be equal to or more than 90°. Second hook portion 36D-2 extends at an angle, $\varphi_2$, from first hook portion 36D-1. In some embodiments, angle, $\varphi_1$, is equal to angle, $\varphi_2$, such that second hook portion 36D-2 extends generally in the same direction as second outer component 36B (e.g. in transverse direction 16). Third hook portion 36D-3 extends from second hook portion 36D-3 at an angle, $\varphi_3$, from second hook portion 36D-2. In some embodiments, angle, $\varphi_3$, is such that third hook portion 36D-3 extends generally in inward-outward direction 24. A distal portion of third hook portion 36D-3 may extend back toward first hook portion 36D-1, as depicted in FIG. 4A, to define a hook concavity 36E that may open in longitudinal direction 19 toward first portion 36D-1 and may be shaped to receive barb tip 34E, as will be discussed further herein. A distal end of third hook portion 36D-3 may be rounded, as depicted in FIG. 4. This is not mandatory. Together, first, second and third hook portions 36D-1, 36D-2, 36D-3 define recess 36C and opening 36L of hook 36D.

Outer surface 36M of second outer component 36B may extend past first hook portion 36D-1 to define a tongue 36F. Tongue 36F may extend in transverse direction 16 from one or both of outer surface 36M and first hook portion 36D-1. For example, tongue 36F may comprise any suitable cross-sectional shape in a plane defined by the transverse and inward-outward directions. Tongue 36F may be complementary in shape to groove 34F.

Although not depicted, one or more nubs may protrude from second hook portion 36D-2 in a generally inward-outward direction. The nubs may comprise any suitable shape. In some embodiments, the nubs are rounded so as to reduce friction between the nubs and inner connector component 34A as first and second connectors 34, 36 are slid together in transverse direction 16. The nubs may also contact inner connector component 34A when connection 32 is formed, thereby providing support to inner connector component 34A and reducing bending of inner connector component 34A. The nubs may also prevent hook 36D from moving in inward-outward direction 24 when connection 32 is formed, thereby increasing the security of connection 32 and helping to maintain hook 36D within recess 34C.

In some embodiments, second outer component 36B is solid while in other embodiments, second outer component 36B comprises an inner portion 36B-1 and an outer portion 36B-2 spaced apart by one or more channels 36B-3. The one or more channels 36B-3 may be separated from one another by one or more braces 36B-4. Channels 36B-3 and braces 36B-4 may increase the stiffness of second outer component 36B while minimizing the weight of second outer component 36B. Although not depicted, first inner component 34A may have a similar construction to second outer component 36B (e.g. it may be hollow and have one or more longitudinally extending channels formed therein).

FIGS. 5A-5E are partial cross-sectional views of the formation of an exemplary connection 32 between first connector 34 and second connector 36 of panels 12.

Figure 5A:
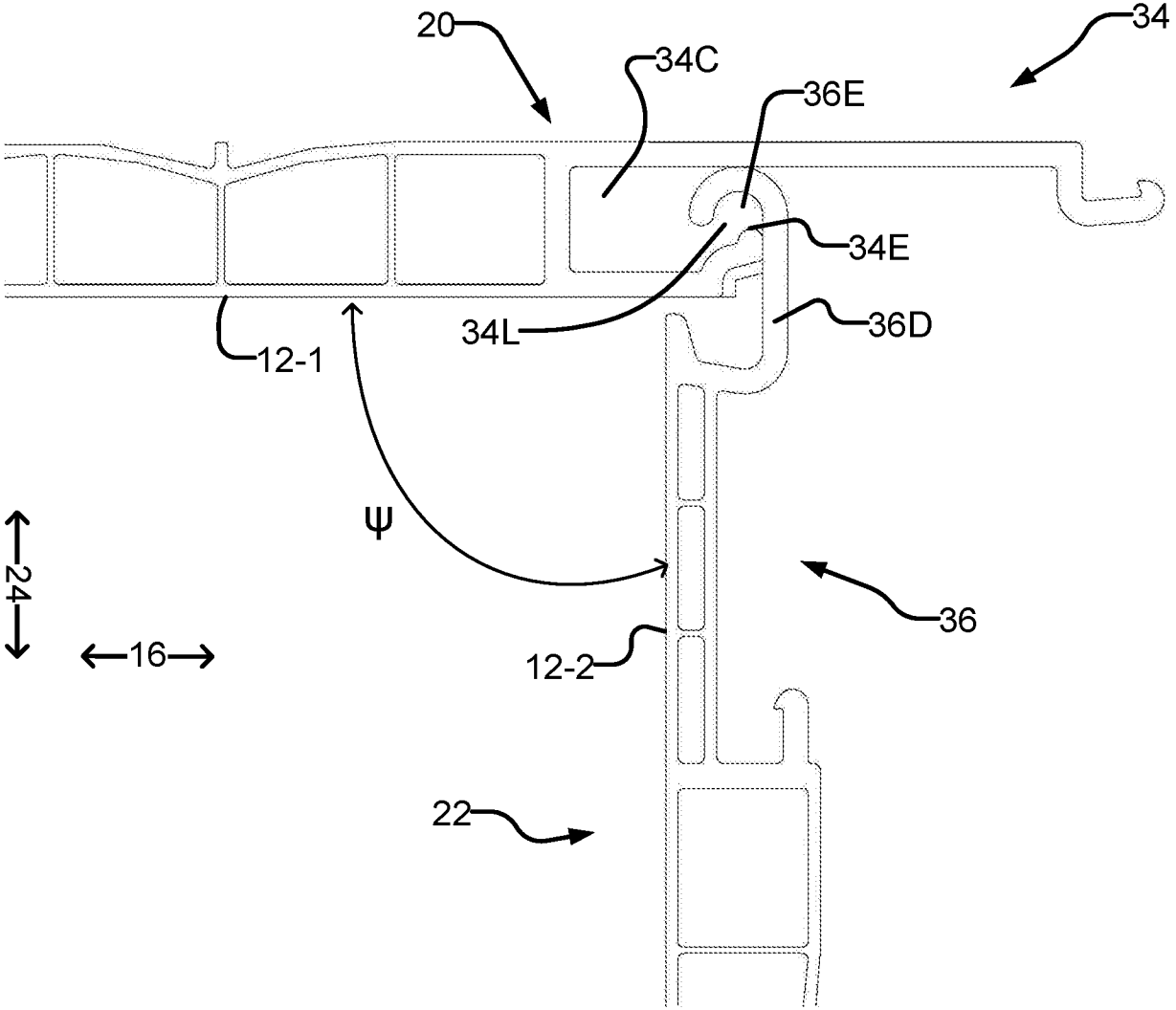
FIGS. 5A to 5G are cross-sectional profile views of the formation of a connection of two panels of the structure cladding apparatus of the FIG. 2 embodiment.

FIG. 5A shows first connector 34 and second connector 36 prior to the formation of edge-to-edge connection 32. In the illustrated embodiment, first panel 12-1 and second panel 12-2 are oriented generally orthogonally to one another (e.g. first panel 12-1 is arranged at an angle, ψ, with respect to second panel 12-1 and angle, ψ, is approximately equal to 90°) in preparation for forming connection 32. For example, as depicted in FIG. 5A, first panel 12-1 is arranged to extend generally in transverse direction 16 and longitudinal direction 19 while second panel 12-2 is arranged to extend generally in inward-outward direction 24 and longitudinal direction 19. In other embodiments, angle, ψ, may not be equal to 90° prior to formation of connection 32. For example, angle, ψ, may be anywhere between 30° and 150°.

As can be seen from FIG. 5A, third hook portion 36D-3 is passed through gap 34L as first connector 34 begins to engage second connector 36. Once, the distal end of third hook portion 36D-3 enters into recess 34C, second panel 12-1 may be moved in inward-outward direction 24 such that barb tip 34E of barb 34D protrudes into hook concavity 36E, as depicted in FIG. 5B.

Figure 5B:
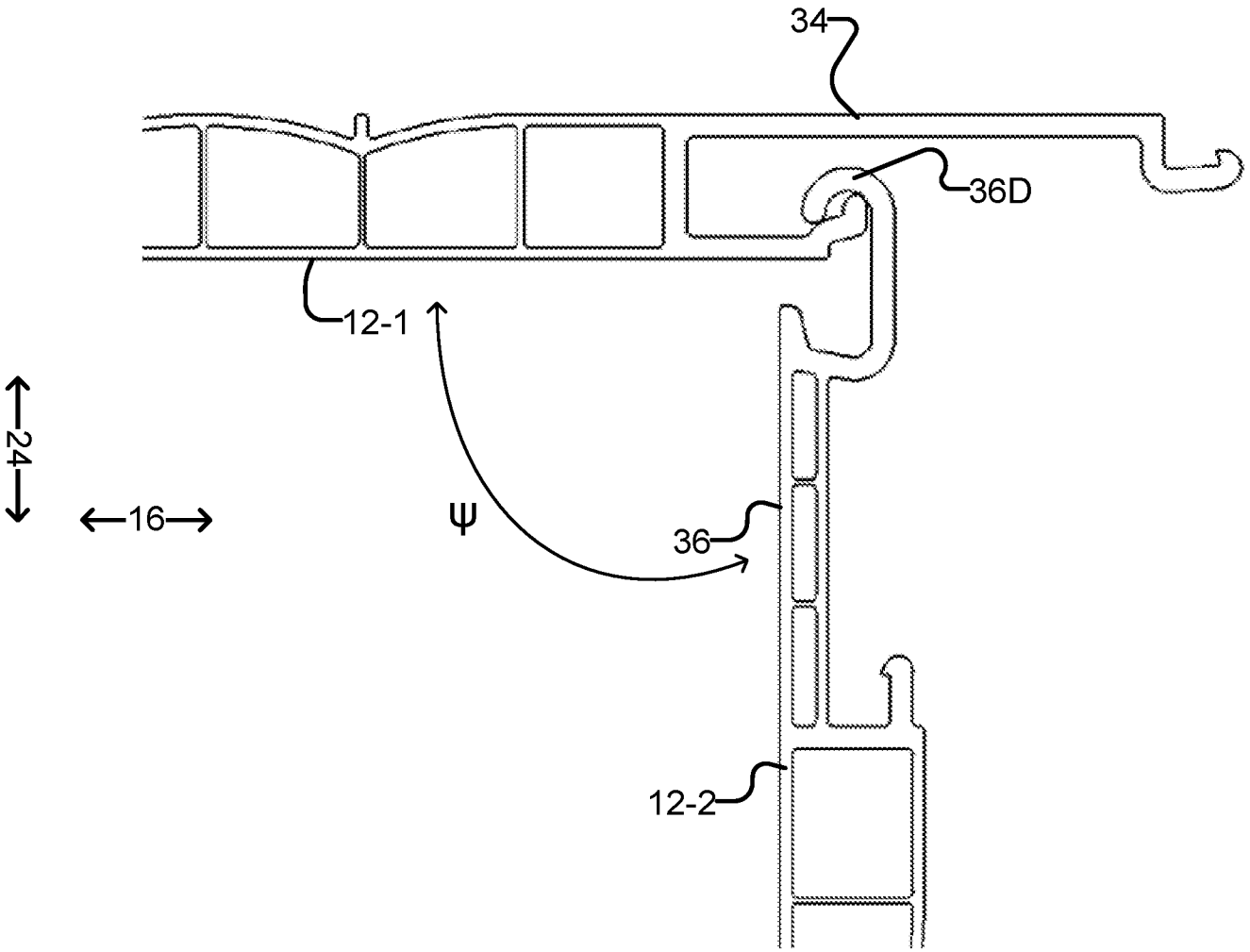

When first panel 12-1 is installed as a ceiling panel, second panel 12-2 may be able to hang from first panel 12-1 in the FIG. 5B hanging configuration due to the protrusion of barb 34D into hook concavity 36E. In the hanging configuration, panels 12-1, 12-2 may be oriented relative to each other by angle, ψ, where angle, ψ, is between approximately 10-170°. In some embodiments, angle, ψ, is between approximately 70-110°. This may provide a number of advantages. First, this may allow for all or substantially all of the weight of second panel 12-2 to be supported by first panel 12-1 which may allow the installer to take a break or prepare for the installation steps that follow. It may also improve the ease with which second panel 12-2 can be manoeuvered since at least some of its weight is supported by first panel 12-1. It may also ensure that even if longitudinally extending edge 20 of a panel becomes unattached from one or more supports 40A of structure 40, panel 12-2 will merely hang from longitudinally extending edge 22 of panel 12-1 instead of crashing to the ground. Given that second panel 12-2 is held vertically (or close thereto) while it is hooked onto first panel 12-1 (e.g. in FIG. 5A), second panel 12-1 is less likely to sag along either of its transverse or longitudinal dimensions under its own weight during manoeuvering. A reduction of such sag simplifies the task of lining up second connector 36 of second panel 12-2 with first connector 34 of first panel 12-1.

Figure 5C:
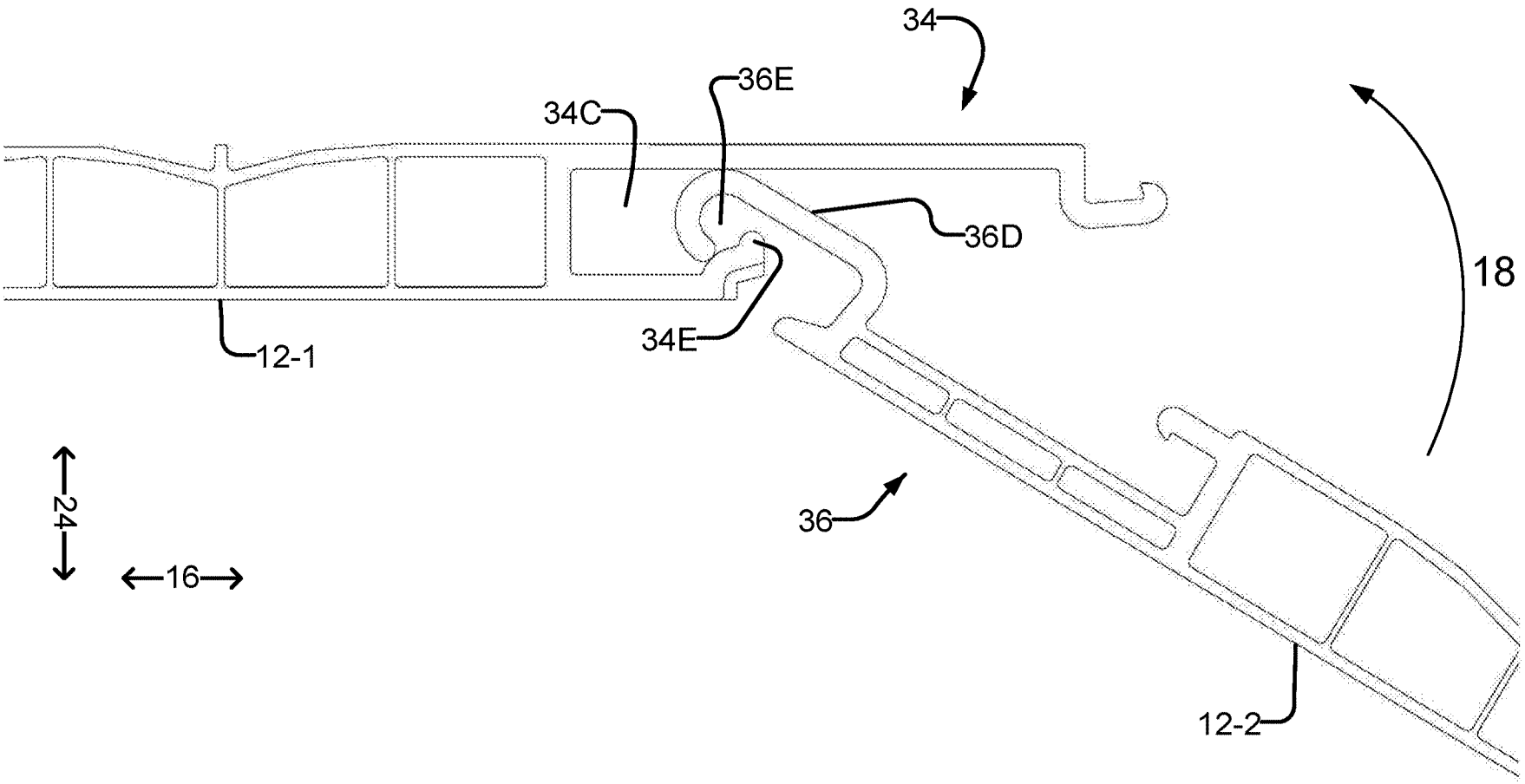
Figure 5D:
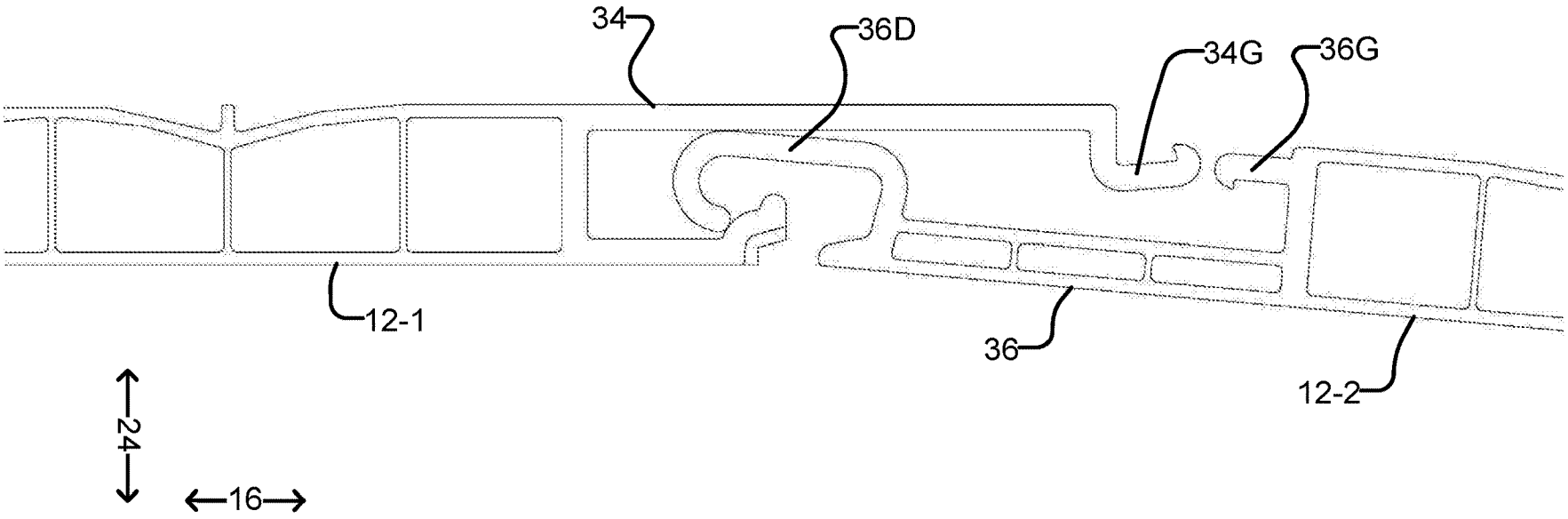

As can be seen from FIGS. 5C and 5D, second panel 12-2 is brought into alignment with first panel 12-1 by pivoting second panel 12-2 in direction 18 (e.g. counter-clockwise in the illustrated embodiment). As second panel 12-2 pivots, it may also slide in transverse direction 16 thereby causing barb 34D to move deeper into recess 36L. Beveled portion 34D-1 of barb 34D may cause panel 12-2 to slide in transverse direction 16 as panel 12-2 is pivoted into alignment with panel 12-1. This is not mandatory. Advantageously, since longitudinally extending edge 22 of second panel 12-2 is supported by first panel 12-1, fewer installers may be employed to pivot second panel 12-2 since only longitudinally extending edge 20 of second panel 12-2 may need to be raised.

In other embodiments, hook 36D and recess 34C are shaped such that primary male connector 37A and primary female connector 35A may be connected by relative transverse movement of first and second connectors 34, 36 and without pivoting of panels 12-1, 12-2. In some embodiments, one or more of hook 36D and outer connector component 34B is resiliently deformed during the connection of primary male connector 37A and primary female connector 35A and is at least partially restoratively deformed to maintain the connection between primary male connector 37A and primary female connector 35A.

Figure 5E:
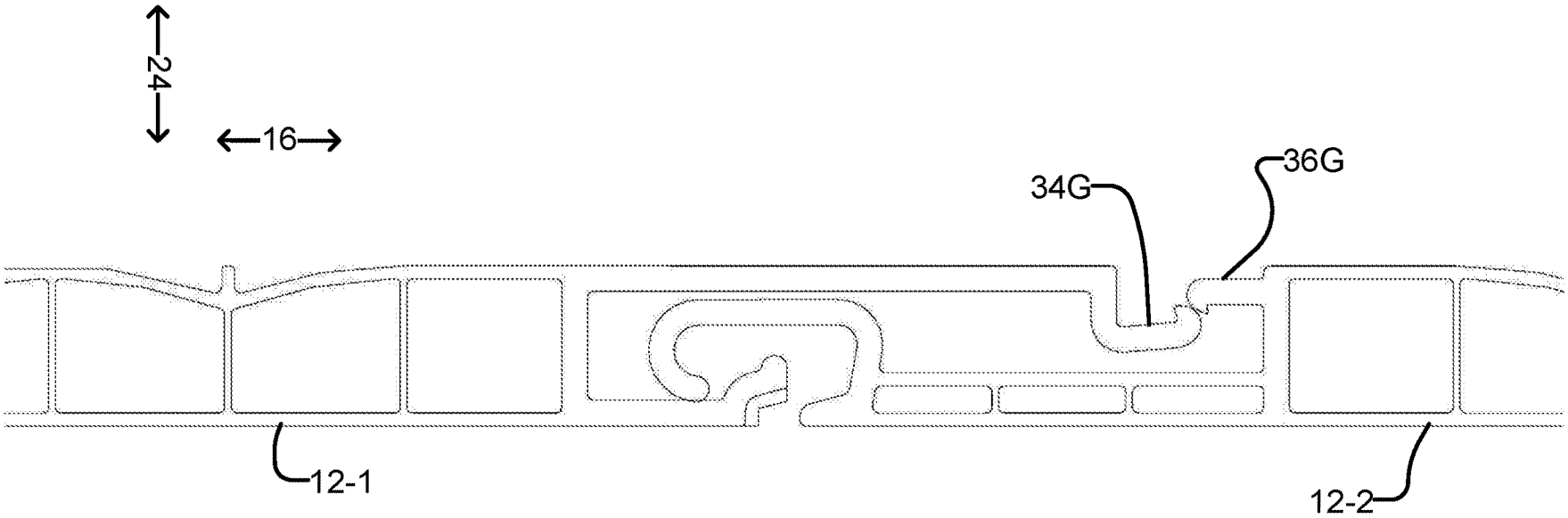

Rotation, or pivoting, of second panel 12-2 continues (e.g. as shown in FIG. 5D) until first and second panels 12 are aligned in a plane defined by the transverse and longitudinal directions, as shown in FIG. 5E. When alignment is achieved longitudinally extending edge 20 may contact the structure 40 (or support 40A) to which it is being attached. As can be seen from FIG. 5E, when first and second panels 12 are first aligned, second panel may be able to slide somewhat in transverse direction 16 relative to first panel 12-1, without deforming either one of first and second connectors 34, 36. Such relative transverse movement of second panel 12-2 toward first panel 12-1 may be limited by first hook tip 34H contacting second hook tip 36H and/or such relative transverse movement of second panel 12-2 away from first panel 12-1 may be limited by tongue 36F contacting groove 34F or seal 52. In some embodiments, third portion 36D-3 of hook 36D has an inward-outward dimension that is greater than an inward-outward dimension of gap 34L such that when first and second panels 12-1, 12-2 are aligned (such as in FIG. 5E), third hook portion 36D-3 cannot be removed from recess 34C by moving panels 12-1, 12-2 apart in transverse direction 16.

Connection 32 may be achieved by sliding second panel 12-2 in transverse direction 16 toward first panel 12-1 such that one or both of first finger 34G and second finger 36G resiliently deform to allow first hook tip 34H to pass over second hook tip 36H. To achieve this, one or both of first and second portions 34G-1, 34G-2 of first finger 34G may resiliently deform (e.g. first portion 34G-1 may move in transverse direction 16 and/or second portion 34G-2 may move in inward-outward direction 24) such that first hook tip 34H moves in inward-outward direction 24 to allow second hook tip 36H to move in transverse direction 16 over first hook tip 34H. Movement of first hook tip 34H may be facilitated by deformation of secondary male connector 35B which causes a reduction of angle α and/or an increase of angle β. As can be seen from FIG. 5F, angles, α, and β may be such that first and second portions 34G-1, 34G-2 of first finger 34G have sufficient space 37 to resiliently deform without contacting second connector 36. Alternatively or additionally, second finger 36G may resiliently deform such that second hook tip 36H moves in inward-outward direction 24 to allow second hook tip 36H to move in transverse direction 16 over first hook tip 34H. Second finger 36G may have sufficient space to deform without contacting structure 40 due to second finger 36G being recessed from an innermost portion of longitudinally extending edge 22 by inward-outward dimension 33. Deformation of either or both of first and second fingers 34G, 36G may be facilitated by beveled surfaces 34J, 36J, which may tend to facilitate deformation of first and second fingers 34G, 36G in response to movement of panels 12-1 and 12-2 toward one another in transverse direction 16.

Figure 5F:
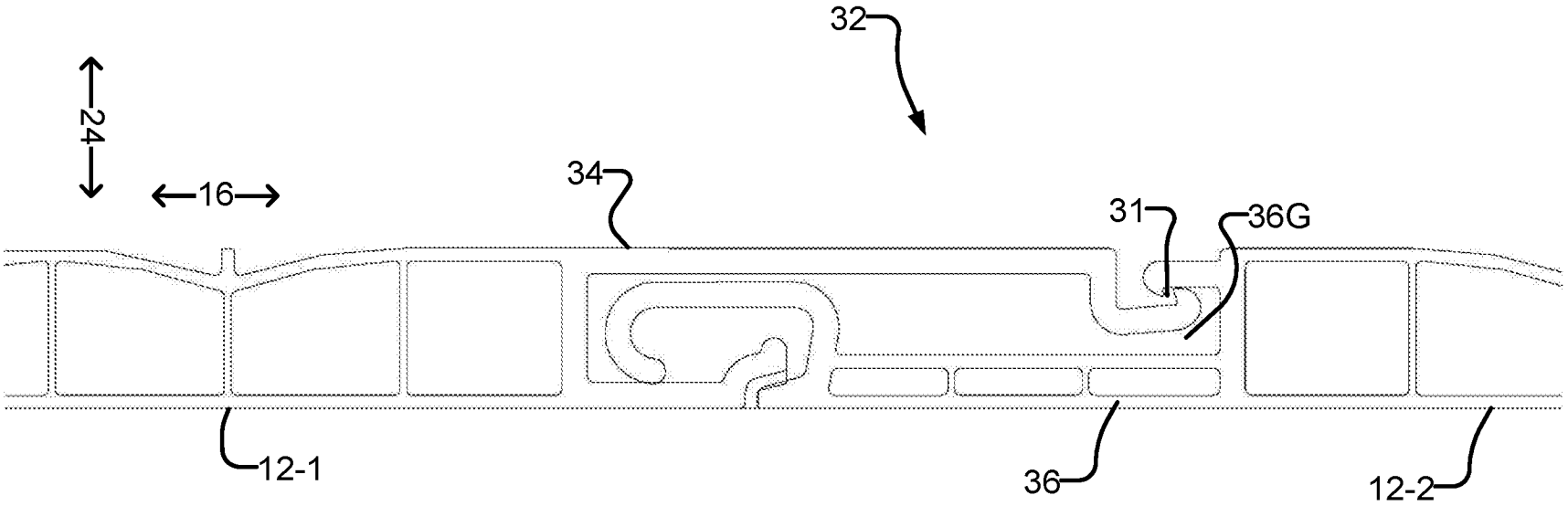

FIG. 5F shows second connector 36 fully inserted in to first connector 34. In other words, primary male connector 37A is engaged with primary female connector 35A and secondary male connector 35B is engaged with secondary female connector 37B. To achieve this, after one or both of first and second fingers 34G, 36G are resiliently deformed and second hook tip 36H passes over first hook tip 34H, one or both of first and second fingers 34G, 36G begin to restoratively deform or snap back (e.g. due to the restorative deformation forces associated with the resilient deformation), at least partially, toward their non-deformed shapes. In some embodiments, one or both of first and second fingers 34G, 36G resiliently snap back (e.g. due to the restorative deformation forces associated with the resilient deformation) to their non-deformed shapes. In other embodiments, one or both of first and second fingers 34G, 36G only partially resiliently snap back toward their non-deformed shapes, causing one or both of first and second fingers 34G, 36G to continue to apply force against the opposing finger to thereby maintain locked engagement of first and second fingers 34G, 36G after connection 32 is formed. Such locked engagement of first and second fingers 34G, 36G may be sufficient to prevent panels 12-1, 12-2 from being pulled apart in transverse direction 16 (i.e. such locked configuration of first and second fingers 24G, 36G provides more than merely a locating mechanism to provide feedback when panels 12-1, 12-2 are spaced apart by a desired amount). To prevent connection 32 from releasing (or reduce the risk thereof) when connectors 34, 36 are being pulled apart from one another in transverse direction 16 due to, for example, thermal contraction of panels 12-1, 12-2, secondary male connector 35B may deform such that an increase of angle $\alpha$ and/or an increase of angle $\beta$ occurs to effectively increase the length of male connector 35B thereby maintaining hook tips 34H, 36H in contact with one another.

Figure 5G:
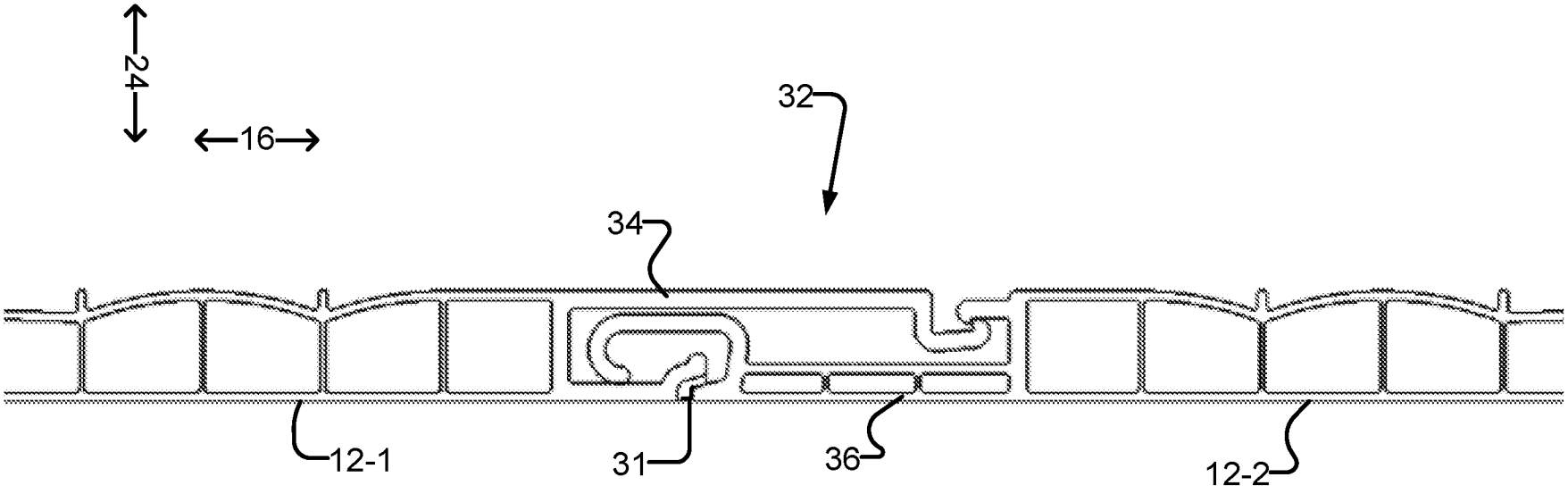

As can be seen by comparing FIGS. 5F and 5G, first and second connectors 34, 36 (and therefore first and second panels 12-1, 12-2) may be able to move by a set amount 31 in transverse direction 16 when connection 32 is formed. By allowing relative transverse movement between panels 12 by amount 31, panels 12 may be able to expand and contract with changes in heat/humidity etc. without being damaged, bending, pillowing, etc. Movement by amount 31 may also facilitate installation by allowing for precise alignment of panels 12 relative to trusses 40A or any part of the structure to which panels 12 are being attached. Amount 31 may be limited by one or more of engagement of tongue 36F and groove 34F and engagement of first and second hook tips 34H, 36H. Transverse dimensions of tongue 36F and groove 34F may be greater than amount 31 to ensure engagement of tongue 36F and groove 34F despite movement of first and second panels 12 by amount 31.

In FIG. 5G, panels 12-1 and 12-2 are pulled apart in transverse direction 16 (e.g. by amount 31) such that first finger 34G lockingly engages second finger 36G. As illustrated, connection 32 is locked, in part, by engagement of first hook concavity surface 34K of first finger 34G and second hook concavity surface 36K of second finger 36G when first and second panels 12 are pulled apart (e.g. in transverse direction 16). In particular, first hook tip 34H may protrude into the hooked concavity of second finger 36G and second hook tip 36H may protrude into the hooked concavity of first finger 34G to lock panels 12-1, 12-2 in connection 32. In some embodiments, angles $\gamma 1$, $\gamma 2$ of the hooked concavities are complementary to prevent disengagement of first and second fingers 34G, 36G due to relative transverse movement of panels 12. In some embodiments, angles $\gamma 1$, $\gamma 2$, are each less than 90° so as to also prevent relative pivoting of panels 12-1, 12-2 and inward-outward movement of panels 12 and to thereby further secure connection 32. Even if longitudinally extending edge 22 of panel 12-2 becomes disengaged from one or more supports 40A of structure 40, the connection between first and second fingers 34G, 36G may serve to prevent relative pivoting of panels 12-1, 12-2 and may prevent panels 12-2 from falling from structure 40.

As first finger 34G lockingly engages second finger 36G, tongue 36F engages groove 34F to provide a substantially flat interface between outer surface 34M of first connector 34 and outer surface 36M of second connector 36. The engagement of tongue 36F and groove 34F may also serve to prevent relative pivotal motion between panels 12-1, 12-2 and inward-outward movement of first connector 34 relative to second connector 36 when connection 32 is formed so as to prevent first and second fingers 34G, 36G from becoming disengaged. Even if longitudinally extending edge 20 of panel 12-2 becomes disengaged from one or more supports 40A of structure 40, the connection between tongue 36F and groove 34F may serve to prevent relative pivoting of panels 12-1, 12-2 and may prevent panels 12-2 from falling from structure 40. In some embodiments, tongue 36F and groove 34F are separated by a sealing material 52, as discussed further herein. In some embodiments, tongue 36F and groove 34F and optionally sealing material 52 overlap in inward-outward direction 24 (e.g. a line drawn parallel to inward-outward direction 24 would intersect both of groove 34F and tongue 36F). Such overlap may serve to reduce or even prevent the ingress of water or dirt into connection 32 whether or not seal 52 is present. In some embodiments, where seal 52 is not present, tongue 36F and groove 34F may comprise a friction fit when connection 32 is formed to prevent ingress of undesired fluid or water into connection 32.

In some embodiments, an elastic or viscoelastic (e.g. flexible) seal 52 may be inserted between first and second connectors 34, 36 to help seal connection 32 and prevent or minimize the leakage of fluids (e.g. liquids or gasses) through connection 32. In some embodiments, seal 52 may be provided by a curable material (e.g. silicone, caulking, glue, a curable elastomer, a curable polyolefin and/or the like) which may be inserted between first and second connectors 34, 36 and may then be permitted to cure between first and second connectors 34, 36. Such a curable seal may bond (e.g. an adhesive bond, a bond involving a chemical reaction, a bond involving melting and re-solidifying a portion of panels 12 and/or the like) to one or more of the surfaces that define first and second connectors 34, 36. In some embodiments, seal 52 may be fabricated from a material that itself bonds to the surfaces of panels 12. In some embodiments, it may be desirable to interpose a primer, a bonding adhesive and/or the like between seal 52 and the surface(s) which define first and second connectors 34, 36 to make and/or to enhance the bond therebetween.

It is not necessary that seal 52 be provided by a curable material. In some embodiments, seal 52 may be provided by a suitably shaped solid flexible seal. Such a solid flexible seal may comprise elastomeric material, polyolefin material or any other suitable material. In some embodiments, such a solid seal may be bonded (e.g. an adhesive bond, a bond involving a chemical reaction, a bond involving melting and re-solidifying a portion of panels 12 and/or the like) to one or more of the surfaces of first and second connectors 34, 36.

In some embodiments, a sealing material may be provided on some surfaces of connector components 34, 36. Such sealing material may be relatively soft (e.g. elastomeric) when compared to the material from which the remainder of panel 12 is formed. Such sealing materials may be provided using a co-extrusion process or coated onto connector components 34, 36 after fabrication of panels 12, for example, and may help to make connection 32 impermeable to liquids or gasses. Suitable surface textures may also be applied to connector components 34, 36 to enhance the seal or friction between components 34, 36.

As can be seen from FIGS. 5F and 5G, even when panels 12-1, 12-2 move relative to one another in transverse direction 16 by amount 31, seal may 52 maintain contact between first connector 34 and second connector 36. Accordingly, even if panels 12 experience thermal expansion/contraction, sagging or the like, a seal may be maintained between adjacent panels 12-1, 12-2 by seal 52.

Figure 5I:
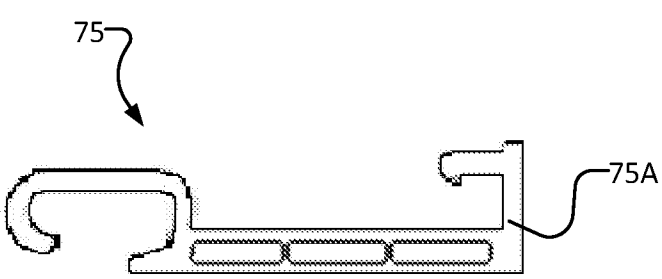
FIGS. 5H and 5I are cross-sectional profile views of a starter piece and end piece, respectively, of the structure cladding apparatus of the FIG. 2 embodiment.
Figure 5H:
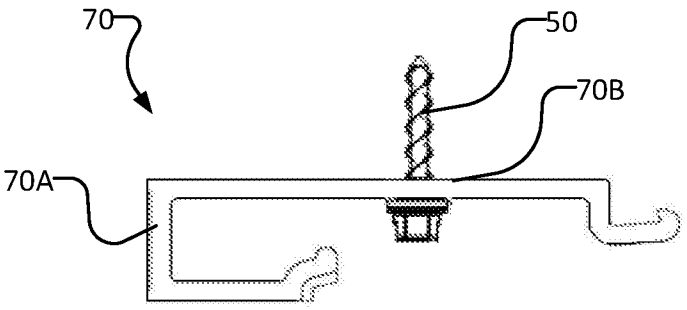

FIG. 5H depicts a starter piece 70. As can be seen from FIG. 5H, starter piece 70 is substantially similar to first connector 34 except in that it is not part of a panel 12. Starter piece 70 may be mounted to a structure 40 with a fastener 50, as shown in FIG. 5H. Starter piece 70 may be mounted to a structure 40 at the starting end of where structure lining apparatus 10 is to be installed. For example, starter piece 70 may be installed such that back 70A of starter piece 70 abuts a wall and mounting tab 70B of starter piece abuts a support 40A. Once starter piece 70 is installed, a panel 12 may be connected to starter piece 70 in a similar fashion to that shown depicted in FIGS. 5A to 5G and described herein. In this way, it may be easier and more efficient to begin installing structure lining apparatus 10 and it may be unnecessary to cut a panel 12 to fit structure lining apparatus 10 flush against a wall. Although starter piece 70 is depicted as being substantially similar to first connector 34, it should be understood that a similar starter piece 70 may be constructed for any of the panels (e.g. panels 12, 112, 212, 312 etc.) described herein).

FIG. 5I depicts an end piece 75. As can be seen from FIG. 5I, end piece 75 is substantially similar to second connector 36 except in that it is not part of a panel 12. End piece 75 may be mounted to a first connector 34 in a similar fashion to that shown depicted in FIGS. 5A to 5G and described herein such that end piece 75 becomes the finishing edge of structure lining apparatus 10. For example, end piece 75 may be mounted to a first connector 34 of a panel 12 such that back 75A of end piece 75 abuts a wall. In this way, it may be easier and more efficient to finish installing structure lining apparatus 10 and it may be unnecessary to cut a panel 12 to fit structure lining apparatus 10 flush against a wall. Although end piece 75 is depicted as being substantially similar to second connector 36, it should be understood that a similar end piece 75 may be constructed for any of the panels (e.g. panels 12, 112, 212, 312 etc.) described herein).

Starter and end pieces 70, 75 may be applied to longitudinally extending edges 20, 22 to cover a corner of structure 40, for support or for esthetic, protective, or other reasons, as desired. For example, starter and end pieces 70, 75 may allow structure lining apparatus 10 to contact walls or vertical supports of structure 10 in a flush manner to reduce ingress of dirt, fluids or other unwanted substances into structure 40.

Figure 5K:
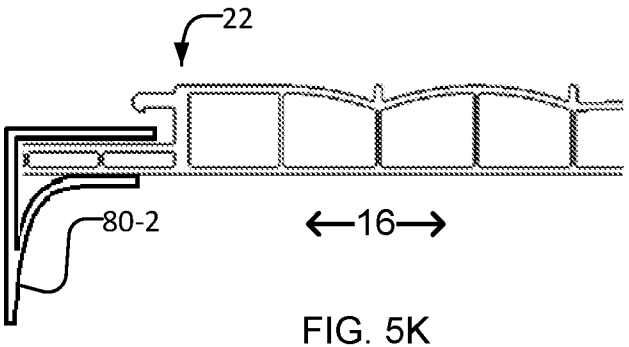
FIGS. 5J to 5M are cross-sectional profile views of trim pieces of the structure cladding apparatus of the FIG. 2 embodiment.
Figure 5J:
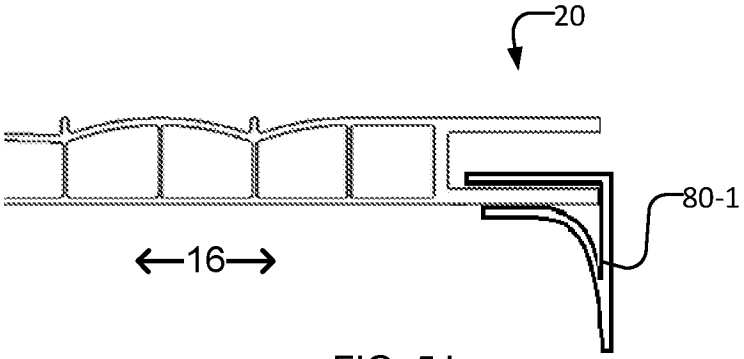

FIGS. 5J and 5K depict trim pieces 80-1, 80-2, respectively. Trim pieces 80-1, 80-2 (collectively referred to herein as trim pieces 80) may be applied to longitudinally extending edges 20, 22 to cover a corner of structure 40, for support or for esthetic, protective, or other reasons, as desired. For example, trim pieces 80 may allow structure lining apparatus 10 to contact walls or vertical supports of structure 10 in a flush manner to reduce ingress of dirt, fluids or other unwanted substances into structure 40.

In some embodiments, trim pieces 80 may be applied to longitudinally extending edges 20, 22 without altering longitudinally extending edges 20, 22. In other embodiments, it may be more simple to cut off one or more parts of panels 12 to facilitate instillation of trim pieces 80, such as is shown in FIGS. 5J, 5K, 5L and 5M.

In some embodiments, trim pieces 80 may be held in place on longitudinally extending edges 20, 22 by friction (e.g. trim pieces 80 may be restoratively deformed to fit onto longitudinally extending edges 20, 22 and may apply restorative deformation forces against longitudinally extending edges 20, 22 to create a friction fit). In some embodiments, trim pieces 80 may be attached to longitudinally extending edges 20, 22 and/or structure 40 by one or more fasteners or adhesive.

Figure 5M:
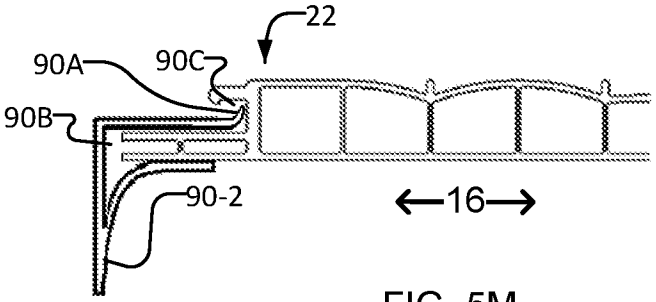
Figure 5L:
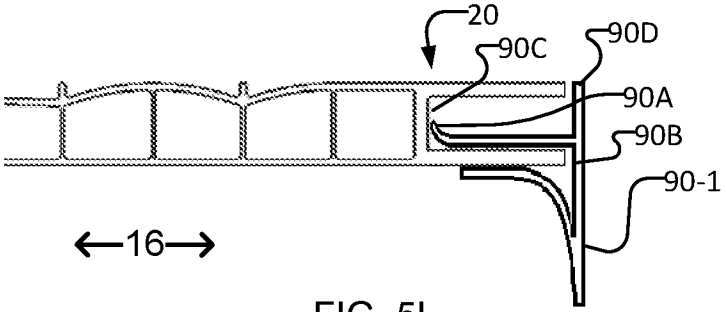

FIG. 5L depicts a trim piece 90-1 installed at longitudinally extending edge 20. Trim piece 90-1 is substantially similar to trim piece 80-1 except that trim piece 90-1 comprises a flexible contact 90A and a positioning arm 90D. Flexible contact 90A may allow for movement and/or expansion/contraction of panel 12. Positioning arm 90D may simply positioning of trim piece 90-1.

Flexible contact 90A may be upturned, bent or the like so as to deform out of the way if panel 12 moves or expands in transverse direction 16. A space 90C may be provided to provide flexible contact 90A with space to deform. In some embodiments, deformation of flexible contact 90A is elastic and flexible contact 90A may restoratively deform (i.e. return to, or close to, its original shape) when panel 12 is pulled away in transverse direction 16. In other embodiments, deformation of flexible contact 90C may be plastic. A space 90B may be provided between the end of panel 12 and trim piece 90-1 to allow for movement or expansion of panel 12.

Positioning arm 90D may be dimensioned such that if its distal end is placed against structure 40, trim piece 90-1 will be appropriately located relative to structure 40 for panel 12 to be installed in trim piece 90-1 without having to measure the location of trim piece 90-1. Although other embodiments of trim pieces 80, 90-2 are not depicted as including a positioning arm 90D, it should be understood that any of the trim pieces depicted or described herein could include a positioning arm 90D. Similarly, in some embodiments, trim piece 90-1 does not comprise a positioning arm 90D.

FIG. 5M depicts a trim piece 90-2 installed at longitudinally extending edge 22. Trim piece 90-2 is substantially similar to trim piece 90-1 except that it does not include a positioning arm 90D. As discussed above, it should be understood that trim piece 90-2 could include a positioning arm 90D.

Referring to FIG. 6A, panels 12 are elongated in longitudinal direction 19 and extend in transverse direction 16. In the illustrated embodiment, panels 12 have a substantially similar transverse cross-section along their entire longitudinal dimension, although this is not necessary. In general, panels 12 may have a number of features which differ from one another as explained in more particular detail below. As above, longitudinally extending edges 20, 22 of panels 12 comprise connector components 34, 36 which are connected to complementary connector components 34, 36 of adjacent panels so as to connect panels 12 in edge-adjacent relationship (as described above) and to thereby provide structure lining apparatus 10, as depicted in FIG. 1, for example.

Panel 12, of the illustrated embodiment, comprises an outer layer 12A which faces outwardly (e.g. away from supports 40A in FIG. 1) when installed and an inner layer 12B which faces inwardly (e.g. toward supports 40A in FIG. 1) when installed. Outer layer 12A and inner layer 12B extend across span 12C of panel 12.

In some embodiments, outer layer 12A has a thickness (i.e. an inward-outward direction thickness) that is greater than a thickness (e.g. an inward-outward direction thickness) of inner layer 12B. For example, in some embodiments, the thickness of inner layer 12B is between 10% to 40% less than the thickness of outer layer 12A. In other words, a ratio of the thickness of outer layer 12A to thickness of inner layer 12B may be between 11:10 and 17:10. For example, in some embodiments, outer layer 12A is approximately 0.0045 inches (+/−0.001 inches) thick and inner layer 12B is approximately 0.0035 inches (+/−0.001 inches) thick. By employing a thicker outer layer 12B, panel 12 is less susceptible to damage by impact while reducing the weight of panel 12. Further, the stiffness of panel 12 is not substantially reduced since inner layer 12A is typically in compression and does not require the same thickness as outer layer 12B, which is typically in tension.

In the illustrated embodiment, outer layer 12A is substantially flat, although in other embodiments, outer layer 12A may be provided with desired shapes (e.g. corrugation, curvature, or the like). Inner layer 12B, as depicted, however, has one or more portions that are not substantially flat.

For example, in FIG. 6A, inner layer 12B comprises a first partially arcuate section 12F-1, a first micro arcuate section 12E-1, a macro arcuate section 12D, a second micro arcuate section 12E-2 and a second partially arcuate section 12F-2. In the illustrated embodiment, first partially arcuate section 12F-1, first micro arcuate section 12E-1, macro arcuate section 12D, second micro arcuate section 12E-2 and second partially arcuate section 12F-2 are oriented to be symmetrical about a notional transverse mid-plane 42 of panel 12 (this is not mandatory). More particularly:

First and second partially arcuate sections 12F-1, 12F-2 have orientations that are mirror images of one another relative to mid-plane 42 and are equidistant from mid-plane 42.

First and second micro arcuate sections 12E-1, 12E-2 have orientations that are mirror images of one another relative to mid-plane 42 and are equidistant from mid-plane 42.

Macro arcuate section 12D is oriented to itself be mirror symmetric about mid-plane 42.

Partially arcuate sections 12F-1, 12F-2 are characterized by flat sections 12F-1A, 12F-2A nearest to first and second connectors 34, 36 respectively and concave sections 12F-1B, 12F-2B adjacent to flat sections 12F-1A, 12F-2A respectively. Flat sections 12F-1A, 12F-2A may extend substantially parallel to outer layer 12A while concave sections 12F-1B, 12F-2B may extend toward outer layer 12A as they move away from longitudinally extending edges 20, 22. Partially arcuate sections 12F-1, 12F-2 may provide increased transverse and longitudinal stiffness near connectors 34, 36 to prevent sagging of panel 12. Partially arcuate sections 12F-1, 12F-2 may also serve to transition into first and second micro arcuate sections 12E-1, 12E-2 or macro arcuate section 12D in the case that first and second micro arcuate sections 12E-1, 12E-2 are not present in panel 12.

Micro arcuate sections 12E-1, 12E-2 each have an arcuate shape extending across their transverse dimensions to provide inward facing surfaces which are convex between longitudinally extending edges of micro arcuate sections 12E-1, 12E-2. Micro arcuate sections 12E-1, 12E-2 may provide increased transverse and longitudinal stiffness near partially arcuate sections 12F-1, 12F-2 to prevent sagging of panel 12.

The additional transverse and longitudinal stiffness provided by partially arcuate sections 12F-1, 12F-2 and micro arcuate sections 12E-1, 12E-2 may function to allow panel 12 to be employed in structures having larger spaces 40B between adjacent supports 40A due to the increased stiffness of panels 12, thereby reducing the number of supports 40A employed for a given structure 40, reducing the number of fasteners 50 to be employed, reducing costs of apparatus 10 and simplifying installation of apparatus 10.

Figure 8:
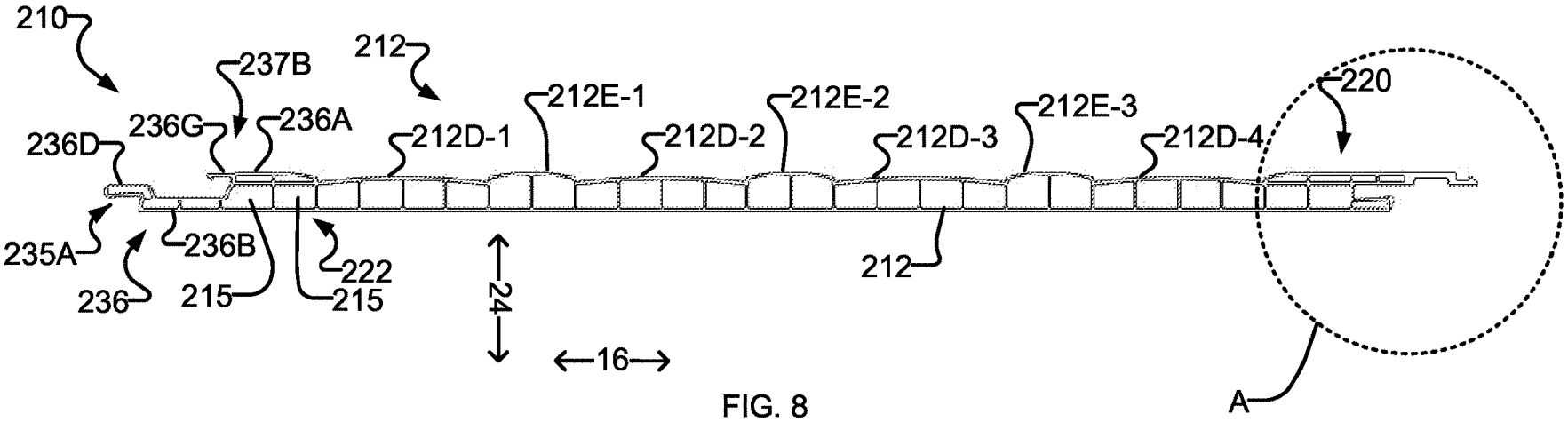
FIG. 8 is a cross-sectional plan view of a panel of a structure lining apparatus according to another embodiment of the invention.
Figure 8A:
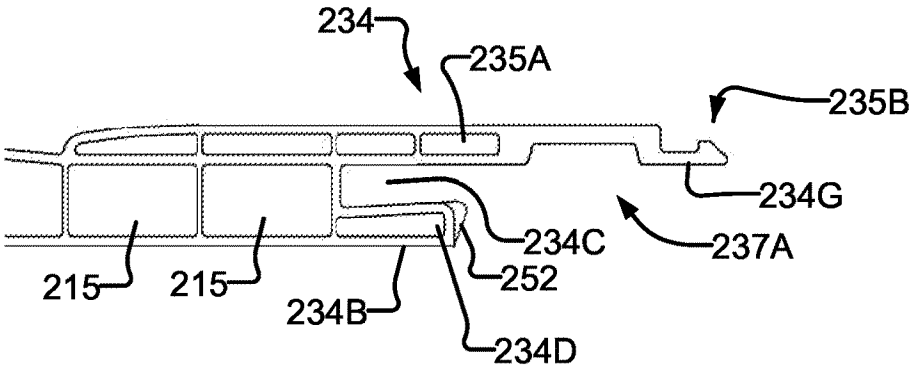
FIG. 8A is a detail view of a portion A (as labelled in FIG. 8) of the second connector of a panel of a structure cladding apparatus according to the FIG. 2 embodiment.

Macro arcuate section 12D may have an arcuate shape extending across its transverse dimension to provide an inward facing layer 12B which is convex between longitudinally extending edges of macro arcuate section 12D. In some embodiments, macro arcuate section 12D may have an inward facing layer 12B that is concave between longitudinally extending edges of macro arcuate section 12D. In some embodiments, macro arcuate section 12D may have an outward facing layer 12A which is convex (see FIG. 6I) or concave (see FIG. 6J) between longitudinally extending edges of macro arcuate section 12D. In some embodiments, outward facing layer 12A and inward facing layer 12B of macro arcuate section 12D are both convex or both concave, while in other embodiments, one is concave while the other is convex. Macro arcuate section 12D may provide increased transverse and longitudinal stiffness across panel 12. In some embodiments, macro arcuate section 12D comprises the entire transverse length of span 12C and panel 12 does not include any micro arcuate sections 12E-1, 12E-2 or any partially arcuate sections 12F-1, 12F-2. In other embodiments, a plurality of micro arcuate sections are interspaced by a plurality of macro arcuate sections, such as depicted in FIG. 8.

FIGS. 6B to 6E depict a variety of arcuate or reinforced sections that may replace any of arcuate or partially arcuate sections 12F-1, 12F-2, 12E-1, 12E-2 etc. It should be understood that other reinforced sections may be employed in addition or instead of those discussed and depicted herein. For example, reinforced sections may include stiffeners having an "X" shaped cross section (in a plane defined by inward-outward direction 24 and transverse direction 16). The section of FIG. 6F depicts a section having one or more internal stiffeners similar to internal stiffener 150 disclosed herein. As discussed herein, such internal stiffeners can be employed at one or more locations along any of the panels disclosed herein. It should be understood by one of skill in the art that any panel 12 (112, 212, etc.) described herein may include any combination of any of the panel stiffening features described herein such as micro, macro and partially arcuate sections, internal stiffeners, ribs, double cell stiffeners etc.

Extending between outer layer 12A and inner layer 12B, panel 12 comprises a plurality of brace elements 13 as best seen in FIG. 6A. Brace elements 13 may be oriented generally orthogonally to outer layer 12A. This is not mandatory. Brace elements 13 may or may not be oriented generally orthogonally to inner layer 12B, depending on the orientation of inner layer 12B (e.g. brace 13 or partially arcuate section 12F-1A may be oriented orthogonally to inner layer 12B while brace 13 of macro arcuate section 12D is not). In the illustrated embodiment, brace elements 13 are parallel with one another. This is not mandatory. In the illustrated embodiment, braces 13 are oriented to be symmetrical about a notional transverse mid-plane 42 of panel 12. This is also not mandatory.

This shape of outer and inner layers 12A, 12B and the orientations of brace elements 13 may reduce deformation due to sagging (in transverse and longitudinal directions 16, 19) in panel 12 as explained in more detail below. It will be appreciated that panel 12 of the illustrated embodiment comprises fourteen pairs of brace elements 13 that are symmetrical with respect to notional mid-plane 42, but that in other embodiment, panel 12 may comprise other numbers of pairs of symmetrical brace elements or panel 12 may comprise an odd number of brace elements that may, or may not, be symmetrical about mid-plane 42.

The configuration of panels 12 (including the shape of inner layer 12B and the orientations of brace elements 13) may tend to reduce the deformation of panels 12 (or at least the deformation of outer layers 12A of panels 12) relative to that of prior art panels. More particularly, the convex (and arcuate convex) shapes of inner layer 12B may form arcuate quasi-truss configurations which tends to redirect outward forces to the longitudinally extending edges of panels 12, but since panels 12 are attached to structure 40 at their longitudinally extending edges, this redirection of outward forced may result in relatively little deformation of outer layers 12A of panels 12. Additionally, within panels 12 (i.e. between inner layer 12B and outer layer 12A), adjacent brace elements 13 themselves have transverse cross-sections that provide a series of transversely-adjacent longitudinally-extending quasi-truss configurations. Further, inner layers of panel 12 may be able to deform into the spaces between the contact regions of brace elements 13. Another advantage of brace elements 13 is that they may provide outer layer 12A with strength against deformation caused by any external force oriented toward panel 12 and inner layer 12B with strength against deformation caused by insulation or the like.

In addition to the truss like characteristics of outer layers 12A, inner layers 12B and brace elements 13 of panels 12, these features may also provide some insulating properties which may reduce the rate of transfer of heat across panels 12 relative to prior art panels. In some instances, the spaces between outer layers 12A, inner layers 12B and brace elements 13 of panels 12 may be filled with insulation which may further enhance this insulation effect.

In some embodiments, panel 12 may comprises a plurality (e.g. fourteen in the illustrated embodiment) of ribs 28 which project inwardly from inner layer 12B of panel 12.

In other embodiments, panel 12 may be provided with different numbers of ribs 28 which may be spaced apart from one another along the transverse dimension of panel 12. Ribs 28 may be longitudinally co-extensive with panel 12—i.e. ribs 28 may extend into an out of the page of FIG. 6A (the longitudinal direction) and may be co-extensive with panel 12 in this longitudinal dimension. This is not necessary, however, and ribs 28 may have different longitudinal extensions than that of panel 12. In addition to extending inwardly and longitudinally, ribs 28 may extend transversely. Ribs 28 may provide increased stiffness across the longitudinal dimension of panel 12. In the case that ribs 28 extend transversely across panel 12, ribs 28 may also provide increased stiffness across the transverse dimension of panel 12. As can be seen from FIG. 6A, ribs 28 may have a transverse dimension that is greater than a transverse dimension of braces 13, although this is not mandatory.

In addition to providing increased stiffness of panel 12, ribs 28 may be sized and/or shaped to permit stacking of panels 12 for storage and shipping. More particularly, ribs 28 may be sized and/or shaped such that the innermost extent 28A of ribs 28 is co-planar with an apex 44 of the convexity of macro arcuate section 12D of inner layer 12B in a plane substantially parallel to outer layer 12A. For example, as shown in FIG. 6A, there is a notional plane 46 that is: parallel to outer layer 12A; tangential to apex 44, or otherwise contacts inner layer 12B at only its innermost extent; and tangential to innermost extent 28A of ribs 28, or otherwise contacts ribs 28 only at their innermost extents 28A. With ribs 28 having this size/shape feature, panels 12 having convex portions of inner layer 12B may be conveniently stacked on top of one another such that ribs 28 and apex 44 of inner layer 12B of one panel 12 rest adjacent outer layer 12A of an adjacent panel 12. In other embodiments, stacking may be facilitated by making ribs 28 extend inwardly beyond apex 44, so that panels stack on the innermost extents 28A of a plurality of ribs 28. In addition to aiding in stacking panels 12, ribs 28 may serve to ease installation of panels 12 against a plywood ceiling by providing a stable connection between ribs 28, apex 44 and the plywood ceiling upon installation. Ribs 28 may be varied in a number of ways while still provide increased stiffness of panel 12 and innermost extents 28A having the features described above.

Figure 6G:
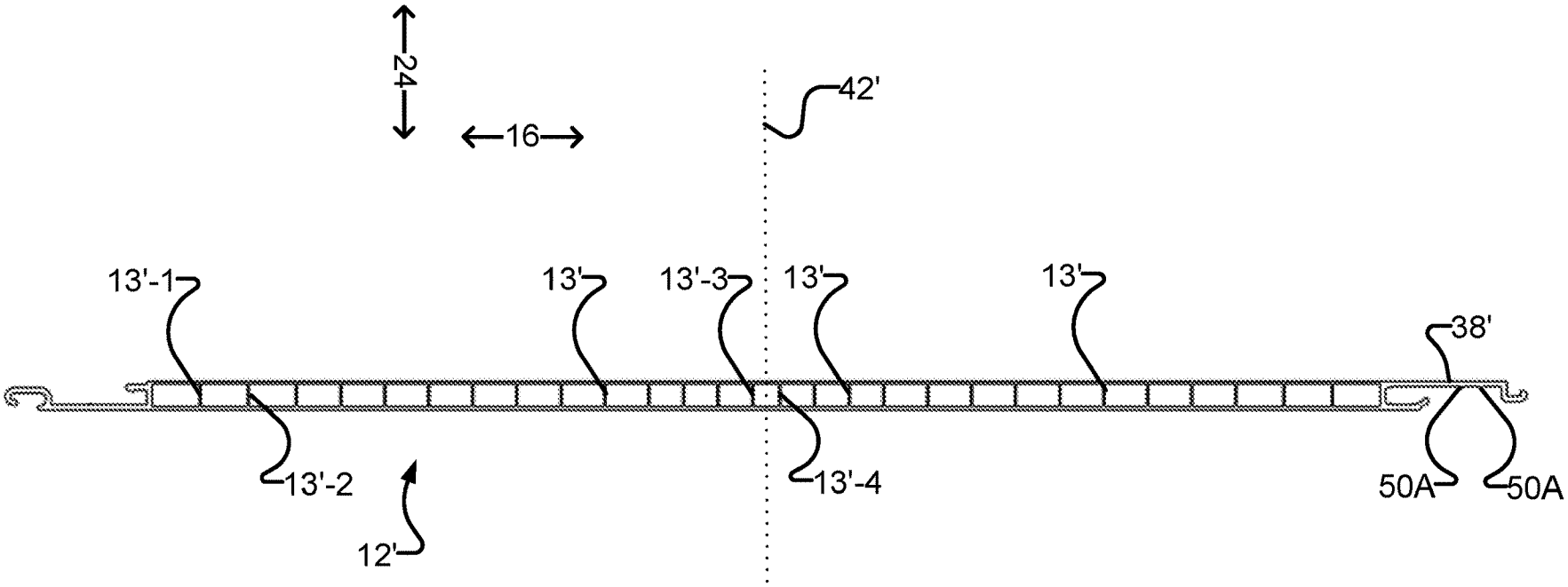
FIG. 6G is a cross-sectional profile view of a panel of another embodiment of a structure cladding apparatus.

FIG. 6G depicts another non-limiting example of a panel 12'. Panel 12' is substantially similar to panel 12 except that one or more pairs of adjacent braces 13' of panel 12' are spaced apart in transverse direction 16 by different transverse direction 16 distances. For example, the transverse distance between brace 13'-1 and brace 13'-2 is greater than the transverse distance between brace 13'-3 and brace 13'-4, as depicted in FIG. 6G. In some embodiments, the spacing between adjacent braces 13' is arbitrary. In other embodiments, the spacing between adjacent braces 13' is smaller for braces 13' that are nearer to transverse mid-plane 42' of panel 12' than for adjacent braces 13' that are further away from transverse mid-plane 42'. Such spacing may have the advantage of increasing the transverse rigidity (e.g. preventing bending of panel 12' across its transverse dimension) by reinforcing the transverse center of panel 12', where the bending stress may be at a maximum when both longitudinally extending edges 20, 22 are supported. It should be understood that any of the embodiments herein may have braces 13' (or braces 13, 113 etc.) that are spaced apart as in the FIG. 6G embodiment or as described herein.

As compared to panel 12, panel 12' also comprises one or more additional fastener locator features 50A. Fastener locator features 50A may comprise one or more protrusions on mounting tab 38'. Fastener locator features 50A may serve to help position fasteners 50 when installing panel 12'. Fastener locater features 50A may also serve to prevent fastener 50 from being overtightened. Fastener locater features 50A may also serve to reduce friction between fastener 50 and mounting tab 38' to allow panel 12' to move relative to fastener 50, as needed, such as to allow for thermal expansion/contraction of panel 12'. Fastener locater features 50A may also serve to reduce the likelihood of mounting tab 38' breaking due to overtightening of fastener 50. Fastener locater features 50A may also serve to align a punching tool employed for creating one or more apertures in mounting tab 38' for receiving fasteners 50. It should be understood that any of the embodiments herein may comprise one or more fastener locator features 50A as in the FIG. 6G embodiment or as described herein.

Figure 6H:
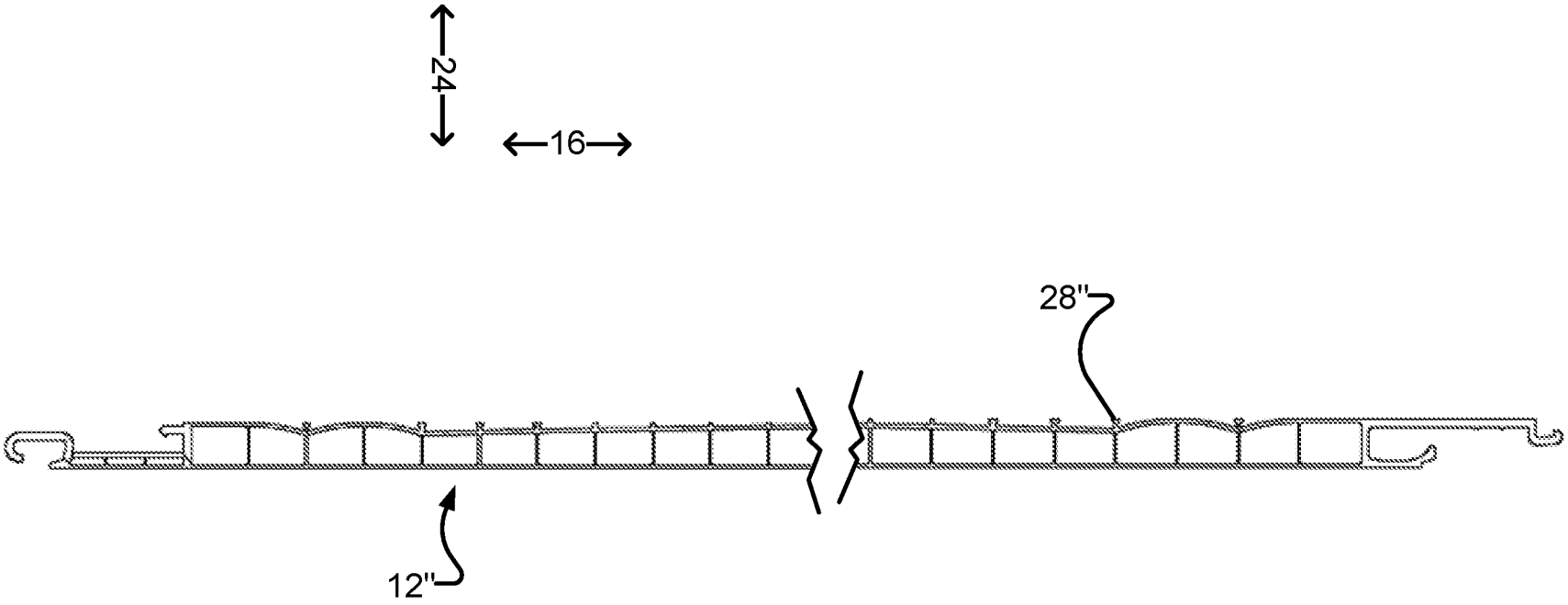
FIG. 6H is a cross-sectional profile view of a portion of a panel of another embodiment of a structure cladding apparatus wherein the break lines indicate that a central portion of the panel is not depicted.
Figure 6I:
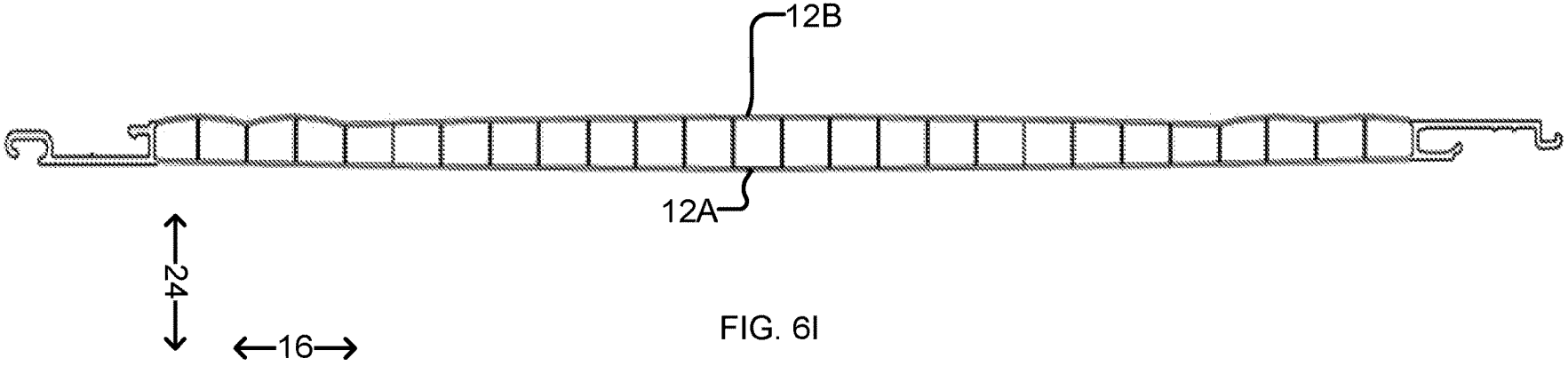
FIGS. 6I and 6J are cross-sectional profile views of panels of additional embodiments of a structure cladding apparatus
Figure 6J:
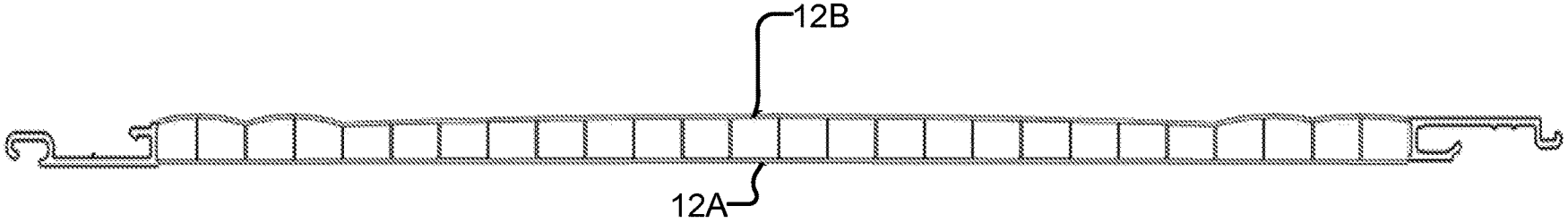

FIG. 6H depicts another non-limiting example of a panel 12". Panel 12" is substantially similar to panel 12 except that at least one of ribs 28" has a different shape than ribs 28. In particular, at least one of ribs 28" has a cross-section in a plane defined by the transverse and longitudinal directions 16, 19 that is "T" shaped. The "T" shape may increase the longitudinal rigidity of panel 12" by functioning similar to an I-beam. The "T" shape may also improve the stackability of panel 12". In some embodiments, all of ribs 28" are T-shaped while in other embodiments, only some are. For example, in some embodiments, to ease fabrication of panel 12", ribs 28" that are longer than an inward-outward direction 24 threshold are "T" shaped while ribs 28" that are shorter than the inward-outward direction 24 threshold are not "T" shaped. It should be understood that any of the embodiments herein may comprise one or more "T" shaped ribs 28" as in the FIG. 6H embodiment or as described herein.

Figure 7A:
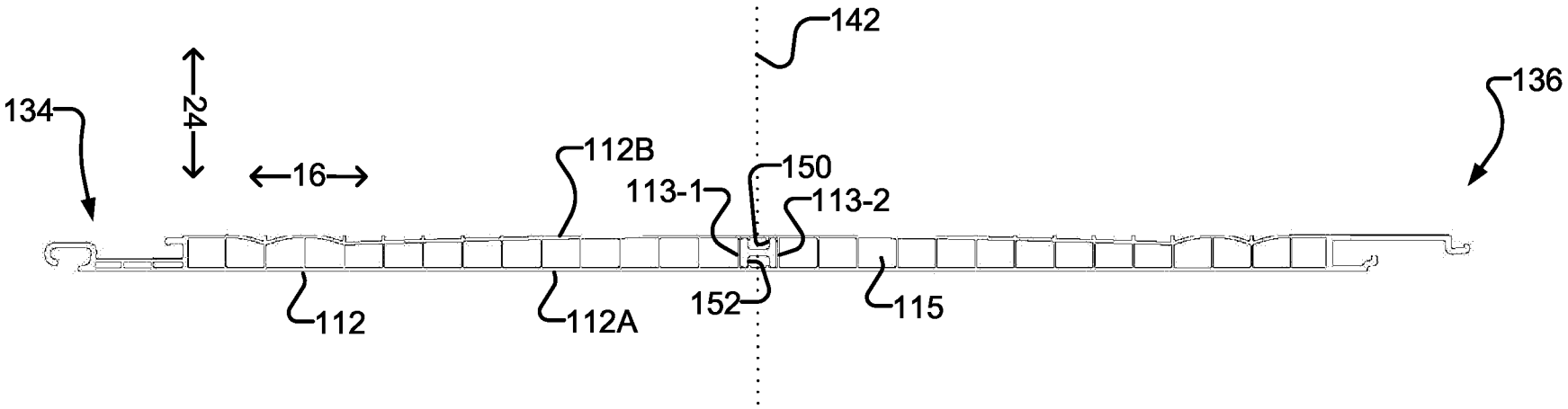
FIG. 7A is a cross-sectional profile view of a panel of another structure cladding apparatus according to one embodiment of the invention.

FIG. 7A depicts another non-limiting example of a panel 112. Panel 12 is substantially similar to panel 12 except that panel 112 comprises an internal stiffener 150 located between outer layer 112A and inner layer 1128 and between braces 113-1, 113-2. Internal stiffener 150 may be longitudinally co-extensive with panel 12—i.e. internal stiffener 150 may extend into an out of the page of FIG. 7A (the longitudinal direction) and may be co-extensive with panel 12 in this longitudinal dimension. This is not necessary, however, and internal stiffener 150 may have a different longitudinal extension than that of panel 12.

Figure 7B:
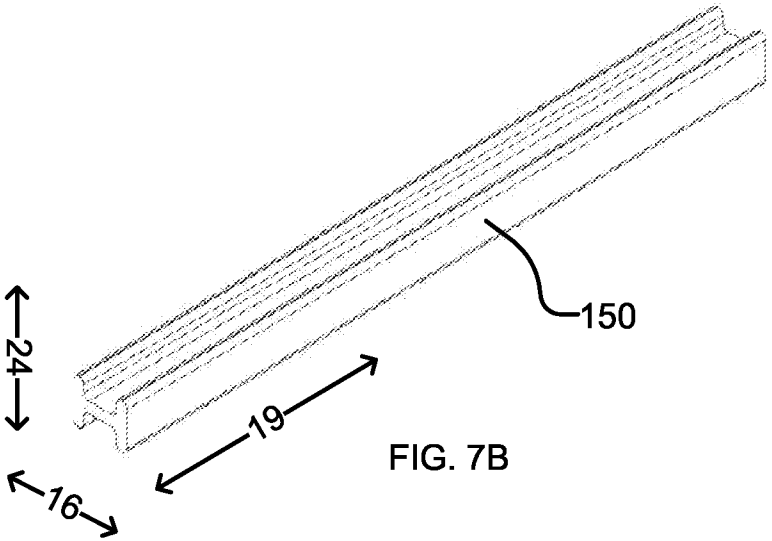
FIG. 7B is an elevated perspective view of an internal panel stiffener according to the FIG. 7A embodiment.

As depicted in FIGS. 7A and 7B, internal stiffener 150 (sometimes referred to as stiffener 150) has a cross-sectional shape in a plane defined by transverse and longitudinal directions 16, 19 like an "H". The "H" cross-section may be advantageous as offering a high stiffness-to-weight ratio. However, it should be understood that any cross-sectional shape may be employed such as, but not limited to, triangular, circular, square, hollow, solid, channeled, I-shaped, U-shaped, V-shaped etc. Notably, the channels 115 defined by outer layer 112A, inner layer 11B and braces 13 may not be of rectangular cross-section. Accordingly, internal stiffener may be shaped to accommodate the non-rectangular cross-section of the channel 115 in which it is installed.

As shown in FIG. 7A, panel 112 may comprise one or more alignment nubs 152 for aligning stiffener 150 and preventing internal stiffener 150 from being installed in an incorrect orientation relative to panel 112. In some embodiments, alignment nubs 152 may serve to reduce friction during installation of stiffener 150 by reducing the surface area of panel 112 in contact with stiffener 150.

Although only one internal stiffener is depicted in FIG. 7A, it should be understood that any number of internal stiffeners may be employed within panel 112. In some embodiments, the number of internal stiffeners may be dependent on, at least, the weight of material to be installed above (or to be held in by) panel 112. For example, as the amount of insulation above panel 112 increases, it may be advantageous to install additional internal stiffeners 150. Additional internal stiffeners 150 may be spread or spaced apart along the transverse length of panel 12 in any suitable way. In some embodiments, a plurality of longitudinal stiffeners 150 are installed so as to be mirror symmetric about transverse mid-plane 142 of panel 112.

Internal stiffener 150 may comprise any suitable material. For example, internal stiffener 150 may comprise a pultruded fiber reinforced polymer composite, or an extruded polymer. By way of non-limiting example, suitable polymers include: poly-vinyl chloride (PVC), acrylonitrile butadiene styrene (ABS) or the like. In other embodiments, internal stiffener 150 may be fabricated from other suitable materials, such as composite materials (e.g. a combination of one or more resins and natural and/or synthetic materials), for example. Although pultrusion and extrusion are particular techniques for fabricating stiffeners 150, other suitable fabrication techniques, such as injection molding, stamping, sheet metal fabrication techniques or the like may additionally or alternatively be used.

Internal stiffener could be manufactured concurrently with panel 112, such as by extrusion. In other embodiments, internal stiffener is installed into panel 112 after panel 112 is fabricated. Due to the tight fit between internal stiffener 150 and panel 112, it may be difficult to install internal stiffener 150 in panel 112. In some embodiments, internal stiffener is cooled so as to allow internal stiffener to contract to facilitate sliding of stiffener 150 into panel 112. In other embodiments, panel 112 may be heated so as to allow panel 112 to expand to facilitate sliding of stiffener 150 into panel 112. After internal stiffener 150 is installed in channel 115, panel 112 and stiffener 150 may be allowed to return to ambient temperature to achieve a tight fit between stiffener 150 and channel 115.

In general, panels 12 may be attached to one or more supports 40A of structure 40 by fasteners 50 which extend through their mounting tabs 38. Fasteners 50 may comprise any suitable fasteners, including screws, nails, bolts, staples, etc. In some embodiments, structure cladding 10 is mounted to one or more supports 40A of structure 40 by other means, such as suitable adhesives and/or the like. Mounting tab 38 may comprise part of first inner component 34A. For example, mounting tab 38 may include one or more apertures defined by first inner component 34A for receiving fasteners 50. The aperture may be substantially circular or may be elongated to allow for some movement of panel 12 relative to structure 40 (e.g. to accommodate thermal expansion/contraction). In some embodiments, a plurality of fasteners 50 are spaced apart from one another along the longitudinal dimensions of panels 12 (such as in, for example, FIG. 19).

In FIG. 2, second connector 36 of second panel 12-2 is connected to first connector 34 of first panel 12-1 as shown in FIGS. 5A-5F, so that second connector 36 of second panel 12-2 covers fasteners 50 used to attach first panel 12-1 to structure 40. First panel 12-1 is attached to one or more supports 40A of structure 40 by fasteners 50 which extend through mounting tab 38. A plurality of fasteners 50 are spaced apart from one another along the longitudinal dimension of mounting tab 38 (i.e. spaced along the dimension into and out of the page and therefore not visible in the views of FIG. 2). After second panel 12-2 is aligned with first panel 12-1 and connection 32 is formed, mounting tab 38 of second panel 12-2 is attached to one or more supports 40A of structure 40 by fasteners 50 in a manner similar to the attachment of first panel 12-1 described above (not depicted in FIG. 2).

Any suitable number of panels 12 may be installed adjacent to one another in this manner. Panels 12 may continue to be installed until an entire surface of a structure 40 is lined with panels 12. If, after a number of panels are installed on a surface of structure 40, there is insufficient transverse space for an additional panel 12 to be installed, longitudinally extending edge 20 of a panel 12 may be cut so as to shorten a transverse dimension of panel 12 before installing it in the remaining space on the surface of structure 40.

Structure 40 may comprise any suitable structure. Structure 40 may comprise drywall, gyprock, studs, concrete, furring strips, plywood, masonry, stucco, other wall layers, etc. Structure 40 may comprise the floor, ceiling, roof, exterior walls, interior walls, etc. of a structure. Structure 40 may comprise all of or a portion of a building, barn, silo, food storage container, car wash, factory, etc. Structure 40 may be rectilinear or curved. Where structure 40 is curved, panels 21 may be curved to match the curvature of structure 40. Additionally or alternatively, panels 12 may be deformable such that they can be deformed to match the curvature of structure 40. Supports 40A of structure 40 may comprise any suitable supports such as truss members, plywood panels, roofing beams, etc.

FIG. 8 depicts a structure lining apparatus according to another particular non-limiting embodiment of the invention. Like structure-lining apparatus 10, structure lining apparatus 210 comprises a plurality of generally planar panels 212 which extend in a longitudinal dimension (into and out of the page) and in a transverse dimension (shown by double-headed arrow 16). Structure lining apparatus 210 is substantially similar to structure lining apparatus 10 (e.g. may comprise similar materials, may be installed in similar ways, etc.) except that panels 212 comprise different connectors 234, 236 (as compared to connectors 34, 36) and different stiffening features as compared to panels 12 and as will be discussed in more detail herein.

Figure 9A:
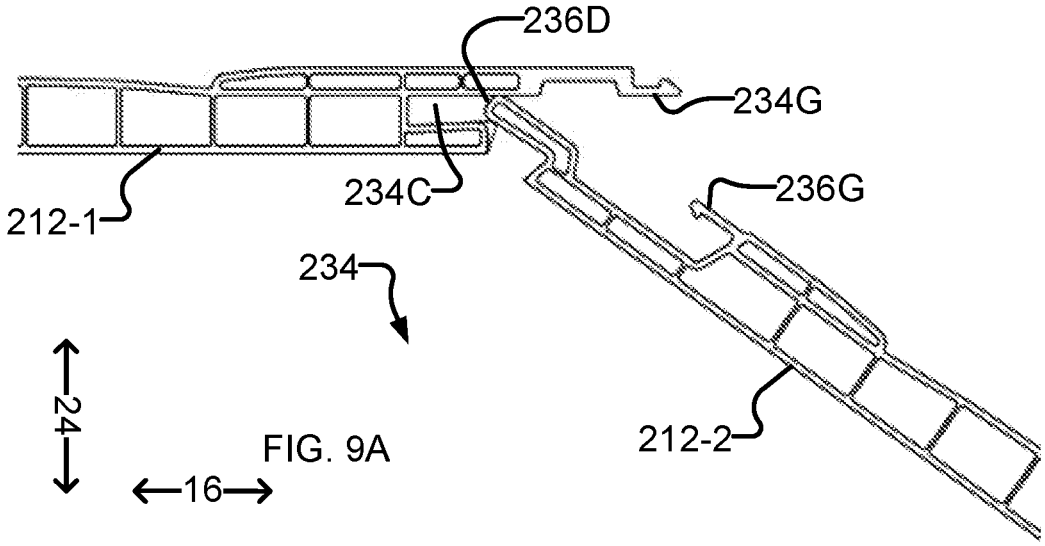
FIGS. 9A to 9C are cross-sectional profile views of the formation of a connection of two panels of the structure cladding apparatus of the FIG. 8 embodiment.
Figure 9B:
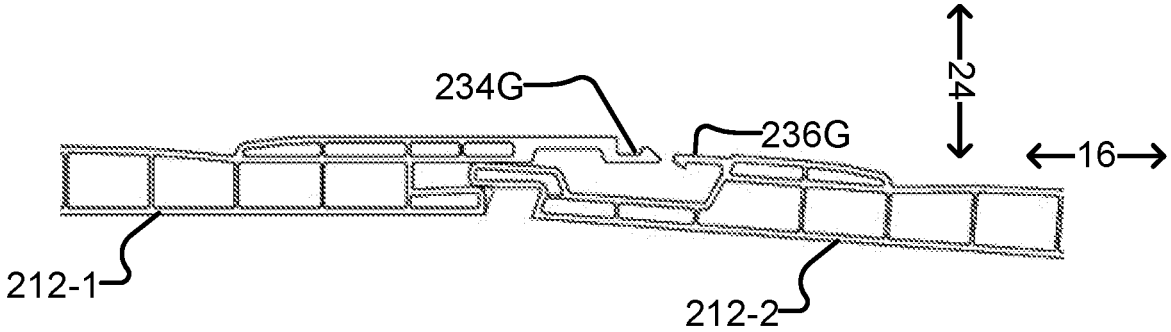
Figure 9C:
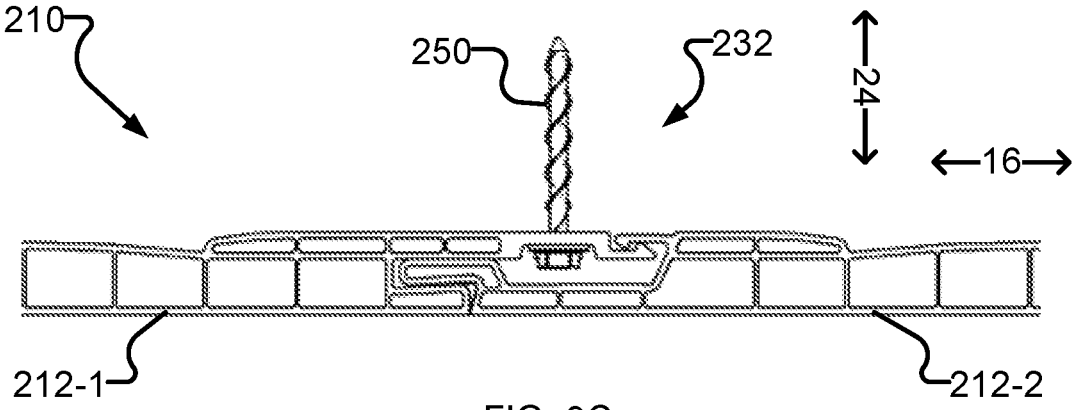

FIGS. 9A to 9C shows detail of an edge-to-edge connection 232 of transversely adjacent panels 212-1, 212-2 of wall-lining apparatus 210. In particular, FIG. 9C depicts a transverse cross-section (i.e. a cross section in a plane defined by the transverse and inward-outward directions) of edge-to-edge connection 232. In the illustrated embodiment, longitudinally extending edge 220 of a first panel 212-1 comprises a first connector 234 and opposing longitudinally extending edge 222 of a transversely adjacent second panel 12-2 comprises a complementary second connector 236.

First connector component 234 may comprise a primary female connector 237A and a secondary male connector 235B while second connector 236 may comprise a primary male connector 235A and a secondary female connector 237B. Connection 232 is formed when the primary male connector engages the primary female connector and the secondary male connector engages the secondary female connector. This double male/female connector connection 232 functions to improve engagement of connection 232 and prevent disengagement upon sagging of one or more panels 212, or failure of one or more fasteners 250 and also serves to reduce sagging of panels 212 both longitudinally and transversely.

As can be seen from FIGS. 8, 8A, 9A, 9B and 9C, first connector 234 comprises a primary female connector 237A defined by a first inner component 234A and a first outer component 234B and a secondary male connector 235B comprising first finger 234G. First finger may be substantially like first finger 34G as described herein. However, first inner component 234A may be different than first inner component 34A. In particular, first inner component 234A may be hollow and comprise one or more channels (similar to the channels of second outer component 36B). Further, first inner component 234A extends in transverse direction 16 toward connector 236 such that first inner component 234A overlaps with a plurality of channels 215 (e.g. an inward-outward direction 24 line could pass through both channels 215 and first inner component 234A). In this way, first inner component 234A adds transverse and longitudinal stiffness to panel 212. The overlapping of first inner component 234A and channels 215 may be referred to as a double-cell feature and may be employed in any of the panel embodiments described herein.

First outer component 234B may also be different from first outer component 34B in that first outer component 234B may be hollow and does not comprise a barb 34D. Instead, first outer component comprises a tongue 234D that has an inward-outward dimension that increases towards its transverse distal end such that recess 234C has an inward-outward dimension that decreases toward its distal end. This is not necessary, tongue 234D may have a constant inward-outward dimension along its transverse length. Like seal 52, a seal 252 may be located a distal end of tongue 234D to improve connection 232.

As can be seen from FIGS. 8, and 9A, 9B and 9C, second connector 236 comprises a primary male connector 235A comprising a second outer component 236B having a tongue 236D and a secondary female connector 237B defined by second inner component 236A and second outer component 236B. Second finger 236G of second inner component 236A may be substantially like second finger 36G as described herein. However, second outer component 236B may be different than second outer component 36B. In particular, instead of comprising a hook 36D, second outer component 236B comprises a tongue 236D. Tongue 236D may be hollow as depicted or may be solid. Tongue 236D may comprise an inward-outward dimension that increases towards its transverse distal end. This is not necessary, tongue 236D may have a constant inward-outward dimension along its transverse dimension. Tongue 236D may be complementary to recess 234C of connector 234. Moreover, second inner component 236A may be different than first inner component 36A. In particular, second inner component 236A extends in transverse direction 16 toward connector 234 such that second inner component 236A overlaps with a plurality of channels 215 (e.g. an inward-outward direction 24 line could pass through both channels 215 and second inner component 236A). In this way, second inner component 236A adds transverse and longitudinal stiffness to panel 212. As with first inner component 234A, the feature of second inner component 236A overlapping with channels 215 may be referred to as a double cell feature and may be employed on any panel described herein.

Given the similarity of panels 12 and panels 212, it should be evident to a person of skill in the art that panels 212 may be attached to one another in a similar method as described herein in relation to panels 12. However, since there is no hook 36D on panel 212, panel 212-2 may not be able to hang from panel 212-1 during installation. Nonetheless, with panels 212-1 and 212-2 oriented at an angle of between 10-80° of one another, a distal end of tongue 236D may be inserted into recess 234C, as shown in FIG. 9A. Panel 212-2 may then be pivoted relative to panel 212-2 to allow tongue 236D to slide further into recess 234C, as shown in FIG. 9B. As panels 212-1, 212-2 align with one another (e.g. are oriented at 0° relative to one another as in FIG. 9C), panels 212-1, 212-2 may be pushed together in transverse direction 16 to engage primary male and female connectors 235A, 237A and secondary male and female connectors 235B, 237B by engaging tongues 234D and 236D and engaging first and second fingers 234G, 236G, in a similar manner to the engagement of first and second fingers 34G, 36G depicted in FIGS. 5A to 5G. In other embodiments, tongue 236D and recess 234C are shaped such that primary male connector 235A and primary female connector 237A may be connected by relative transverse movement of first and second connectors 234, 236 and without pivoting of panels 212-1, 212-2. In some embodiments, one or more of tongue 236D and outer connector component 234B is resiliently deformed during the connection of primary male connector 235A and primary female connector 237A and is at least partially restoratively deformed to maintain the connection between primary male connector 235A and primary female connector 237A.

Referring to FIG. 8, it can be seen that panel 212 has one or more stiffening features. For example, panel 212 comprises a plurality of micro-arcuate sections 212E (e.g. micro-arcuate sections 212E-1, 212E-2, 212E-3) spaced apart by a plurality of macro-arcuate sections 212D (e.g. macro-arcuate 212D-1, 212D-2, 212D-3, 212D-4). Micro-arcuate sections 212E provide panel 212 with significant increased stiffness in the longitudinal direction and increased stiffness in the transverse direction. Macro-arcuate sections 212D provide panel 212 with significant increased stiffness in the transverse and increased stiffness in the longitudinal direction. Panels 212 (or panels 12, 112 etc.) may comprise any combination of micro-arcuate sections 212E and macro-arcuate sections 212D. In some embodiments, micro-arcuate sections 212E and macro-arcuate sections 212D are spaced apart so as to exhibit mirror symmetry about a transverse mid-plane of panel 212, although this is not mandatory.

These features (including the double cell features) may function to allow panel 212 to be employed in structures having larger spaces 40B between adjacent supports 40A due to the increased stiffness of panels 212, thereby reducing the number of supports 40A employed for a given structure 40, reducing the number of fasteners 250 to be employed, reducing costs of apparatus 210 and simplifying installation of apparatus 210.

Figure 10:
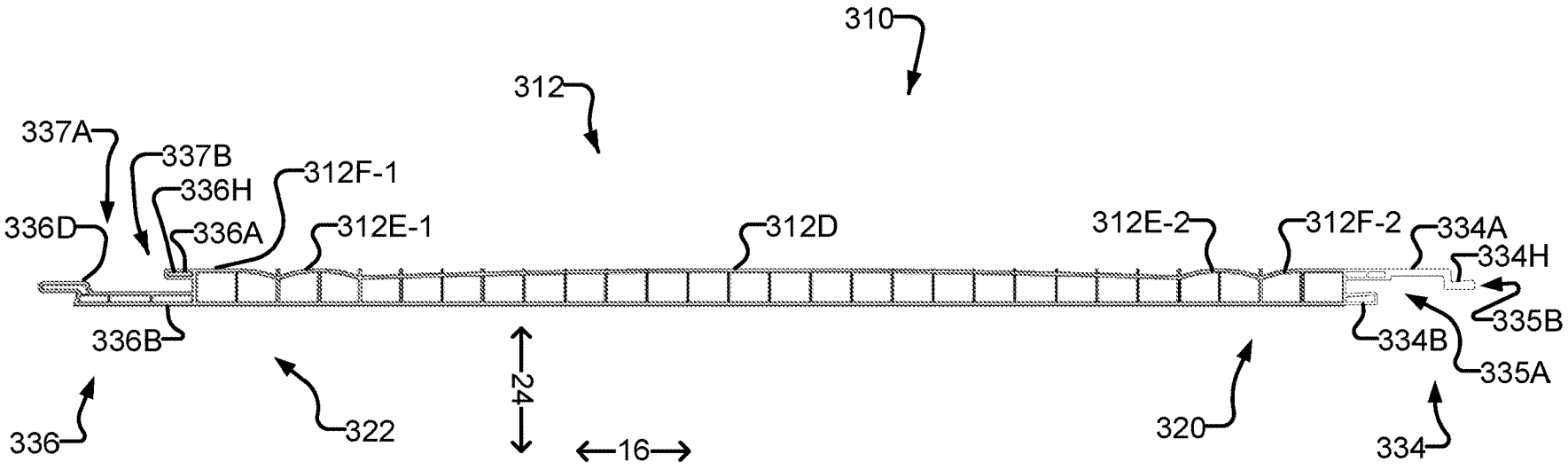
FIG. 10 is a cross-sectional plan view of a panel of a structure lining apparatus according to another embodiment of the invention.

FIG. 10 depicts a structure lining apparatus according to another particular non-limiting embodiment of the invention. Structure lining apparatus 310 comprises a plurality of generally planar panels 312 which extend in a longitudinal dimension (into and out of the page) and in a transverse dimension (shown by double-headed arrow 16). Structure lining apparatus 310 is substantially similar to structure lining apparatus 10 (e.g. may comprise similar materials, may be installed in similar ways, etc.) except that panels 312 comprise different connectors 334, 336 as will be discussed in detail below.

Figure 11A:
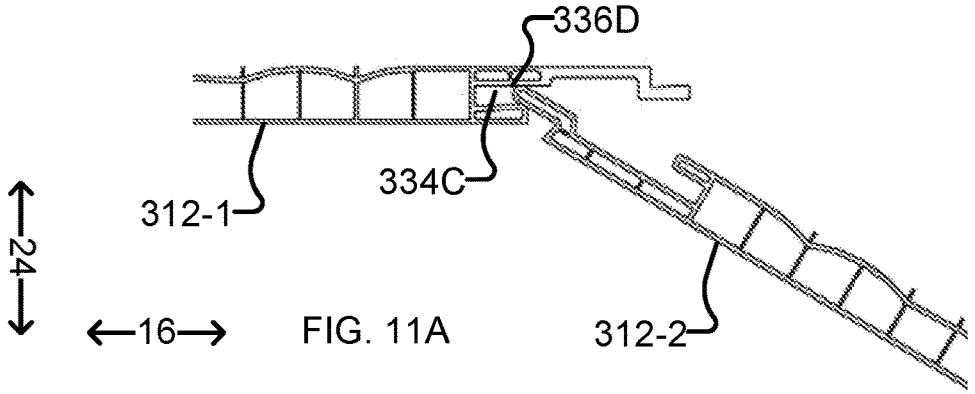
FIGS. 11A to 11D are cross-sectional profile views of the formation of a connection of two panels of the structure cladding apparatus of the FIG. 10 embodiment.
Figure 11B:
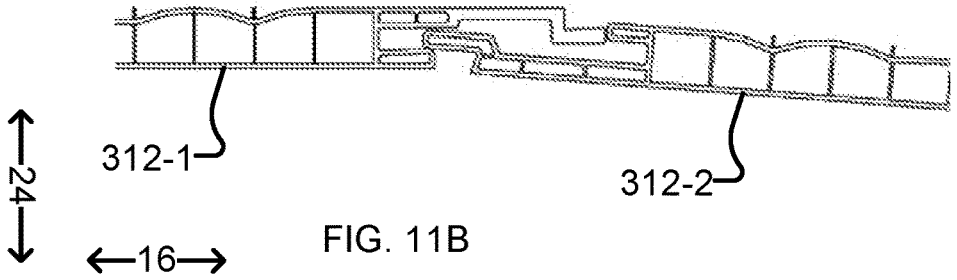
Figure 11C:
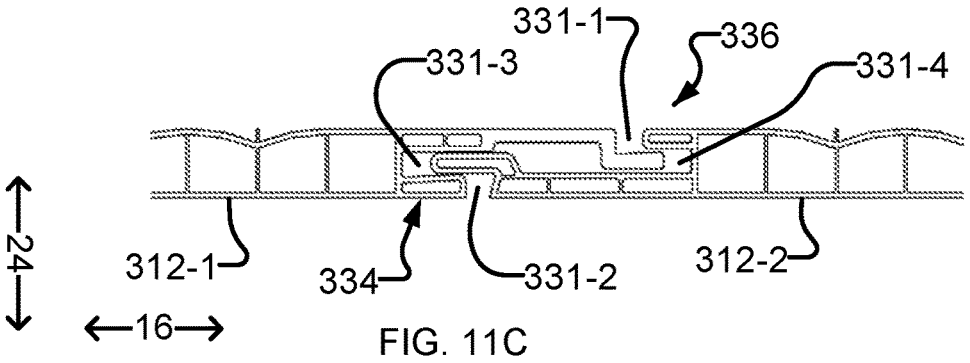
Figure 11D:
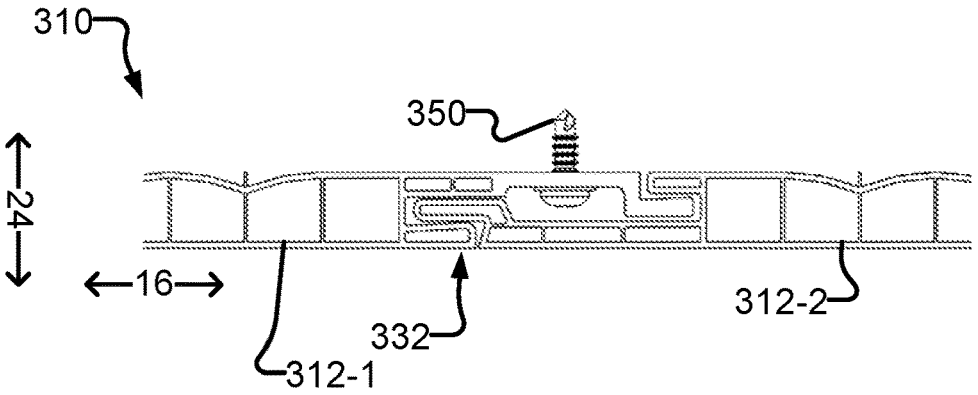

FIG. 11D shows a detailed view of an edge-to-edge connection 332 of transversely adjacent panels 312-1, 312-2 of wall-lining apparatus 310. In particular, FIG. 11D depicts a transverse cross-section (i.e. a cross section in a plane defined by the transverse and inward-outward directions) of edge-to-edge connection 332. In the illustrated embodiment, longitudinally extending edge 320 of a first panel 312-1 comprises a first connector 334 and opposing longitudinally extending edge 322 of a transversely adjacent second panel 312-2 comprises a complementary second connector 336.

First connector component 334 may comprise a primary female connector 337A and a secondary male connector 335B while second connector 336 may comprise a primary male connector 335A and a secondary female connector 337B. Connection 332 is formed when the primary male connector engages the primary female connector and the secondary male connector engages the secondary female connector. This double male/female connector connection 332 functions to improve engagement of connection 332 and prevent disengagement upon sagging of one or more panels 312, or failure of one or more fasteners 350 and also serves to reduce sagging of panels 312 both longitudinally and transversely.

First connector 334 comprises a primary female connector 337A defined by a first inner component 334A and a first outer component 334B and a secondary male connector 335B comprising first tongue 334G. First outer component 334B is substantially similar to first outer component 234B. First inner component is substantially similar to first inner component 34B except that it comprises tongue 334H at its distal end instead of hook tip 34H.

Second connector 336 comprises a primary male connector 335A comprising a second outer component 336B having a tongue 336D and a secondary female connector 337B defined by second inner component 336A and second outer component 336B.

Second outer component 336B is substantially similar to second outer component 236B. Second inner component is substantially similar to second inner component 36B except that it comprises tongue 336H at its distal end instead of hook tip 36H.

Given the similarity of panels 212 and panels 312, it should be evident to a person of skill in the art that panels 312 may be attached to one another in a similar method as described herein in relation to panels 212. However, since there are no hook tips 34H, 36H, secondary male and female connectors 35B, 37B may be connected without deformation (or with less deformation) of first and second inner components 334A, 336A. For example, FIGS. 11A to 11D depict the formation of connection 332. In other embodiments, tongue 336D and recess 334C are shaped such that primary male connector 335A and primary female connector 337A may be connected by relative transverse movement of first and second connectors 334, 336 and without pivoting of panels 312-1, 312-2. In some embodiments, one or more of tongue 336D and outer connector component 334B is resiliently deformed during the connection of primary male connector 335A and primary female connector 337A and is at least partially restoratively deformed to maintain the connection between primary male connector 335A and primary female connector 337A.

Figure 12:
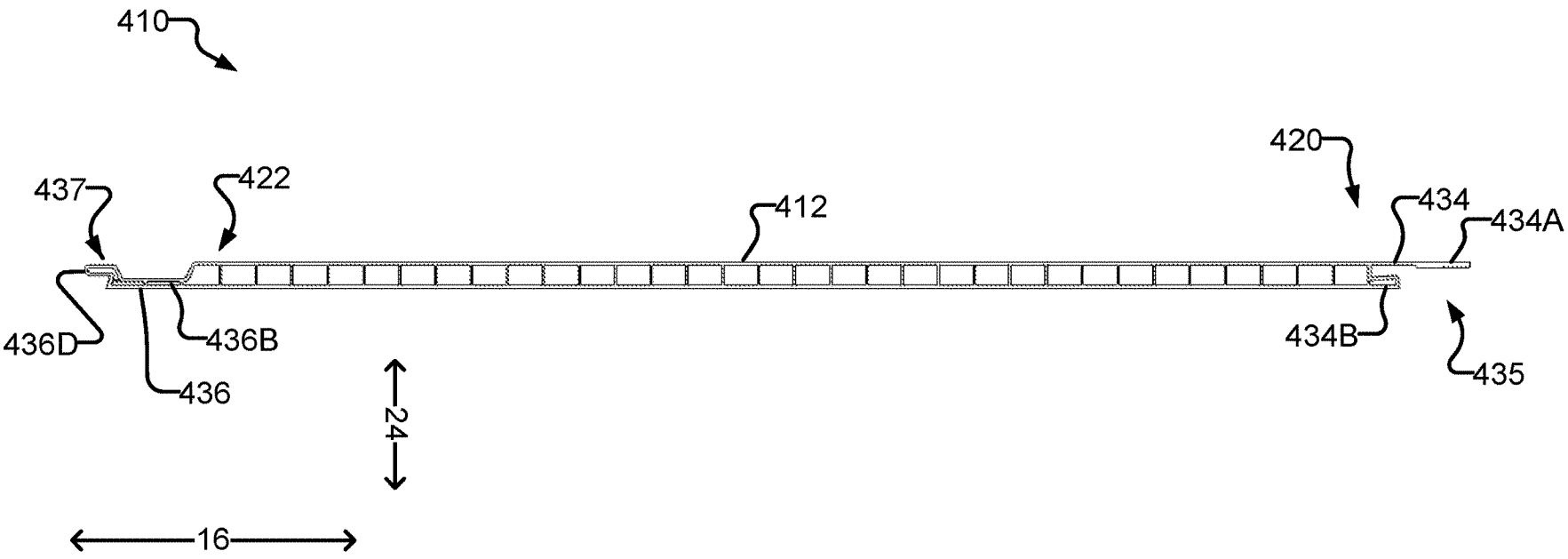
FIG. 12 is a cross-sectional profile view of a panel of another structure cladding apparatus according to one embodiment of the invention.

FIG. 12 depicts a structure lining apparatus according to another particular non-limiting embodiment of the invention. Structure lining apparatus 410 comprises a plurality of generally planar panels 412 which extend in a longitudinal dimension (into and out of the page) and in a transverse dimension (shown by double-headed arrow 16). Structure lining apparatus 410 is substantially similar to structure lining apparatus 10, 210, 310 (e.g. may comprise similar materials and be installed in similar ways, etc.) except that panels 412 comprise different connectors 434, 436, as will be discussed in detail below.

Figure 13:
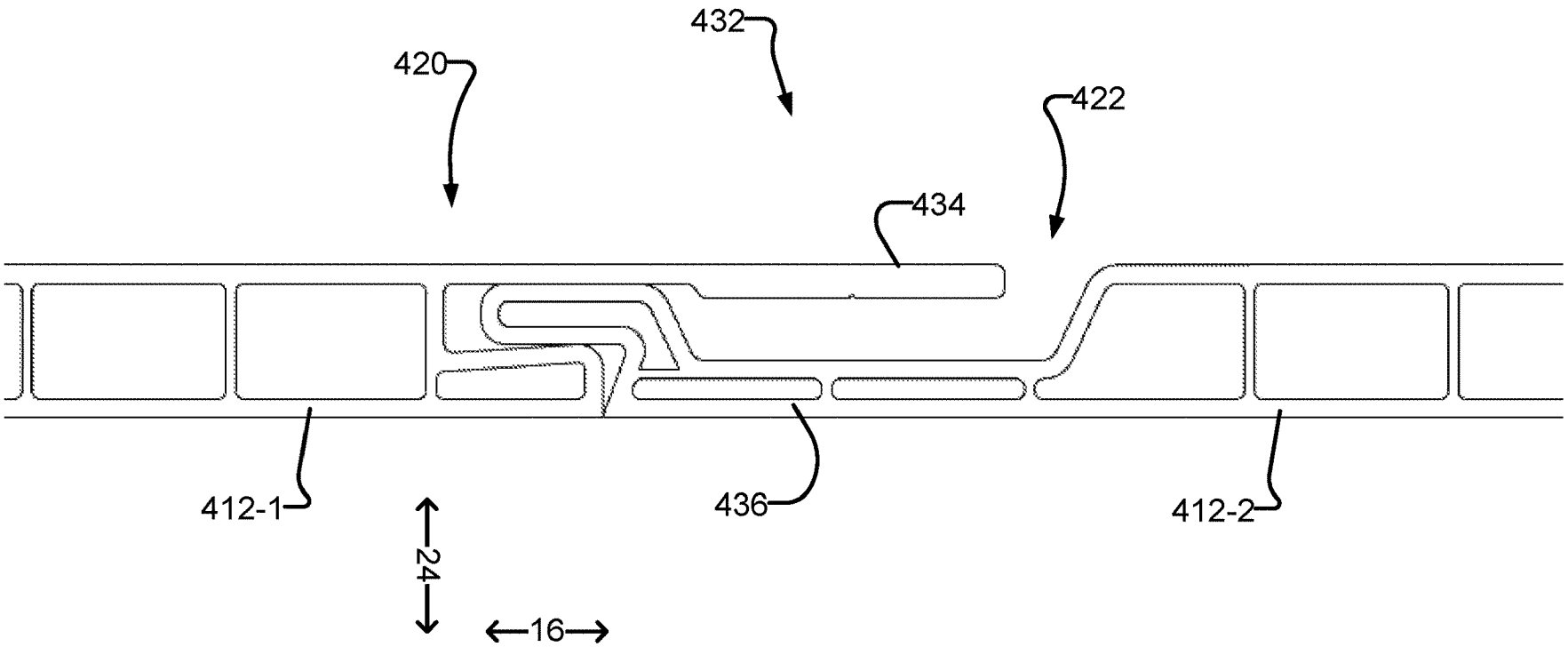
FIG. 13 is a cross-sectional plan view of a panel of a structure lining apparatus according to the FIG. 12 embodiment.

FIG. 13 shows detail of an edge-to-edge connection 432 of transversely adjacent panels 412-1, 412-2 of wall-lining apparatus 410. In particular, FIG. 13 depicts a transverse cross-section (i.e. a cross section in a plane defined by the transverse and inward-outward directions) of edge-to-edge connection 332. In the illustrated embodiment, longitudinally extending edge 420 of a first panel 412-1 comprises a first connector 434 and opposing longitudinally extending edge 422 of a transversely adjacent second panel 412-2 comprises a complementary second connector 436.

First connector component 434 may comprise a primary female connector 435 while second connector 436 may comprise a primary male connector 437. Connection 432 is formed when the primary male connector engages the primary female connector.

First connector 334 comprises a primary female connector 437 defined by a first inner component 434A and a first outer component 434B. First outer component 434B is substantially similar to first outer component 334B.

Second connector 436 comprises a primary male connector 437 comprising a second outer component 436B having a tongue 436D. Second outer component 436B is substantially similar to second outer component 336B.

Given the similarity of panels 412 and panels 312, it should be evident to a person of skill in the art that panels 412 may be attached to one another in a similar method as described herein in relation to panels 312 (or 12, 112, 212 etc.) except that there are no secondary male and female connectors to engage.

Figure 19:
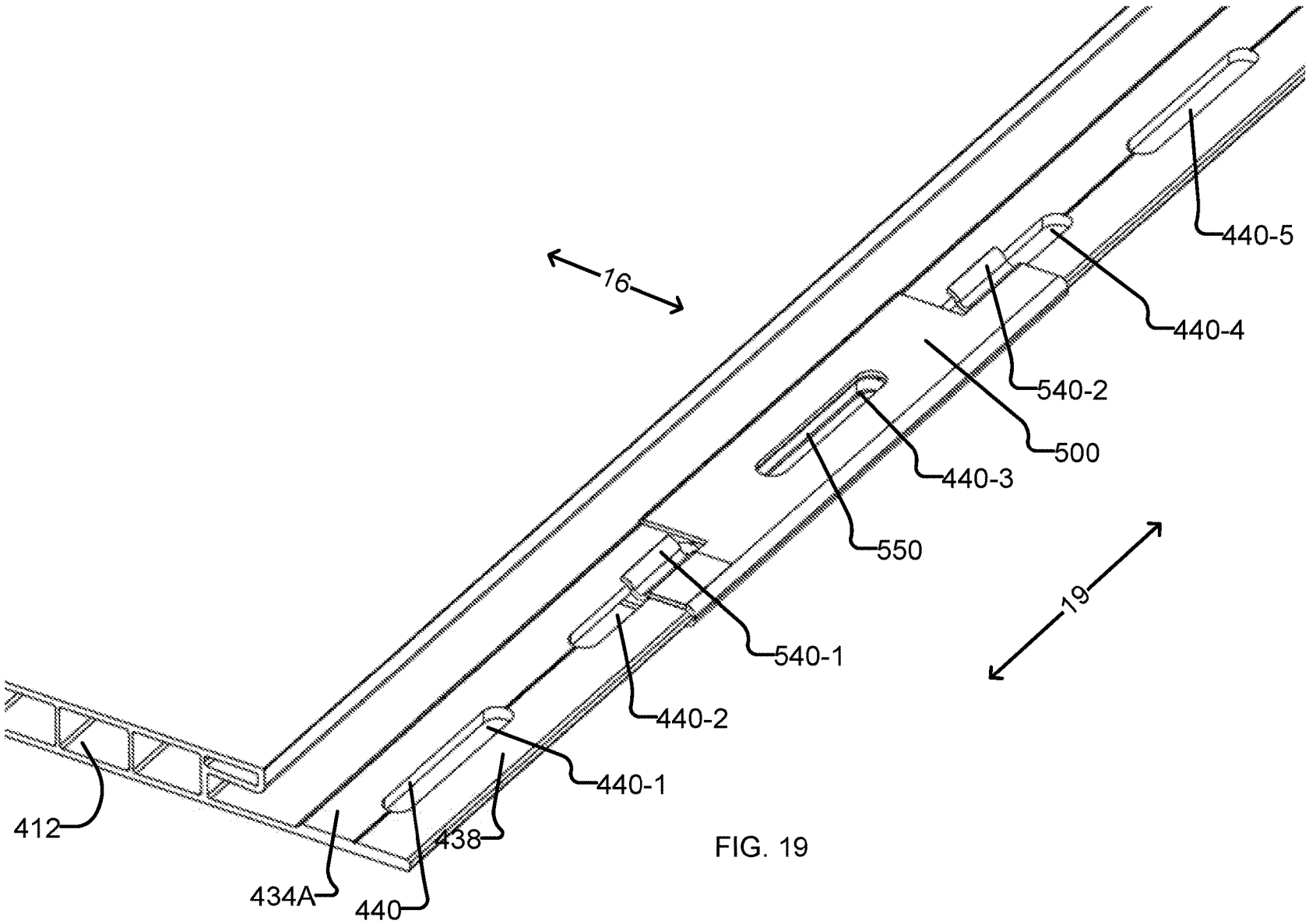
FIG. 19 is an elevated perspective view of a mounting tab reinforcer installed on a panel of a structure lining apparatus according to one embodiment of the invention.

In some embodiments, first inner components 434 comprise mounting tabs 438 (e.g. similar to mounting tabs 38) which define apertures 440 for receiving fasteners (such as fasteners, 50, 250, 350 etc.). Apertures 440 may be circular or elongated in shape, such as depicted in FIG. 19. Apertures 440 may be spaced apart along a longitudinal dimension of panel 412 (or panel 12, 112, 212, etc.). For example, FIG. 19 depicts mounting tab 438 comprising a plurality of apertures 440 (e.g. apertures 440-1, 440-2, 440-3, 440-4, 440-5) spaced apart along longitudinal dimension 19 of mounting tab 438.

Figure 14A:
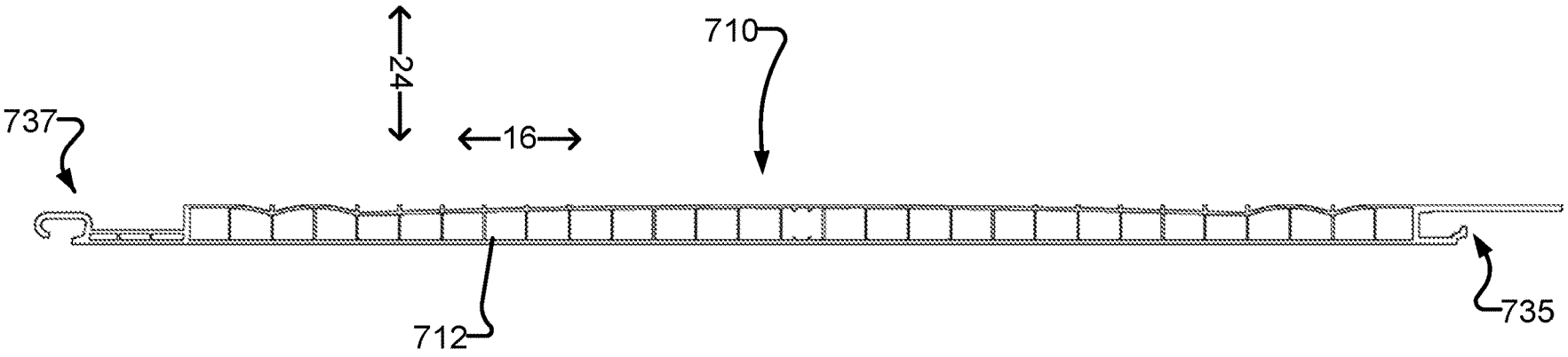
FIG. 14A is a cross-sectional plan view of a panel of a structure lining apparatus according to another embodiment of the invention.

FIG. 14A depicts a structure lining apparatus according to another particular non-limiting embodiment of the invention. Structure lining apparatus 710 comprises a plurality of generally planar panels 712 which extend in a longitudinal dimension (into and out of the page) and in a transverse dimension (shown by double-headed arrow 16). Structure lining apparatus 710 is substantially similar to structure lining apparatus 10, 210, 310 (e.g. may comprise similar materials and be installed in similar ways, etc.) except that panels 712 comprise different connectors 734, 736, as will be discussed in detail below.

Figure 14B:
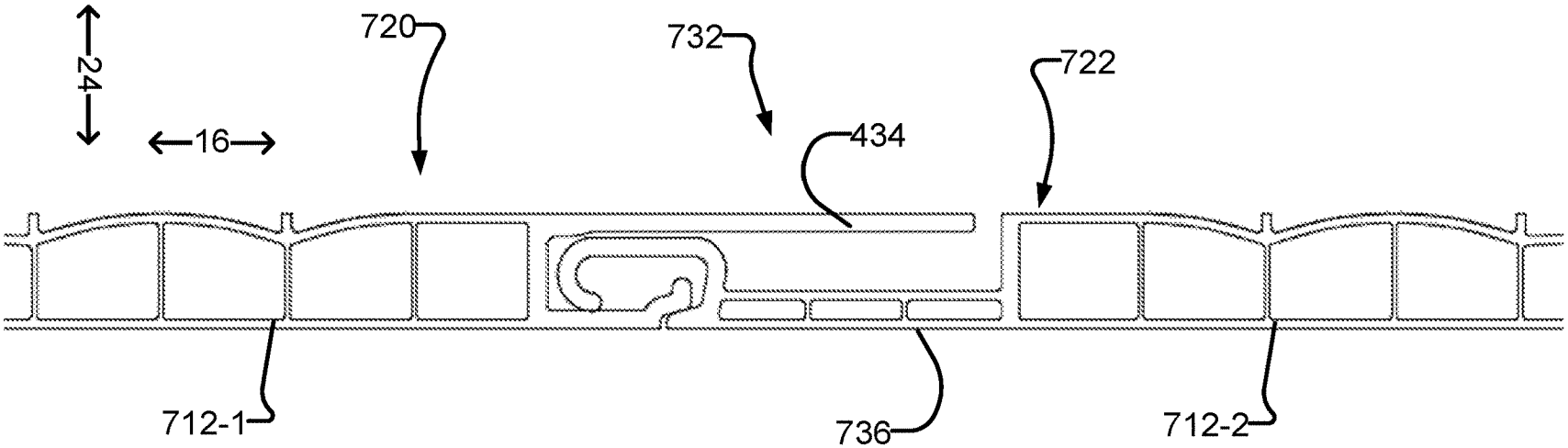
FIG. 14B is a cross-sectional profile view of the formation of a connection of two panels of the structure cladding apparatus of the FIG. 10 embodiment.

FIG. 14B shows detail of an edge-to-edge connection 732 of transversely adjacent panels 712-1, 712-2 of wall-lining apparatus 710. In particular, FIG. 14B depicts a transverse cross-section (i.e. a cross section in a plane defined by the transverse and inward-outward directions) of edge-to-edge connection 732. In the illustrated embodiment, longitudinally extending edge 720 of a first panel 712-1 comprises a first connector 734 and opposing longitudinally extending edge 722 of a transversely adjacent second panel 712-2 comprises a complementary second connector 736.

First connector component 734 may comprise a primary female connector 735 while second connector 736 may comprise a primary male connector 737. Connection 732 is formed when the primary male connector engages the primary female connector. Primary female connector 735 may be substantially similar to primarily female connector 35A and primary male connector 737 may be substantially similar to primary male connector 37A, although this is not mandatory.

Given the similarity of panels 712 and panels 12, it should be evident to a person of skill in the art that panels 712 may be attached to one another in a similar method as described herein in relation to panels 12 (or 112, 212, 312 etc.) except that there are no secondary male and female connectors to engage.

Figure 15A:
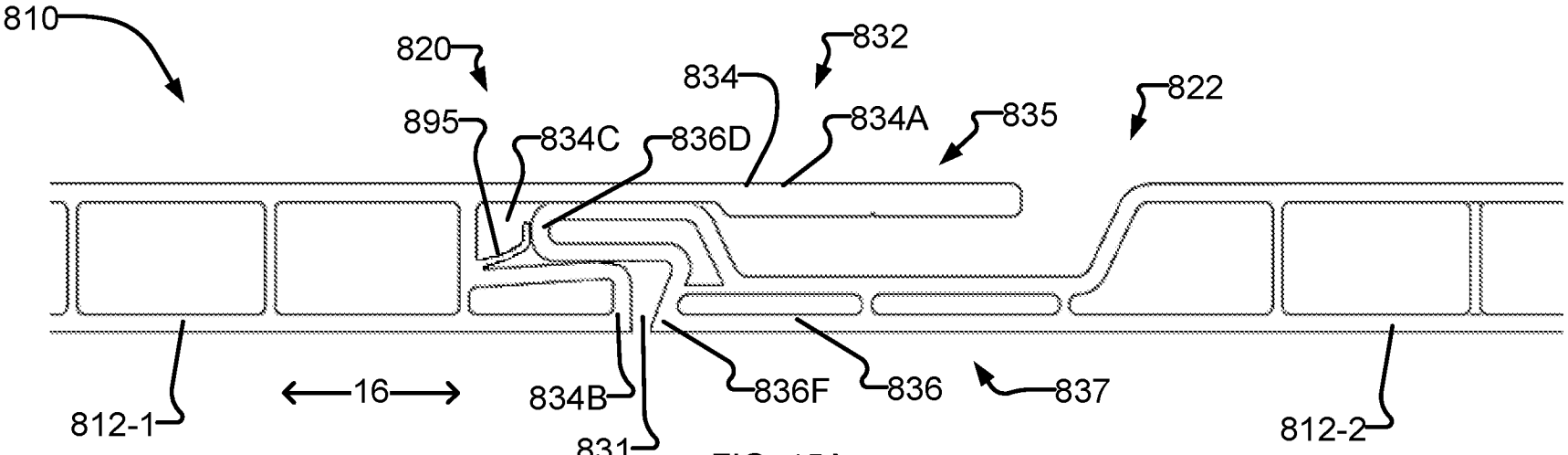
FIGS. 15A and 15B are cross-sectional profile views of a connection of two panels of a structure lining apparatus according to another embodiment of the invention.

FIG. 15A depicts a structure lining apparatus according to another particular non-limiting embodiment of the invention. Structure lining apparatus 810 comprises a plurality of generally planar panels 812 which extend in a longitudinal dimension (into and out of the page) and in a transverse dimension (shown by double-headed arrow 16). Structure lining apparatus 810 is substantially similar to structure lining apparatus 410 (e.g. may comprise similar materials and be installed in similar ways, etc.) except that panels 812 comprise a locator 895.

Figure 15B:
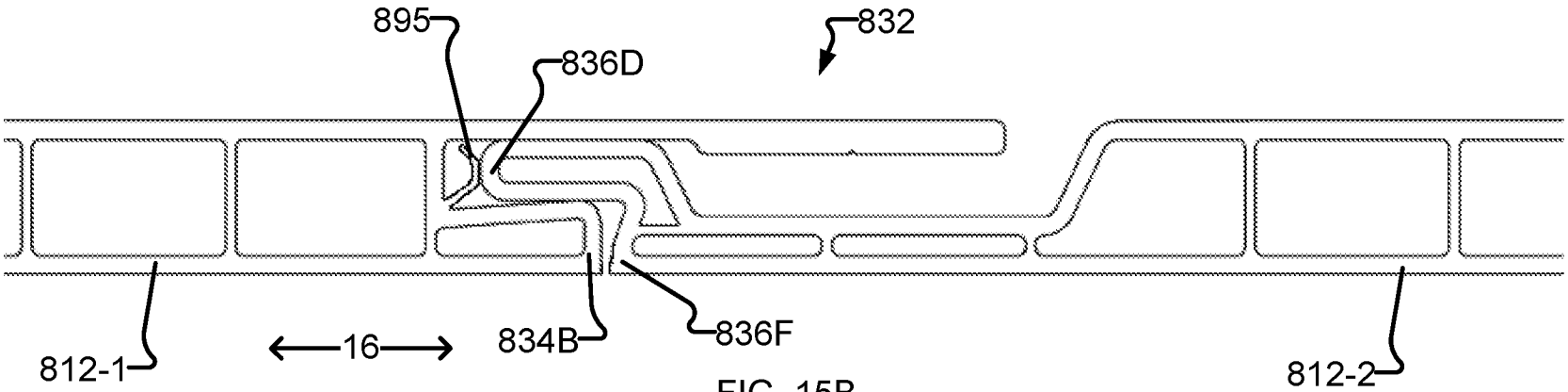

FIGS. 15A and 15B show details of an edge-to-edge connection 832 of transversely adjacent panels 812-1, 812-2 of wall-lining apparatus 810. In particular, FIGS. 15A 15B depict a transverse cross-section (i.e. a cross section in a plane defined by the transverse and inward-outward directions) of edge-to-edge connection 832. In the illustrated embodiment, longitudinally extending edge 820 of a first panel 812-1 comprises a first connector 834 and opposing longitudinally extending edge 822 of a transversely adjacent second panel 812-2 comprises a complementary second connector 836.

First connector component 834 may comprise a primary female connector 835 while second connector 836 may comprise a primary male connector 837. Connection 832 is formed when the primary male connector engages the primary female connector.

First connector 834 comprises a primary female connector 837 defined by a first inner component 834A and a first outer component 834B. A recess 834C is defined between first inner component 834A and first outer component 834B. Locator 895 protrudes into recess 834C. While locator 895 is depicted as protruding (relatively upwards as shown in FIG. 15A) from a base of first outer component 834B (or near the base), this is not mandatory and, for example, locator 895 could protrude from a base (or near the base) of first inner component 834A (relatively downwards, as would be shown in FIG. 15A). Similarly, locator 895 could protrude from tongue 836D to contact first connector 834 when connection 832 is formed. Referring back to FIG. 11C, a locator 895 could be provided to extend from either of connector 334 or 336 into any or all of gaps 331-1, 331-2, 331-3 and 331-4 to contact connector 336 or 334 respectively when connection 332 is formed and it should be understood that locator 895 could be present in similar locations in any of the embodiments disclosed herein. Locator 895 may be more flexible or deformable than other portions of panel 812. This flexibility may be a result of, for example, a reduced thickness as compared to other portions of panel 812 and/or locator 895 being made of a more flexible material as compared to other portions of panel 812 or otherwise. Locator 895 may be curved or bent to facilitate deformation of locator 895 and for improved contact with second connector 836 as connection 832 is formed, as described below. Although not depicted, in some embodiments locator 895 may comprise a bubble co-extruded with panel 812.

Second connector 836 comprises a primary male connector 837 comprising a second outer component 836B having a tongue 836D. Second outer component 836B is substantially similar to second outer component 436B.

Given the similarity of panels 812 and panels 412, it should be evident to a person of skill in the art that panels 812 may be attached to one another in a similar method as described herein in relation to panels 412 (or 12, 112, 212 etc.) except that locator 895 is present. Locator 895 may be shaped to contact tongue 836D as tongue 836D is extended into recess 834C. Locator 895 may serve to guide an installer as to how far tongue 836D should extend into recess 834C. For example, as an installer forces tongue 836D into recess 834C, locator 895 may provide resistance as locator 895 contacts tongue 836D and begins to deform. This may signal to the installer that tongue 836D is sufficiently extended into recess 834C. Locator 895 may be shaped to contact tongue 836D when the spacing 831 between edge 836F of second connector 836 and first outer component 834B is as desired. In this way, locator 895 may serve to maintain a sufficient gap 831 between edge 836F of second connector 836 and first outer component 834B to allow for movement and or expansion of panels 812. Despite the contact of locator 895 with tongue 836D and possible deformation of locator 895 during formation of connection 832, panels 812 may still be able to move relatively closer together due to movement of panels 812 or expansion through deformation of locator 895. For example, by comparing FIG. 15A to FIG. 15B, it can be seen that although connection 832 is formed in FIG. 15A, panels 812 are still allowed to move relatively closer toward one another in direction 16 as shown in FIG. 15B by additional deformation of locator 895. Recess 834C provides space for deformation of locator 895. In some embodiments, locator 895 only has sufficient space to deform as much as is necessary to allow edge 836F to contact first outer component 834B. In some embodiments, locator 895 restoratively deforms (e.g. may return to, or close to, its undeformed shape) as panels 812 move relatively further apart, although this is not necessary.

In some embodiments, contact of locator 895 with connector 836 (or connector 834 as the case may be) may create an air-tight and/or liquid-tight seal. Such seal may increase the thermal resistivity of connection 832 and/or may allow panels 812 to be employed in a wider variety of environments.

Although panels 12, 112, 212, etc. are not depicted as comprising a locator 895 or similar, it should be understood by one of skill in the art that any of panels 12, 112, 212, etc. or any other panel described or depicted herein could comprise a locator 895.

Figure 16A:
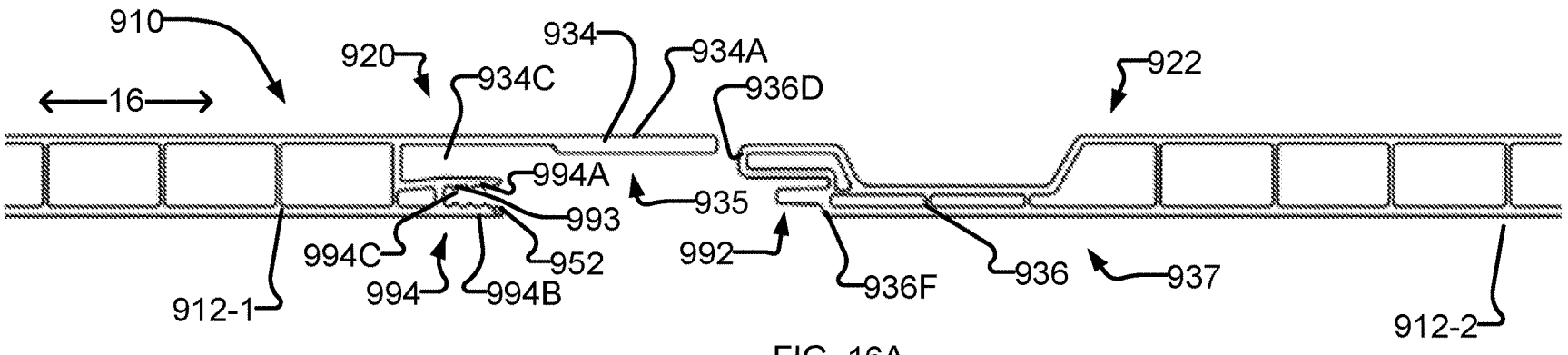
FIGS. 16A to 16C are cross-sectional profile views of a connection of two panels of a structure lining apparatus according to another embodiment of the invention.

FIG. 16A depicts a structure lining apparatus according to another particular non-limiting embodiment of the invention. Structure lining apparatus 910 comprises a plurality of generally planar panels 912 which extend in a longitudinal dimension (into and out of the page) and in a transverse dimension (shown by double-headed arrow 16). Structure lining apparatus 910 is substantially similar to structure lining apparatus 410 (e.g. may comprise similar materials and be installed in similar ways, etc.) except that panels 912 comprise a tertiary male connector 992 and a tertiary female connector 994.

Figure 16B:
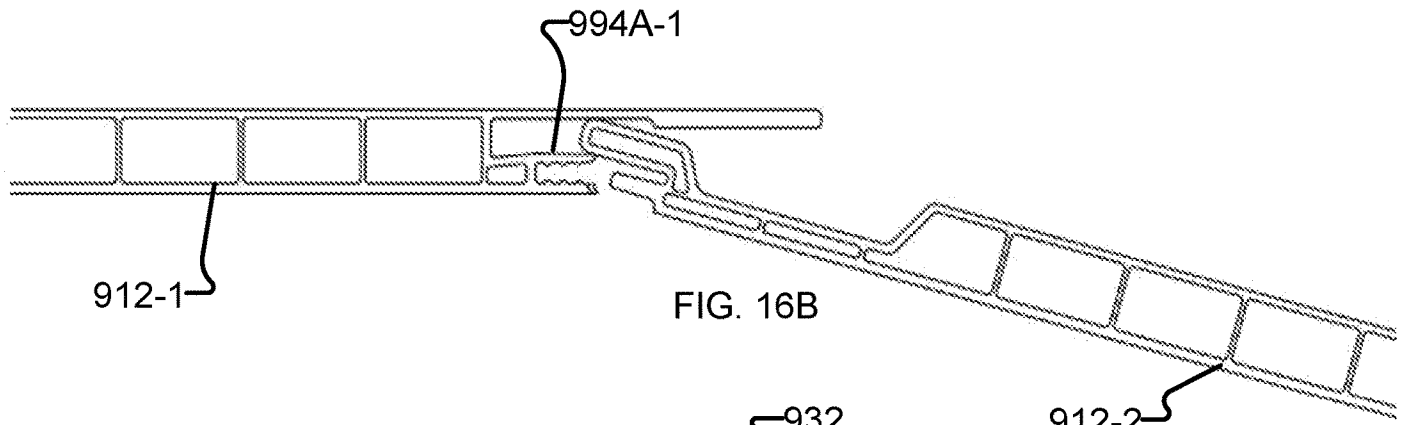
Figure 16C:
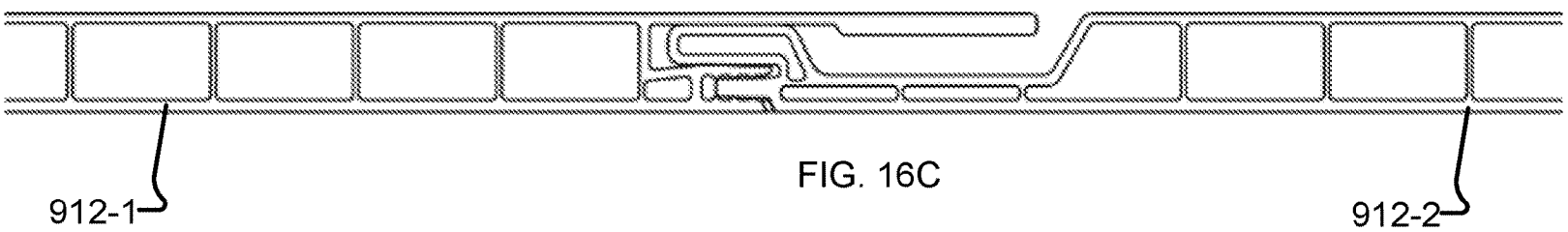

FIGS. 16A to 16C show details of an edge-to-edge connection 932 of transversely adjacent panels 912-1, 912-2 of wall-lining apparatus 910. In particular, FIGS. 16A to 16C depict transverse cross-sections (i.e. a cross section in a plane defined by the transverse and inward-outward directions) of edge-to-edge connection 932 being formed. In the illustrated embodiment, longitudinally extending edge 920 of a first panel 912-1 comprises a first connector 934 and opposing longitudinally extending edge 922 of a transversely adjacent second panel 912-2 comprises a complementary second connector 936.

First connector component 934 may comprise a primary female connector 935 and a tertiary female connector 994 while second connector 936 may comprise a primary male connector 937 and tertiary male connector 992. Connection 932 is formed when primary male connector 937 engages primary female connector 935 and tertiary male connector 992 engages tertiary female connector 994.

First connector 934 comprises a primary female connector 935 defined by a first inner component 934A and a first outer component 934B. A recess 934C is defined between first inner component 934A and first outer component 934B. First connector 934 comprises a tertiary female connector 994 defined by a first inner component 994A and a first outer component 994B. A recess 994C is defined between first inner component 994A and first outer component 994B. Serrations or teeth 993 may protrude from one or more of first inner component 994A and first outer component 994B into recess 994C. Serrations or teeth 993 may reduce friction between tertiary male connector 992 and tertiary female connector 994. Serrations or teeth 993 are not mandatory.

Second connector 936 comprises a primary male connector 937 comprising a second outer component 936B having a tongue 936D. Second outer component 936B is substantially similar to second outer component 436B. Second connector 936 also comprises a tertiary male connector 992. Although not depicted, tertiary male connector 992 may comprise serrations or teeth protruding therefrom to engage tertiary female connector 994 and/or serrations or teeth 993 of tertiary female connector 994.

In some embodiments, an inward surface 994A-1 of first inner component 994A is beveled so as to increase the opening of recess 934C and facilitate insertion of tongue 936D into recess 934C. This is not mandatory. Although such a bevel not be depicted in other embodiments described herein (e.g. panels 312, 412, 812, etc.), it should be understood that such panels could be modified to include such a beveled surface.

In some embodiments, a seal 952 is provided on at least a portion of one or both of tertiary male connector 992 and tertiary female connector 994 to prevent ingress of fluid between tertiary male connector 992 and tertiary female connector 994. Seal 952 may be substantially similar to seals 52, 252 described herein. In the FIG. 16A embodiment, seal 952 is located on a distal end of outer component 994B to contact an edge 936F of second connector 936 when connection 932 is formed.

Given the similarity of panels 912 and panels 412, it should be evident to a person of skill in the art that panels 912 may be attached to one another in a similar method as described herein in relation to panels 412 (or 12, 112, 212 etc.) except that tertiary male connector 932 is extended into tertiary female connector 934 as the connection is made. Serrations or teeth 993 may serve to decrease friction between tertiary male connector 992 and tertiary female connector 994 to facilitate insertion of tertiary male connector 992 into tertiary female connector 994.

Although panels 212, 312, 412, 812, etc. are not depicted as comprising tertiary male and female connectors 992, 994 or similar, it should be understood by one of skill in the art that any of panels 212, 312, 412, 812, etc. or any other panel described or depicted herein could comprise tertiary male and female connectors 992, 994.

Figure 17A:
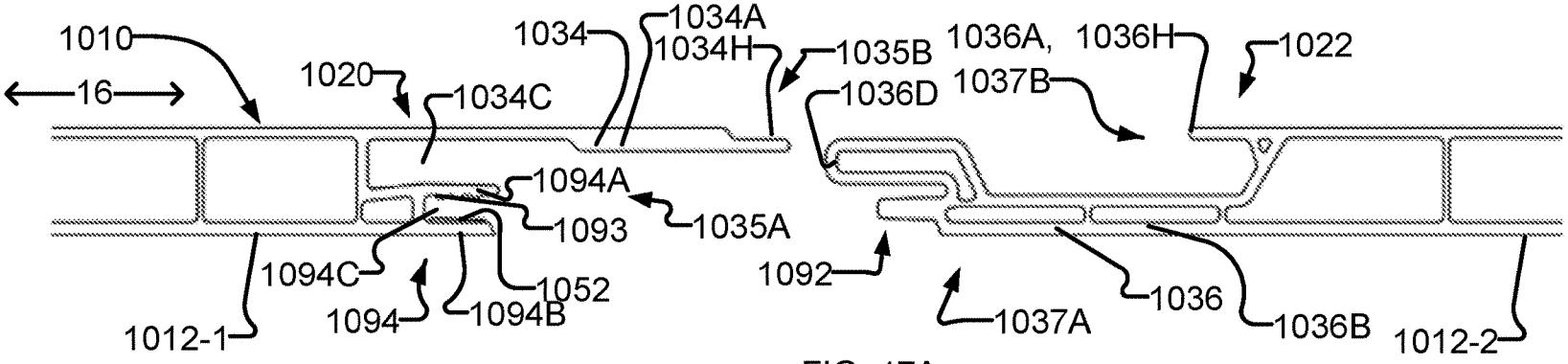
FIGS. 17A to 17C are cross-sectional profile views of a connection of two panels of a structure lining apparatus according to another embodiment of the invention.

FIG. 17A depicts a structure lining apparatus according to another particular non-limiting embodiment of the invention. Structure lining apparatus 1010 comprises a plurality of generally planar panels 1012 which extend in a longitudinal dimension (into and out of the page) and in a transverse dimension (shown by double-headed arrow 16). Structure lining apparatus 1010 is substantially similar to structure lining apparatus 310 (e.g. may comprise similar materials and be installed in similar ways, etc.) except that panels 1012 comprise a tertiary male connector 1092 and a tertiary female connector 1094.

Figure 17B:
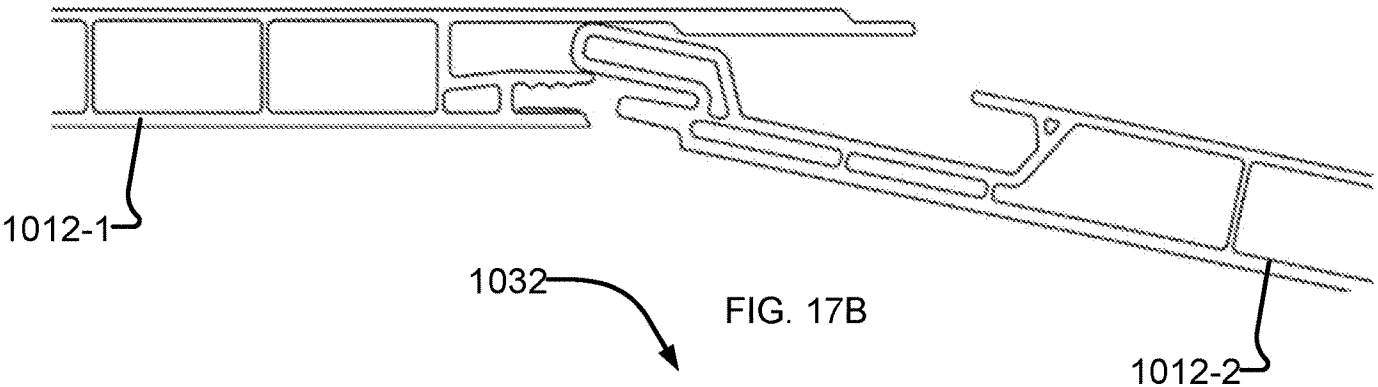
Figure 17C:
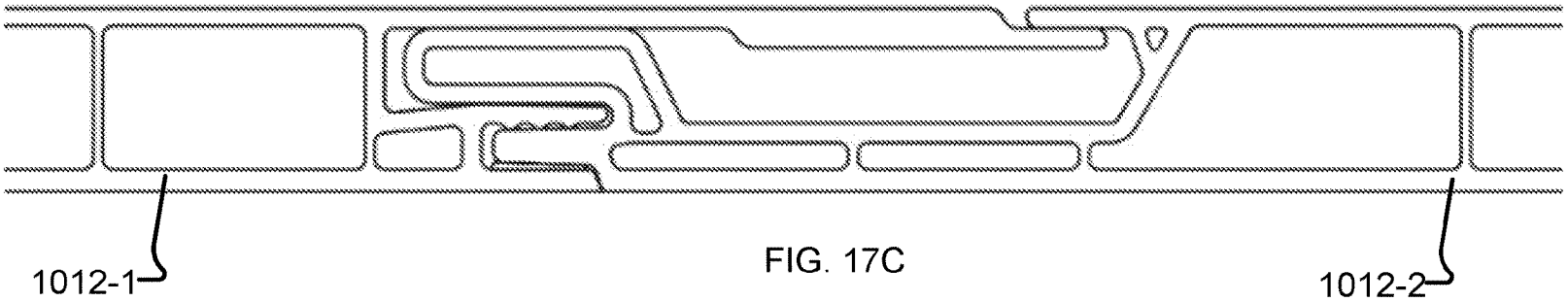

FIGS. 17A to 17C show details of an edge-to-edge connection 1032 of transversely adjacent panels 1012-1, 1012-2 of wall-lining apparatus 1010. In particular, FIGS. 17A to 17C depict transverse cross-sections (i.e. a cross section in a plane defined by the transverse and inward-outward directions) of edge-to-edge connection 1032 being formed. In the illustrated embodiment, longitudinally extending edge 1020 of a first panel 1012-1 comprises a first connector 1034 and opposing longitudinally extending edge 1022 of a transversely adjacent second panel 1012-2 comprises a complementary second connector 1036.

First connector component 1034 may comprise a primary female connector 1035A, a secondary male connector 10356 and a tertiary female connector 1094 while second connector 1036 may comprise a primary male connector 1037A, a secondary female connector 1037B and a tertiary male connector 1092. Connection 1032 is formed when primary male connector 1037 engages primary female connector 1035, secondary male connector 10356 engages secondary female connector 10376 and tertiary male connector 1092 engages tertiary female connector 1094.

First connector 1034 comprises a primary female connector 1035A defined by a first inner component 1034A and a first outer component 10346. A recess 1034C is defined between first inner component 1034A and first outer component 1034B. First inner component comprises a tongue 1034H. First connector 1034 comprises a secondary male connector 1035B comprising a first tongue 1036H. First connector 1034 comprises a tertiary female connector 1094 defined by a first inner component 1094A and a first outer component 10946. A recess 1094C is defined between first inner component 1094A and first outer component 10946. Serrations or teeth 1093 may protrude from one or more of first inner component 1094A and first outer component 10946 into recess 1094C. Serrations or teeth 1093 are not mandatory.

Second connector 1036 comprises a primary male connector 1037A comprising a second outer component 10366 having a tongue 1036D and a secondary female connector 10376 defined by second inner component 1036A and second outer component 10366. Second outer component 10366 is substantially similar to second outer component 336B. Second inner component is substantially similar to second inner component 336A and comprises a tongue 1036H. Second connector 1036 comprises a secondary female connector 10376 defined by second inner component 1036A and second outer component 1036. Second connector 1036 also comprises a tertiary male connector 1092. Although not depicted, tertiary male connector 1092 may comprise serrations or teeth protruding therefrom to engage tertiary female connector 1094 and/or serrations or teeth 1093 of tertiary female connector 1094.

In some embodiments, a seal 1052 is provided on at least a portion of one or both of tertiary male connector 1092 and tertiary female connector 1094 to prevent ingress of fluid between tertiary male connector 1092 and tertiary female connector 1094. Seal 1052 may be substantially similar to seals 52, 252, 952 described herein. In the FIG. 17A embodiment, seal 1052 is protrudes into recess 1094C from outer component 1094B to contact tertiary male connector 1092 when connection 1032 is formed.

Given the similarity of panels 1012 and panels 312, it should be evident to a person of skill in the art that panels 1012 may be attached to one another in a similar method as described herein in relation to panels 312 (or 12, 112, 212 etc.) except that tertiary male connector 1032 is extended into tertiary female connector 1034 as the connection is made. Serrations or teeth 1093 may serve to decrease friction between tertiary male connector 1092 and tertiary female connector 1094 to facilitate inserting tertiary male connector 1092 into tertiary female connector 1094.

Although panels 212, 312, 412, 812, etc. are not depicted as comprising tertiary male and female connectors 1092, 1094 or similar, it should be understood by one of skill in the art that any of panels 212, 312, 412, 812, etc. or any other panel described or depicted herein could comprise tertiary male and female connectors 1092, 1094.

Figure 17D:
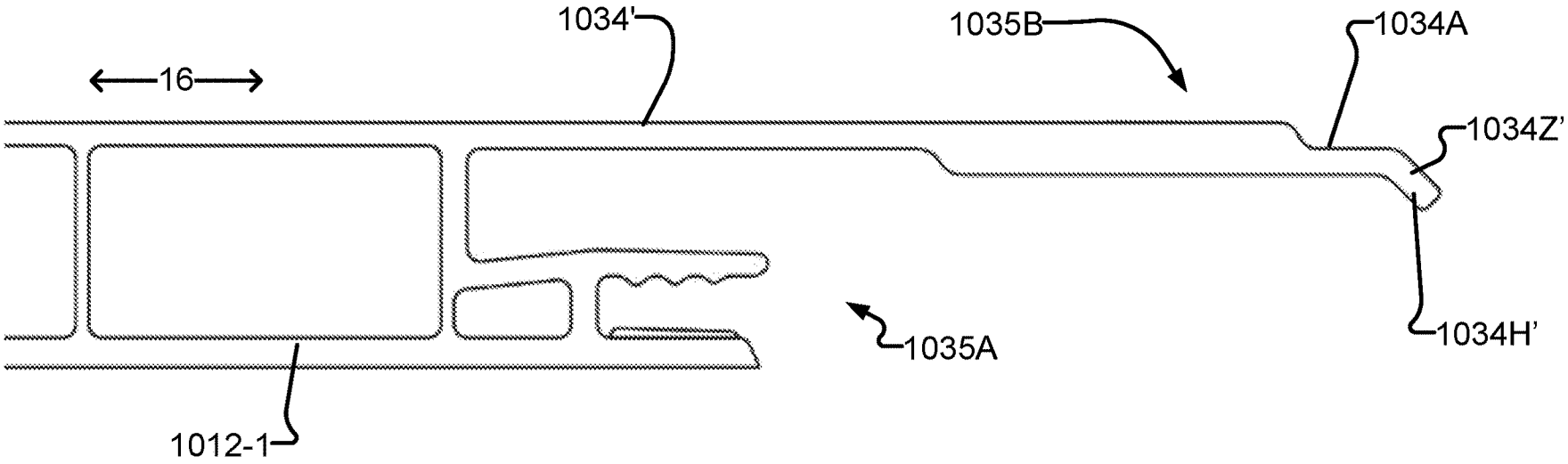
FIG. 17D is a cross-sectional profile view of a portion of a panel of a structure lining apparatus according to another embodiment of the invention.

FIG. 17D depicts a first connector component 1034' substantially similar to first connector component 1034 except in that tongue 1034H' comprises a beveled portion 1034Z' to facilitate engagement of tongue 1036H with tongue 1034H' by allowing tongue 1036H to slide along beveled portion 1034Z' of tongue 1034H' as edge-to-edge connection 1032 is formed. Although panels 312, 1012 etc. are not depicted as comprising a beveled portion 1034Z' or similar, it should be understood by one of skill in the art that any of panels 312, 1012, etc. or any other panel described or depicted herein could comprise a beveled portion 1034Z' or similar.

Figure 18A:
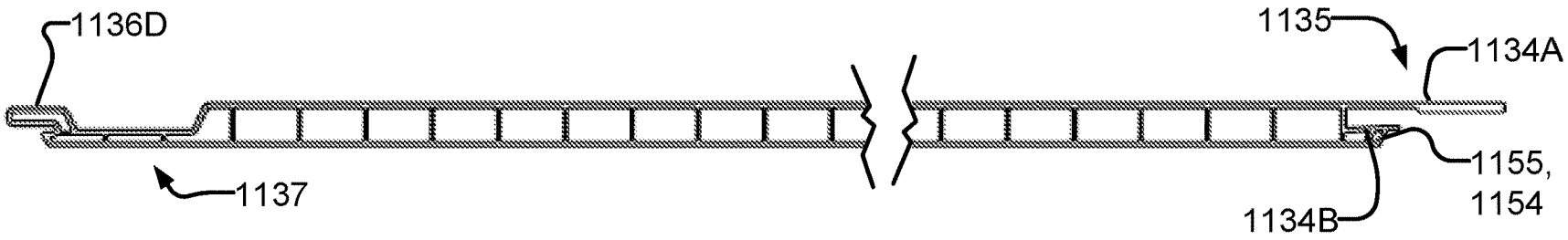
FIGS. 18A and 18B are cross-sectional profile views of a connection of two panels of a structure lining apparatus according to another embodiment of the invention.
Figure 18B:
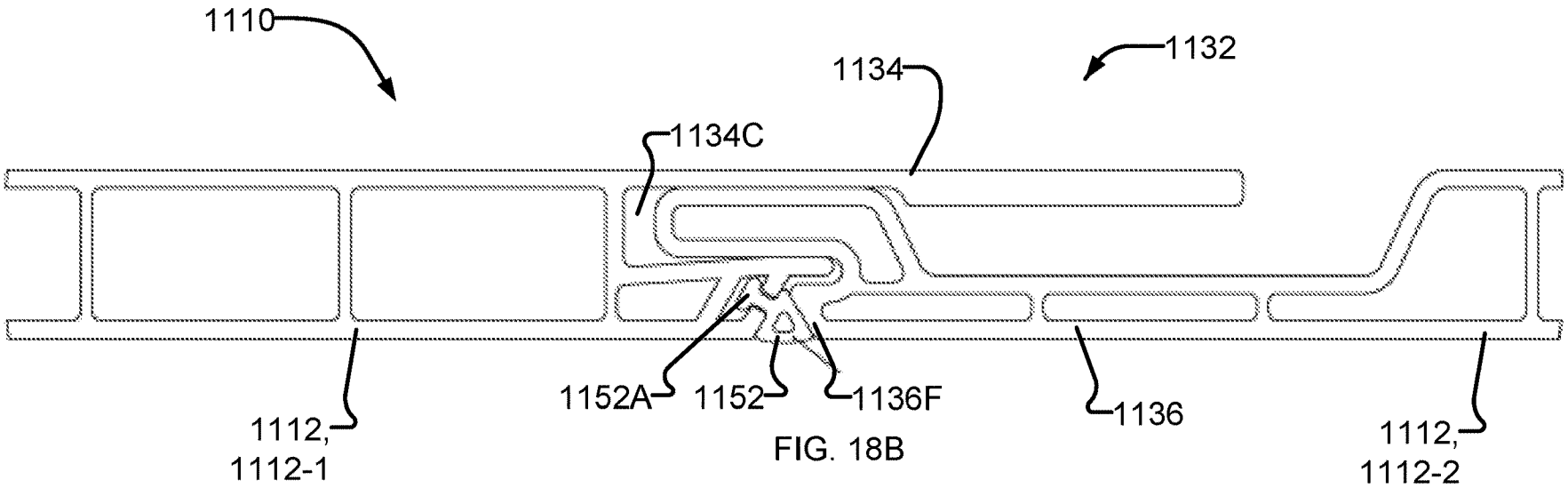

FIGS. 18A and 18B depict a structure lining apparatus according to another particular non-limiting embodiment of the invention. Structure lining apparatus 1110 comprises a plurality of generally planar panels 1112 which extend in a longitudinal dimension (into and out of the page) and in a transverse dimension (shown by double-headed arrow 16). Structure lining apparatus 1110 is substantially similar to structure lining apparatus 410 (e.g. may comprise similar materials and be installed in similar ways, etc.) except that panels 1112 comprise a seal 1152 and one or more seal retaining features 1154.

FIGS. 18A and 18B show details of an edge-to-edge connection 1132 of transversely adjacent panels 1112-1, 1112-2 of wall-lining apparatus 1110. In particular, FIG. 18B depicts a transverse cross-section (i.e. a cross section in a plane defined by the transverse and inward-outward directions) of edge-to-edge connection 1132. In the illustrated embodiment, longitudinally extending edge 1120 of a first panel 1112-1 comprises a first connector 1134 and opposing longitudinally extending edge 1122 of a transversely adjacent second panel 1112-2 comprises a complementary second connector 1136.

First connector component 1134 may comprise a primary female connector 1135 while second connector 1136 may comprise a primary male connector 1137. Connection 1132 is formed when primary male connector 1137 engages primary female connector 1135.

First connector 1134 comprises a primary female connector 1135 defined by a first inner component 1134A and a first outer component 11346. A recess 1134C is defined between first inner component 1134A and first outer component 11346.

First outer component may comprise one or more seal retaining features 1154. In some embodiments, first outer component 11346 defines a channel 1155 for receiving a first retainer portion 1152A of a seal 1152. Seal 1152 (like other seals discussed herein) may serve to prevent or reduce ingress of unwanted fluid, dirt and/or debris into connection 1132. Seal 1152 may be substantially similar to any seals discussed herein. Seal 1152 may be an elastic or viscoelastic (e.g. flexible) material. Engagement of first retainer portion 1152A and channel 1155 may serve to retain seal 1152 in a desired location. In the illustrated embodiment, channel 1155 is located such that seal 1152 is positioned between first outer component 1134B of first panel 1112-1 and edge 1136F of second panel 1112-2. This is not mandatory, channel 1155 may be located anywhere so as to position seal in connection 1132 in contact with adjacent portions of first connector component 1134 of first panel 1112-1 and second connector component 1132 of second panel 1112-2.

In some embodiments, first retainer portion 1152A has a "T" shaped cross-section that may be slid longitudinally into channel 1155. In other embodiments, first retainer portion 1152A has an arrowhead shaped cross-section or similar that may be pushed transversely into channel 1155. In other embodiments, first retainer portion 1152A may have other cross-sectional shapes. In some embodiments, first retainer portion 1152A is may be resiliently deformed during installation into channel 1155 and may exhibit restorative deformation after insertion into channel 1155 to hold first retainer portion 1152A in channel 1155.

Second connector 1136 comprises a primary male connector 1137 comprising a second outer component 1136B having a tongue 1136D. Second outer component 1136B is substantially similar to second outer component 436B.

Figure 18C:
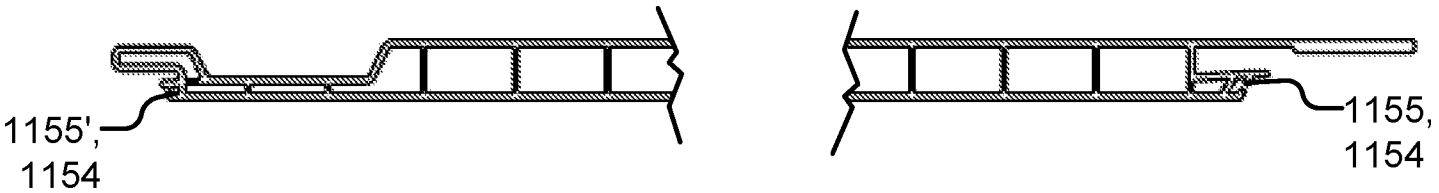
FIGS. 18C and 18D are cross-sectional profile views of a connection of two panels of a structure lining apparatus according to another embodiment of the invention.
Figure 18D:
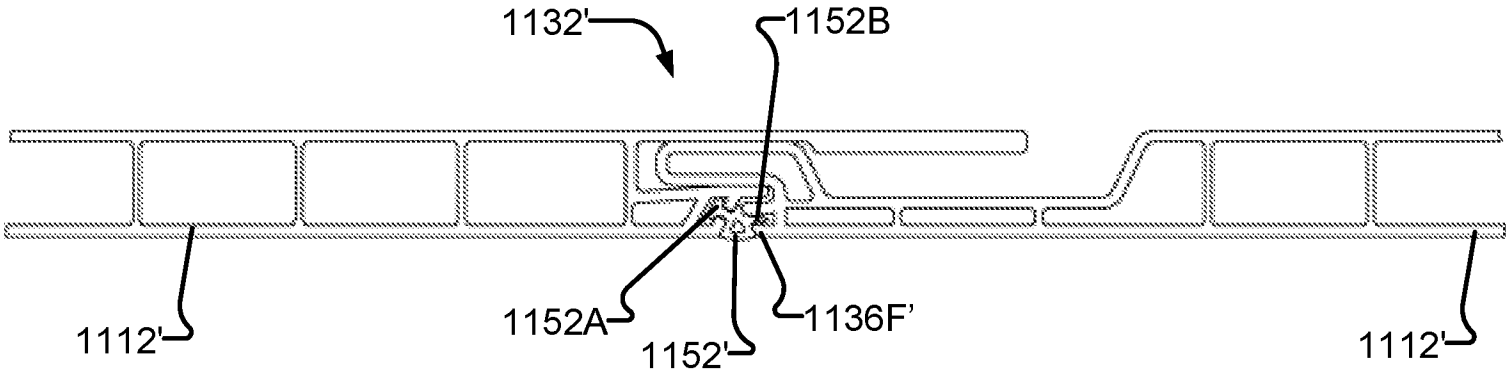

It should be understood that edge 1136F could also or alternatively have one or more seal retaining features (e.g. channels or the like) for receiving a retaining portion of seal 1152. For example, FIGS. 18C and 18D depict panels 1112' wherein edge 1136F' comprises a seal retaining feature 1154. Seal retaining feature 1154 of edge 1136F may comprise a channel 1155' for receiving a retainer portion 11528 of seal 1152'. To facilitate formation of connection 1132', retainer portion 11528 may be shaped to be inserted into channel 1155' in the transverse direction without substantial deformation. This is not mandatory. In some embodiments, seal 1152' may be resiliently deformed during insertion into channel 1155' and may exhibit restorative deformation to hold retainer portion 11528 in channel 1155'. In some embodiments, seal 1152' is installed after connection 1132' is formed by sliding seal 1152' in the longitudinal direction. Sliding seal 1152' in the longitudinal direction into place in connection 1132' may comprise sliding retainer portions 1152A, 1152B in the longitudinal direction in channels 1155, 1155' respectively.

Given the similarity of panels 1112, 1112' and panels 412, it should be evident to a person of skill in the art that panels 1112, 1112' may be attached to one another in a similar method as described herein in relation to panels 412 (or 12, 112, 212 etc.) except that seal 1152 is present.

Although panels 212, 312, 412, 812, etc. are not depicted as comprising a seal 1152, 1152' or similar, it should be understood by one of skill in the art that any of panels 212, 312, 412, 812, etc. or any other panel described or depicted herein could comprise a seal 1152, 1152' or similar.

Another aspect of the invention provides a mounting tab reinforcer for reinforcing a mounting tab of a panel. The mounting tab reinforcer may comprise one or more locator features for maintaining desired positioning of the mounting tab reinforcement relative to the mounting tab of a panel. In some embodiments, the mounting tab reinforcer wraps around at least a portion of the mounting tab. In other embodiments, the mounting tab reinforcer does not wrap around any portion of the mounting tab.

FIG. 19 depicts an exemplary mounting tab reinforcer 500 (sometimes referred to as reinforce 500) according to one non-limiting embodiment of the invention. Reinforcer 500 is depicted in FIG. 19 as being installed on mounting tab 438 of panel 412. This is not mandatory. Reinforcer 500 may be employed on any suitable panel such as those depicted and discussed herein or other panels not depicted or discussed herein.

Reinforcer 500 may comprise any suitable material, such as for example, a polymer material, a composite material, a metal material (e.g. spring steel) or some combination thereof. In some embodiments, reinforcer 500 comprises the same material as panel 412. In other embodiments, reinforcer 500 comprises a different material than panel 412. In some embodiments, reinforcer 500 comprises a material having a greater Young's modulus than that of panel 412, although this is not mandatory. Reinforcer 500 may be made using any suitable technique, such as, but not limited to pultrusion, injection molding, casting, etc.

Reinforcer 500 comprises a first body portion 510 and a second body portion 530 attached together by an edge 520 to define a space 515 between first and second body portions 510, 530. Edge 520 may have an inward-outward dimension that is similar to or greater than an inward-outward dimension of mounting tab 438 to prevent unwanted deformation of reinforcer 500 when installed on panel 412. Reinforcer 500 may be formed as a single piece or may comprise a plurality of pieces joined together by suitable means.

For example, first body portion 510 and second body portion 530 may be separate parts joined together by, for example, a separate edge 520 using a suitable bonding technique, welding or one or more fasteners.

Figure 20A:
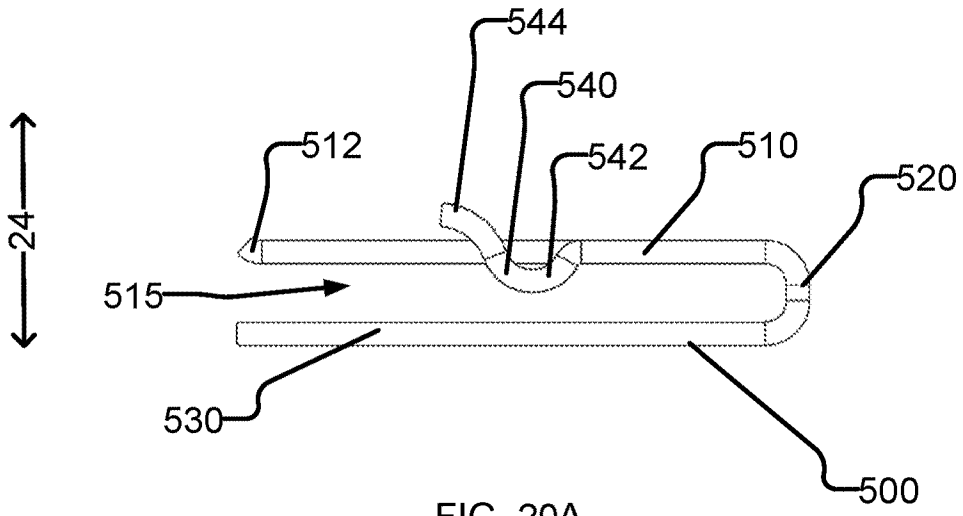
FIG. 20A is a side view of a mounting tab reinforcer according to the FIG. 19 embodiment.
Figure 20B:
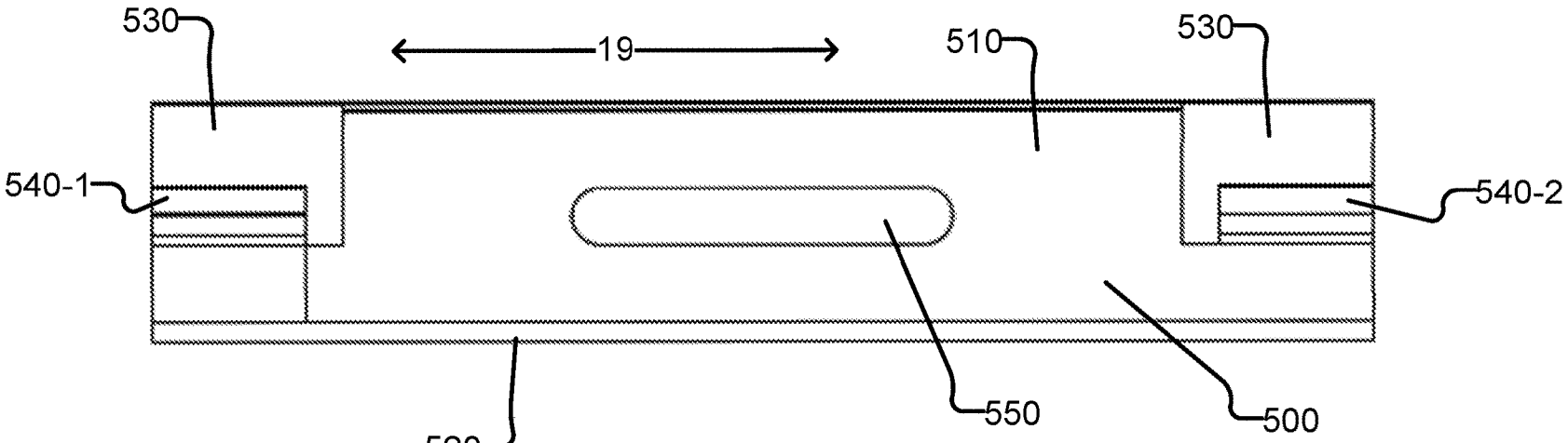
FIG. 20B is a top plan of a mounting tab reinforcer according to the FIG. 19 embodiment.

As can be seen from FIG. 20B, first and second body portions 510, 530 of reinforcer 500 define an aperture 550. Aperture 550 may be circular or may be elongated as depicted in FIG. 20B. When reinforcer 500 is installed on a panel (e.g. panel 412), it may be desired for aperture 550 to align with one or more apertures 440 such that a fastener 50, 250, 350 etc. may be secured through both aperture 440 and aperture 550. To aid in aligning, and maintaining alignment of aperture 440 of panel 412 (or another suitable panel) and aperture 550 of reinforcer 500, reinforcer 500 may comprise one or more locator features 540.

Locator features 540 may be employed to ensure desired positioning of reinforcer 500 relative to apertures 440 of panel 412 (or another suitable panel). Locator features 540 may comprise any suitable features. For example, in the FIG. 20A and FIG. 20B embodiment, locator features 540 each comprise an indented portion 542 that may protrude into an adjacent aperture 440 when installed. For example, as best seen from FIG. 19, where reinforcer 500 is installed on panel 412 and aperture 550 is aligned with aperture 440-3, aperture 550 is held in alignment with aperture 440-3 by a first locator 540-1 that protrudes into adjacent aperture 440-2 and a second locator 540-2 that protrudes into adjacent aperture 440-4. Locators 540 may be spaced apart such that reinforcer 500 may be allowed to move in longitudinal direction 19 relative to panel 412 (e.g. while still maintaining sufficient alignment of aperture 440 and aperture 550) when installed to allow for some flexibility in installation of fasteners and to allow for some movement due to thermal expansion of panels 412 of the like.

Reinforcer 500 may be installed on panel 412 (or another suitable panel) by sliding reinforcer 500 relative to panel 412 until locators 540 protrude into the desired apertures 440. In some embodiments, this comprises sliding reinforcer 500 in transverse direction 16 toward panel 412. To ease insertion of mounting tab into space 515, a distal end 512 of first body portion 510 may be beveled or up-turned. Similarly, to ease insertion of protrusions 542 into apertures 440, distal ends 544 of locators 540 may be beveled or up-turned.

Protrusions 542 may have a transverse width equal to or approximately equal to (e.g. plus or minus 10%) the transverse width of apertures 440 to reduce relative transverse movement between reinforcer 500 and panel 412

As protrusion 542 contacts panel 412, each locator 540 may be resiliently deformed in inward-outward direction 24 such that panel 412 can pass deeper into space 515. Once protrusions 542 reach apertures 440, each locator 540 may partially or completely restoratively deform to its non-deformed shape and protrude into aperture 440 due to restorative deformation forces caused by the resilient deformation of locator 540. This resilient and restorative deformation may improve the connection between panel 412 and reinforcer 500 and may serve to securely hold reinforcer 500 in alignment with aperture 440. In other embodiments, reinforcer 500 may be slid onto mounting tab 438 in longitudinal direction 19.

Reinforcer 500 may serve to reinforce aperture 440 to prevent pull-through of fasteners (e.g. fasteners 50, 250 etc.) by spreading the forces associated with the fastener across a larger surface area of mounting tab 438. Reinforcer 500 may also serve to increase the longitudinal stiffness of panel 414, thereby allowing panels 412 to be employed across larger unsupported spans (e.g. spaces 40B). Reinforcer 500 may also be employed to improve any panels, including but not limited to pre-existing panels that have issues with pull-through and/or are not sufficiently stiff for a desired application.

Figure 21:
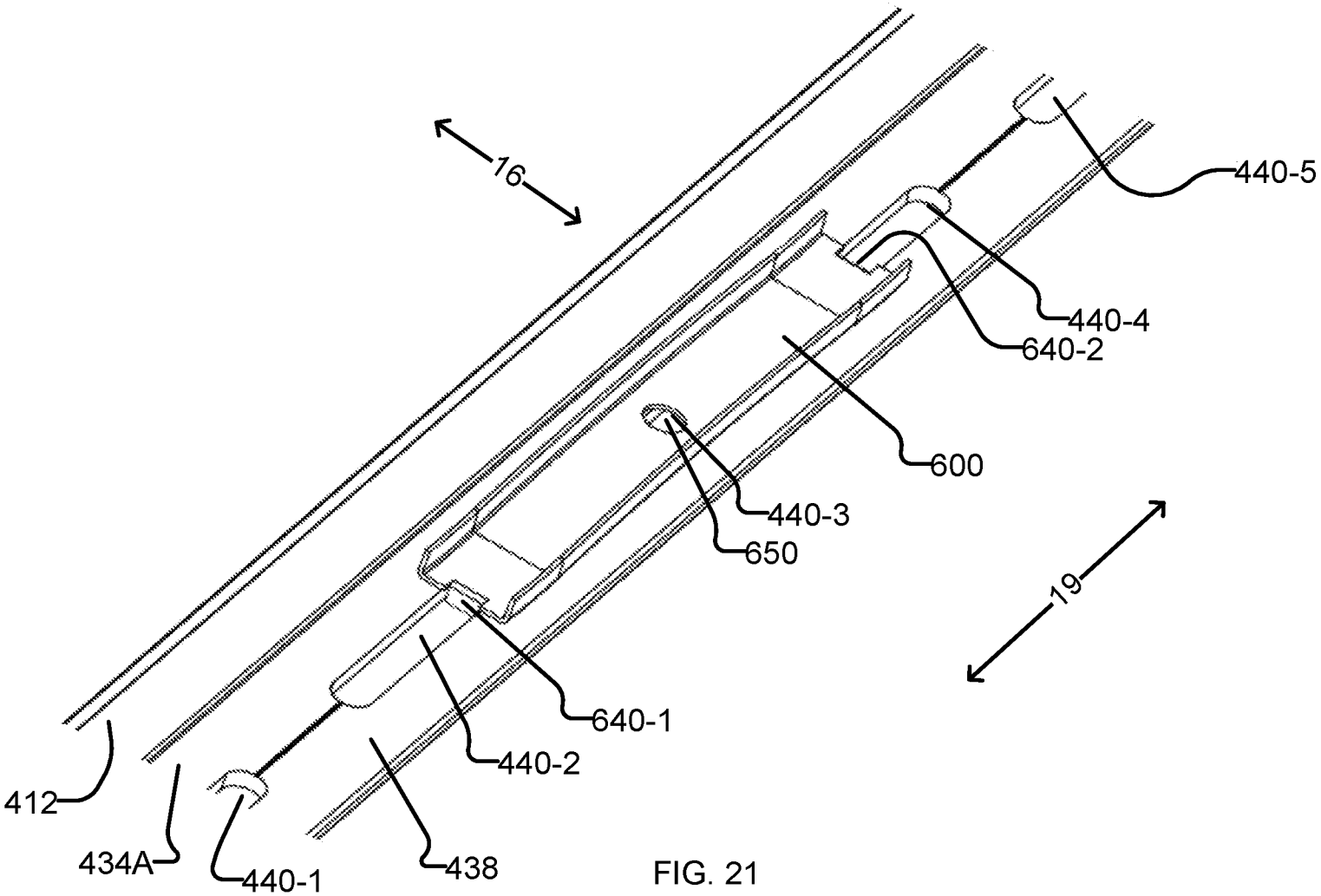
FIG. 21 is an elevated perspective view of another mounting tab reinforcer installed on a panel of a structure lining apparatus according to one embodiment of the invention.

FIG. 21 depicts another exemplary mounting tab reinforcer 600 (sometimes referred to as reinforce 600) according to one non-limiting embodiment of the invention. Reinforcer 600 is depicted in FIG. 21 as being installed on mounting tab 438 of panel 412. This is not mandatory. Reinforcer 600 may be employed on any suitable panel such as those depicted and discussed herein or other panels not depicted or discussed herein.

Reinforcer 600 may comprise any suitable material, such as for example, a polymer material, a composite material, a metal material (e.g. spring steel) or some combination thereof. In some embodiments, reinforcer 600 comprises the same material as panel 412. In other embodiments, reinforcer 600 comprises a different material than panel 412. In some embodiments, reinforcer 600 comprises a material having a greater Young's modulus than that of panel 412, although this is not mandatory. Reinforcer 600 may be made using any suitable technique, such as, but not limited to pultrusion, injection molding, casting, etc.

Reinforcer 600 comprises a body portion 610 that is generally elongated in longitudinal direction 19. First and second flanges 620-1, 620-2 may protrude in inward-outward direction 24 from longitudinally extending edges of body portion 610 to increase the longitudinal stiffness of reinforcer 600. Body portion 610 may be arcuate across its longitudinal dimension such that a top surface 610A of body portion 610 is convex. The arcuate shape of body portion 610 may reduce the likelihood of overtightening a fastener 50 (250, 350, etc.) installed in aperture 650 due to the restorative deformation forces associated with the resilient deformation of body 610 as it is flattened out from tightening of fastener 50.

Figure 22:
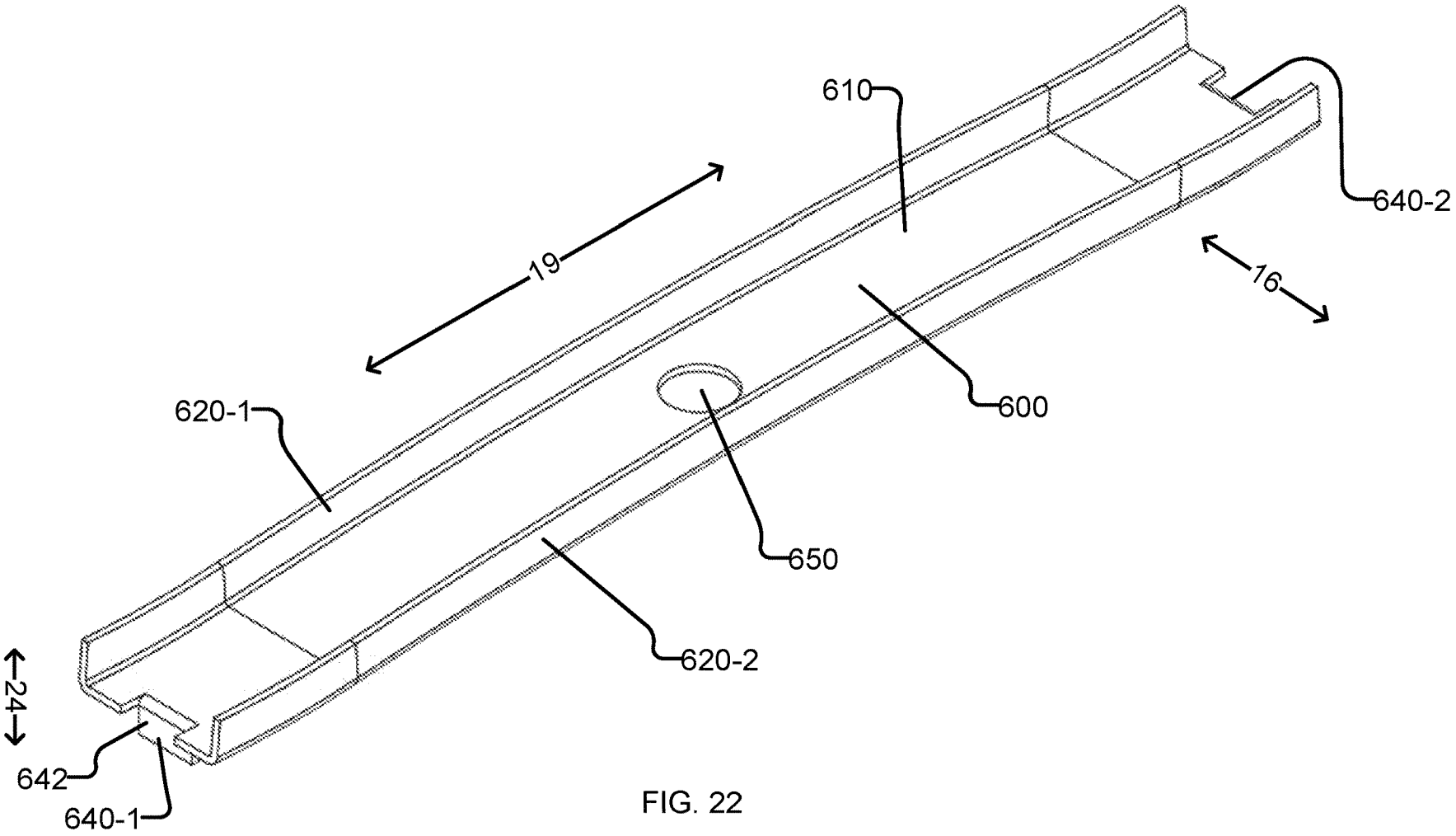
FIG. 22 is an elevated perspective view of a mounting tab reinforcer according to the FIG. 21 embodiment.

As can be seen from FIG. 22, body portion 610 of reinforcer 600 defines an aperture 650. Aperture 650 may be elongated or may be circular as depicted in FIG. 22. When reinforcer 600 is installed on a panel (e.g. panel 412), it may be desired for aperture 650 to align with one or more apertures 440 such that a fastener 50, 250, 350 etc. may be secured through both aperture 440 and aperture 650. To aid in aligning, and maintaining alignment of, aperture 440 of panel 412 (or another suitable panel) and aperture 650 of reinforcer 600, reinforcer 600 may comprise one or more locator features 640.

Locator features 640 may be employed to ensure desired positioning of reinforcer 600 relative to apertures 440 of panel 412 (or another suitable panel). Locator features 640 may comprise any suitable features. For example, in the FIG. 21 and FIG. 22 embodiment, locator features 640 (e.g. locator features 640-1, 640-2) each comprise protrusions 642 that extend in inward-outward direction 34 from longitudinal ends of body portion 610. Protrusions 642 may have a transverse width equal to or approximately equal to (e.g. plus or minus 10%) the transverse width of apertures 440 to reduce relative transverse movement between reinforcer 600 and panel 412.

Each protrusion 642 may protrude into an adjacent aperture 440 when installed. For example, as best seen from FIG. 21, where reinforcer 600 is installed on panel 412 and aperture 650 is aligned with aperture 640-3, aperture 650 is held in alignment with aperture 440-3 by a first locator 640-1 that protrudes into adjacent aperture 440-2 and a second locator 640-2 that protrudes into adjacent aperture 440-4. Locators 640 may be spaced apart such that reinforcer 600 may be allowed to move in longitudinal direction 19 relative to panel 412 (e.g. while still maintaining sufficient alignment of aperture 440 and aperture 650) when installed to allow for some flexibility in installation of fasteners and to allow for some movement due to thermal expansion of the like.

Reinforcer 600 may serve to reinforce aperture 440 to prevent overtightening of fasteners (e.g. fasteners 50, 250 etc.) and pull-through of fasteners (e.g. fasteners 50, 250 etc.) by spreading the forces associated with the fastener across a larger surface area of mounting tab 438. Reinforcer 600 may also serve to increase the longitudinal stiffness of panel 414, thereby allowing panels 412 to be employed across larger unsupported spans (e.g. spaces 40B). Reinforcer 600 may also be employed to improve any panels, including but not limited to pre-existing panels that have issues with pull-through and/or are not sufficiently stiff for a desired application.

Where a component is referred to above, unless otherwise indicated, reference to that component (including a reference to a "means") should be interpreted as including as equivalents of that component any component which performs the function of the described component (i.e. that is functionally equivalent), including components which are not structurally equivalent to the disclosed structure which performs the function in the illustrated exemplary embodiments of the invention.

Unless the context clearly requires otherwise, throughout the description and any accompanying claims (where present), the words "comprise," "comprising," and the like are to be construed in an inclusive sense, that is, in the sense of "including, but not limited to." As used herein, the terms "connected," "coupled," or any variant thereof, means any connection or coupling, either direct or indirect, between two or more elements; the coupling or connection between the elements can be physical, logical, or a combination thereof. Additionally, the words "herein," "above," "below," and words of similar import, shall refer to this document as a whole and not to any particular portions. Where the context permits, words using the singular or plural number may also include the plural or singular number respectively. The word "or," in reference to a list of two or more items, covers all of the following interpretations of the word: any of the items in the list, all of the items in the list, and any combination of the items in the list.

As will be apparent to those skilled in the art in the light of the foregoing disclosure, many alterations and modifications are possible in the practice of this invention without departing from the spirit or scope thereof. For example:

- Any of the connector components described herein can be used in conjunction with any of the panels spans (e.g. span 12C) described herein.
- In the embodiments describes herein, the outward facing surfaces of some panels (e.g. panels 12, 112) are substantially flat. In other embodiments, panels may be provided with corrugations in inward/outward direction 24. Such corrugations may extend longitudinally and/or transversely.
- In the embodiments described above, the various features of panels 12, 112 (e.g. connector components 34, 36, 134, 136, etc.) are substantially co-extensive with panels 12, 112 etc. in the longitudinal dimension. This is not necessary. In some embodiments, such features may be located at various locations on the longitudinal dimension of panels 12, 112 etc.
- In some embodiments, the panels described herein may be used to fabricate walls, ceilings or floors of buildings or similar structures. In general, the panels described above are not limited to building structures and may be used to line any suitable structures formed from wood, concrete or similar materials. Non-limiting examples of such structures include transportation structures (e.g. bridge supports and freeway supports), barns, hangars, factories, beams, foundations, sidewalks, pipes, tanks, beams and the like.
- Structures (e.g. ceilings) fabricated according to the invention may have curvature. Where it is desired to provide a structure with a certain radius of curvature, panels on the inside of the curve may be provided with a shorter length than corresponding panels on the outside of the curve. This length difference will accommodate for the differences in the radii of curvature between the inside and outside of the curve. It will be appreciated that this length difference will depend on the thickness of the structure.

In addition or in the alternative to the co-extruded coating materials and/or surface texturing described above, materials (e.g. sealants and the like) may be provided at various interfaces between the connector components described above to improve the impermeability of the resulting connections to liquids and/or gasses.

The description set out above makes use of a number of directional terms (e.g. inward-outward direction 24, transverse direction 16 and longitudinal direction 19). These directional terms are used for ease of explanation and for explaining relative directions. In some embodiments, the longitudinal direction 19 may be generally vertical and the transverse and inward-outward directions 16, 24 may be generally horizontal, but this is not necessary. Walls and other structures fabricated from the forms described herein need not be vertically and/or horizontally oriented like those described above. In some circumstances, components of the forms described herein may be assembled in orientations different from those in which they are ultimately used to accept concrete. However, for ease of explanation, directional terms are used in the description to describe the assembly of these form components. Accordingly, the directional terms used herein should not be understood in a literal sense but rather in a sense used to facilitate explanation and/or directions relative to one another.

Many embodiments and variations are described above. Those skilled in the art will appreciate that various aspects of any of the above-described embodiments may be incorporated into any of the other ones of the above-described embodiments by suitable modification.

The structure claddings in the illustrated embodiments are not necessarily to scale. In some embodiments, some panels may be larger than others.

While a number of exemplary aspects and embodiments have been discussed above, those of skill in the art will recognize certain modifications, permutations, additions and sub-combinations thereof. It is therefore intended that the following appended aspects and aspects hereafter introduced are interpreted to include all such modifications, permutations, additions and sub-combinations as are within their true spirit and scope.

The invention claimed is:

1. A structure-lining apparatus for providing a lining surface for a structure, the apparatus comprising:

a plurality of transversely and longitudinally extending panels connectable to a surface of the structure and connectable edge-to-edge via complementary connector components on their longitudinally extending edges to define at least a portion of a lining surface, each panel comprising transversely extending edges generally orthogonal to their longitudinally extending edges;

each panel comprising a first connector component on a first longitudinally extending edge thereof and a second connector component on a second longitudinally extending edge thereof, the second connector component complementary to the first connector component;

each first connector component comprising a mounting tab for connecting the first connector component to the surface of the structure;

at least one edge-to-edge connection between a first connector component of a first panel and a second connector component of a second panel, the at least one edge-to-edge connection comprising a primary male connector component of the second connector component of the second panel extended into a primary female connector component of the first connector component of the first panel and a secondary male connector component of the first connector component of the first panel extended into a secondary female connector component of the second connector component of the second panel; and wherein a transverse direction is generally parallel to the transversely extending edges of the first panel and a longitudinal direction is generally parallel to the longitudinally extending edges of the first panel;

wherein the primary female connector component comprises a barb and the primary male connector component comprises a hook wherein the hook defines a third hooked concavity, the third hooked concavity opening a second panel transverse direction generally parallel to the transversely extending edges of the second panel and the barb extending in the longitudinal direction;

wherein the structure is a ceiling framework and the structure-lining apparatus comprises a ceiling-lining apparatus and a shape of the barb of the primary female connector component of the first panel and a shape of the third hooked concavity of the primary male connector component of the second panel permit the second panel to hang in a hanging configuration from the first panel after the first panel is connected to the ceiling structure during formation of the at least one edge-to-edge connection by receiving the barb in the third hooked concavity.

2. A structure-lining apparatus according to claim 1 wherein the secondary male connector component is extended into the secondary female connector component to form the at least one edge-to-edge connection by forcing the first connector component of the first panel and the second connector component of the second panel together in the transverse direction.

3. A structure-lining apparatus according to claim 2 wherein the secondary male connector component is resiliently deformed during formation of the at least one edge-to-edge connection by forcing the first connector component of the first panel and the second connector component of the second panel together in the transverse direction to thereby apply a restorative force to the secondary female connector component when the at least one edge-to-edge connection is made, the restorative force acting to maintain the at least one edge-to-edge connection.

4. A structure-lining apparatus according to claim 2 wherein the secondary female connector component is resiliently deformed during formation of the at least one edge-to-edge connection by forcing the first connector component of the first panel and the second connector component of the second panel together in the transverse direction to thereby apply a second restorative force to the secondary male connector component when the at least one edge-to-edge connection is made, the second restorative force acting to maintain the at least one edge-to-edge connection.

5. A structure-lining apparatus according claim 1 wherein the secondary male connector component comprises a first hook tip and a first hooked concavity and the secondary female connector component comprises a second hook tip and a second hooked concavity and the at least one edge-to-edge connection comprises engagement of the first hook tip in the second hooked concavity and the second hook tip in the first hooked concavity to thereby lock the first connector component of the first panel to the second connector component of the second panel.

6. A structure-lining apparatus according to claim 1 wherein the primary male connector component is extended into the primary female connector component during formation of the at least one edge-to-edge connection by effecting relative pivotal motion between the first connector component of the first panel and the second connector component of the second panel.

7. A structure-lining apparatus according to claim 1 wherein the primary male connector component is partially extended into the primary female connector component during formation of the at least one edge-to-edge connection by effecting relative pivotal motion between the first connector component of the first panel and the second connector component of the second panel and the primary male connector component is partially extended into the primary female connector component during formation of the at least one edge-to-edge connection by forcing the first connector component of the first panel and the second connector component of the second panel together in the transverse direction.

8. A structure-lining apparatus according to claim 7 wherein the primary male connector component is partially extended into the primary female connector component during formation of the at least one edge-to-edge connection by forcing the first connector component of the first panel and the second connector component of the second panel together in the transverse direction after the primary male connector component is partially extended into the primary female connector component during formation of the at least one edge-to-edge connection by effecting relative pivotal motion between the first connector component of the first panel and the second connector component of the second panel.

9. A structure-lining apparatus according to claim 1 wherein the first panel comprises a longitudinally and transversely extending outer layer and a longitudinally and transversely extending inner layer at a location inwardly spaced apart from the outer layer.

10. A structure-lining apparatus according to claim 9 wherein the inner layer comprises one or more arcuate and outwardly projecting convexities.

11. A structure-lining apparatus according to claim 9 wherein the inner layer comprises an arcuate and outwardly projecting convex cross-section on a cross-sectional plane that is normal to the longitudinal direction.

12. A structure-lining apparatus according to claim 9 wherein each panel comprises one or more brace elements that extend between the inner layer and the outer layer.

13. A structure-lining apparatus according to claim 12 wherein the one or more braces comprises a plurality of braces and wherein the structure-lining apparatus comprises an internal stiffener located between the inner and outer layers and between a first brace and a second brace of the plurality of braces.

14. A structure-lining apparatus according to claim 13 wherein the internal stiffener comprises a different material than a material of the first and second panels.

15. A structure-lining apparatus according to claim 1 wherein at least one of the primary male and primary female connector components of the first panel is at least partially coated with a sealing material.

16. A structure-lining apparatus according to claim 1 wherein the primary male and female connector components are shaped such that extending the primary male connector component of the second connector component into the primary female connector component of the first panel can be effected without deformation of the primary male and female connector components.

17. A method for lining a structure with a lining surface, the method comprising:

attaching a first panel to a structure so that the panel extends in longitudinal and transverse directions and has longitudinally extending edges extending in the longitudinal direction and transversely extending edges extending in the transverse direction;

forming an edge-to-edge connection by connecting a second longitudinally extending edge of a second panel to a first longitudinally extending edge of the first panel in edge-to-edge relation via complementary connector components on their longitudinally extending edges to define at least a portion of a lining by:

extending a primary male connector component of a second connector component of the second longitudinally extending edge of the second panel into a primary female connector component of a first connector component of the first longitudinally extending edge of the first panel; and extending a secondary male connector component of the first connector component of the first panel into a secondary female connector component of the second connector component of the second panel;

wherein the primary female connector component is shaped to prevent removal of the primary male connector component therefrom and the secondary female connector component is shaped to prevent removal of the secondary male connector component therefrom; and attaching a first longitudinally extending edge of the second panel to the structure;

wherein the primary female connector component comprises a barb and the primary male connector component comprises a hook wherein the hook defines a third hooked concavity, the third hooked concavity opening a second panel transverse direction generally parallel to the transversely extending edges of the second panel and the barb extending in the longitudinal direction;

wherein attaching the first panel to the structure comprises attaching the first panel to a ceiling framework;

and wherein the method further comprises receiving the barb of the first panel in the third hooked concavity of the second panel and hanging the second panel from the first panel in a hanging configuration by supporting the second panel on the barb of the first panel.

* * * * *